US010005476B2

(12) United States Patent
Ooe

(10) Patent No.: US 10,005,476 B2
(45) Date of Patent: Jun. 26, 2018

(54) CONVEYANCE DEVICE UTILIZING COUPLED WAGONS

(71) Applicant: Masahiro Ooe, Shiga (JP)

(72) Inventor: Masahiro Ooe, Shiga (JP)

(73) Assignee: Daifuku Co., Ltd. (JP)

( * ) Notice: Subject to any disclaimer, the term of this patent is extended or adjusted under 35 U.S.C. 154(b) by 255 days.

(21) Appl. No.: 15/006,854

(22) Filed: Jan. 26, 2016

(65) Prior Publication Data

US 2016/0207543 A1 Jul. 21, 2016

Related U.S. Application Data

(63) Continuation of application No. PCT/JP2014/073452, filed on Sep. 5, 2014.

(30) Foreign Application Priority Data

Sep. 9, 2013 (JP) ..... 2013-185858
Sep. 9, 2013 (JP) ..... 2013-185859
Sep. 9, 2013 (JP) ..... 2013-185860

(51) Int. Cl.
*B61B 10/00* (2006.01)
*B61B 10/04* (2006.01)
*B61B 13/00* (2006.01)

(52) U.S. Cl.
CPC ..... *B61B 10/04* (2013.01); *B61B 13/00* (2013.01)

(58) Field of Classification Search
CPC ..... B61B 13/00; B61B 13/12; B61B 10/03; B61B 10/043; B61B 10/046; B65G 35/08
See application file for complete search history.

(56) References Cited

U.S. PATENT DOCUMENTS 6,415,905 B1 * 7/2002 Sundermeier ..... B65G 17/066 198/465.1
6,425,478 B1 * 7/2002 Eberle ..... B65G 23/16 198/795
9,044,901 B2 * 6/2015 Williams ..... B65G 17/46
9,475,645 B2 * 10/2016 Miller ..... B65G 17/086
2009/0173603 A1 * 7/2009 Hayashi ..... B61B 13/127 198/735.1
2016/0207543 A1 * 7/2016 Ooe ..... B61B 13/00

FOREIGN PATENT DOCUMENTS

JP 2013006495 A 1/2013

* cited by examiner

*Primary Examiner* — Jason C Smith
(74) *Attorney, Agent, or Firm* — St. Onge Steward Johnston & Reens LLC

(57) ABSTRACT

A conveyance device utilizing coupled wagons includes front and rear adjacent wagons and a pair of left and right coupling units coupling left and right side portions of the adjacent wagons. The coupling units are switchable between a coupled state in which the left and right side portions of the adjacent wagons are respectively allowed for relative horizontal rotations about vertical shafts and an uncoupled state. A first coupling control mechanism operating at least one of the coupling units is provided at a horizontal turn path section in a travel path. By the operation of the first coupling control mechanism, the conveying traveling body can enter the horizontal turn path section while the coupling unit on the inner side of the horizontal turn path section is in the coupled state and the coupling unit on the outer side of the horizontal turn path section is in the uncoupled state.

18 Claims, 33 Drawing Sheets

101
102
103
104
105
106A
106B
108
108a
108b
108c
108d
109
109a
109b
109c
110
110a
110b
110c
110d
110e
110f
111
111a
111b
111c
111d
111e
111f
112
112a
112b
113
113a
113b
117a
117b
118a
118b
119a
119b
120a
120b
121
122L
123L
124
124A
124B
125a
125b 101
102
103
104
106C
108
108a
108b
108c
109
109a
109b
109c
110
110a
110b
110c
110d
110e
110f
111
111a
111b
111c
111d
111e
111f
112
112a
112b
113
113a
113b
117a
117b
118a
118b
119a
119b
120a
120b
121
122L
124
125a
125b
129
130R
131

101
102
103
104
106C
108
108a
108b
108c
109
109a
109b
109c
110
110a
110b
110c
110d
110e
110f
111
111a
111b
111c
111d
111e
111f
112
112a
112b
113
113a
113b
117a
117b
118a
118b
119a
119b
120a
120b
121
122L
124
125a
125b
129
130R
131

201
202
203
204
205
206
207
208
209
210
211
212
213
214
215
216
217
218
219
220
221a
221b
222
223
224
225
227(226)
227a(226a)
227b(226b)
229(228)
229a(228a)
229b(228b)
230a
230d
231a
231d
232a
232b
232c
232d
233a
233b
233c
233d
234
235

CONVEYANCE DEVICE UTILIZING COUPLED WAGONS

FIELD OF THE INVENTION

The present invention relates to a conveyance device utilizing coupled wagons configured such that a conveying traveling body provided with a plurality of wagons disposed in series in a traveling direction and wagon-to-wagon coupling means is made to travel along a travel path having a horizontal turn path section.

BACKGROUND OF THE INVENTION

It is conventionally known, as described in Patent Literature 1 (Japanese Unexamined Patent Application Publication No. 2013-6495) for example, that a conveying traveling body used in an automobile assembly line, etc., so as to convey a large workpiece is composed of a central main wagon mainly used for workpiece support and the working floor with respect to left and right both side portions of the workpiece and a front and a rear two auxiliary wagons mainly used for the working floor with respect to front and rear both end portions of the workpiece. In this kind of conveyance device, it is also known from the above Patent Literature 1 that the central main wagon and the front and rear two auxiliary wagons are configured to be coupled by the wagon-to-wagon coupling means and handled as a single conveying traveling body to convey one workpiece by means of this plurality of front to rear wagons. However, in the configuration described in this Patent Literature 1, the wagon-to-wagon coupling means are provided in a normally coupled state to only one of left and right both side portions of the conveying traveling body, which side portion becomes the inner side in a curving direction of the horizontal turn path section in the travel path.

SUMMARY OF THE INVENTION

In the conventionally known configuration as described in the above Patent Literature 1, the conveying traveling body is horizontally turnable only in such a direction that the side face on the side where the wagon-to-wagon coupling means are located becomes the inner side. Thus, the travel path of the conveying traveling body is limited to a simple loop-shaped layout which can be constructed of horizontal turn path sections turning in one direction and straight-ahead path sections, and has no degree of freedom in layout.

Accordingly, the present invention proposes a conveyance device utilizing coupled wagons capable of solving the foregoing conventional problem. Described by giving reference symbols in parentheses used in the description of embodiments described later in order to facilitate understanding the relationship with the embodiments, a conveyance device utilizing coupled wagons according to the first aspect of the invention includes a conveying traveling body (1) having a plurality of wagons (2 to 4) disposed in series in a traveling direction and a wagon-to-wagon coupling means (13, 14); and a traveling drive means (26) to make the conveying traveling body (1) travel along a travel path, wherein the wagon-to-wagon coupling means (13, 14) includes a pair of left and right coupling units (13*a* to 14*b*) respectively coupling left and right both side portions of front and rear adjacent wagons (2, 3/3, 4), and the respective coupling units (13*a* to 14*b*) are configured to be switchable between a coupled state in which the left and right both side portions of the front and rear adjacent wagons (2, 3/3, 4) are respectively allowed for relative horizontal turns about vertical shafts (15, 18) and an uncoupled state, and at an entrance of each horizontal turn path section (5, 7) provided in the travel path, a first coupling control means (27) is disposed, and this first coupling control means (27) operates at least one of the pair of left and right coupling units (13*a* to 14*b*) between the respective wagons (2, 3/3, 4) of the conveying traveling body (1) entering the horizontal turn path section (5, 7), and the conveying traveling body (1) is made to enter into the horizontal turn path section (5, 7) while the coupling unit which becomes the inner side in a curving direction of the horizontal turn path section (5, 7) is in the coupled state and the coupling unit which becomes the outer side in the curving direction of the horizontal turn path section (5, 7) is in the uncoupled state.

A conveyance device utilizing coupled wagons according to the second aspect of the invention made to solve the same problem as that of the first aspect of the invention includes a conveying traveling body (201) provided with a plurality of wagons (202 to 204) disposed in series in a traveling direction and a wagon-to-wagon coupling means (205, 206); and a guide means for making the conveying traveling body (201) travel along a travel path, wherein the wagon-to-wagon coupling means (205, 206) has two links (226, 227/228, 229) having both ends pivotally supported respectively by vertical support shafts (226*a* to 227*b*/228*a* to 229*b*), to end portions laterally different from each other of front and rear two wagons to be coupled, and when the front and rear wagons coupled by the wagon-to-wagon coupling means (205, 206) adjoin each other in a straight ahead orientation, the two links (226, 227/228, 229) are configured to be vertically overlapped in an orientation perpendicular to a wagon straight ahead direction and to have the vertical support shafts (226*a* to 227*b*/228*a* to 229*b*) at both ends thereof positioned concentrically, and the guide means has left and right two guide roller rows (234, 235) and a guide rail (236 to 238) laid on the travel path of the conveying traveling body (201) and guiding at least one of the left and right two guide roller rows (234, 235), and when the respective wagons (202 to 204) adjoin each other in the straight ahead orientation, the left and right two guide roller rows (234, 235) includes intermediate rollers (232*b*, 232*c*/233*b*, 233*c*) pivotally supported to one of the front and rear two wagons coupled by the two links (226, 227/228, 229) so as to be rotatable about vertical axial centers concentric to the mutually concentric vertical support shafts (226*a* to 227*b*/228*a* to 229*b*) at both ends of the two links (226, 227/228, 229), and end rollers (232*a*, 232*d*/233*a*, 233*d*) pivotally supported rotatably about vertical axial centers to end portions on a side opposite to a side where the intermediate rollers are located of the wagons (202, 204) at front and rear both ends, so as to be positioned on a straight line passing the intermediate rollers (232*b*, 232*c*/233*b*, 233*c*) and being parallel to the wagon straight ahead direction.

According to the above configuration of the first aspect of the invention, when the conveying traveling body which has traveled the straight-ahead path section enters a counter-clockwise horizontal turn path section, the left coupling unit is brought into the coupled state and the right coupling unit is brought into the uncoupled state by the first coupling control means disposed at the entrance side of the counter-clockwise horizontal turn path section. When the conveying traveling body enters a clockwise horizontal turn path section, the right coupling unit is brought into the coupled state and the left coupling unit is brought into the uncoupled state by the first coupling control means disposed at the entrance side of the clockwise horizontal turn path section.

Thus, when the conveying traveling body travels the horizontal turn path section, side portions of the left and right side faces, which become the inner side in the curving direction, are always coupled by the coupling unit and the respective wagons constituting the conveying traveling body are relatively and horizontally turnable about the vertical shaft of the coupling unit, regardless of the curving direction of the horizontal turn path section. Since side portions which become the outer side in the curving direction are uncoupled, the wagons can travel smoothly while spread in a fan shape around an arc of the horizontal turn path section. In other words, by the configuration of the first aspect of the invention, the travel path of the conveying traveling body can be laid out freely by incorporating both of the counter-clockwise horizontal turn path section and the clockwise horizontal turn path section.

When the conveying traveling body travels the horizontal turn path section, the coupling unit which becomes the inner side in the curving direction of the path section is always in the coupled state. Therefore, both a pushing type and a pulling type can be used for the traveling drive means for making the conveying traveling body travel on the horizontal turn path section. For example, the conveying traveling body can be configured to be sent into the horizontal turn path section by a pushing drive means at the entrance side of the horizontal turn path section, continue to be subjected to a thrust from a pulling-in drive means at the exit side of the horizontal turn path section immediately after departing forward from the pushing drive means, and leave the horizontal turn path section in its entirety. In other words, the number of choices of the traveling drive means for making the conveying traveling body travel on the horizontal turn path section is increased, allowing for easy implementation.

In carrying out the first aspect of the invention, it is as a matter of course that the traveling guide means for moving the conveying traveling body (each wagon) along the travel path is necessary. For example, conventionally known guide means which guide wheels provided to the respective wagons by a guide rail on the travel path can be used. Since the conveying traveling body (each wagon) is guided so as to move along the travel path in this manner, a variety of conventionally known drive means can also be used as the traveling drive means for making the conveying traveling body travel along the travel path. For example, a train type that rotationally drives wheels of a specific wagon of the plurality of wagons constituting the conveying traveling body to be self-propelled, a chain drive type that engages a specific wagon of the plurality of wagons constituting the conveying traveling body with a driving chain moving along the travel path, a friction drive type that pressure-contacts a friction drive wheel on the ground side with a friction drive surface provided to continue parallelly to the traveling direction across the entire length of the conveying traveling body, etc., can be used. The traveling drive means do not necessarily have to be of the same type in the entire travel path, and different types of drive means between the straight-ahead path section and the horizontal turn path section can be used depending on the circumstances.

The respective coupling unit may be the one that allows the respective wagons of the conveying traveling body to travel the straight-ahead path section in an adjacent state of continuing with each other by all of the coupling units being brought into the coupled state. However, when the coupling unit having been switched into the uncoupled state by an operation is the one having a configuration that can be held in the uncoupled state even if released from the operation such as the one that is locked in the uncoupled state, the one that holds the uncoupled state with a spring force, etc., the coupling unit on either the left or right side or all of the coupling units can be configured to be in the uncoupled state even when the respective wagons of the conveying traveling body travel the straight-ahead path section in the adjacent state of continuing with each other.

In the case of implementing the conveyance device utilizing coupled wagons according to the first aspect of the invention, the first coupling control means (27) provided at the entrance side of the horizontal turn path section (5, 7) switches the coupling unit of the pair of left and right coupling units (13*a* to 14*b*), which coupling unit being on a side opposite to the curving direction of the horizontal turn path section (5, 7), to the uncoupled state. A second coupling control means (28) for returning the coupling unit of the pair of left and right coupling units (13*a* to 14*b*), which coupling unit having been switched into the uncoupled state at the entrance side of the horizontal turn path section (5, 7), to the coupled state is provided at an exit side of the horizontal turn path section (5, 7). The conveying traveling body (1) can be configured to travel with all of the coupling units (13*a* to 14*b*) being in the coupled state on the straight-ahead path section (6) in the travel path. In this case, the coupling units (13*a* to 14*b*) can each include the vertical shaft (15, 18) positionally fixed to one (3) of the wagons, a vertically movable bearing member (17, 20) provided to the other wagon (2, 4) so as to be fittable and detachable with respect to the vertical shaft (15, 18), and a cam follower portion (a cam follower roller 29) provided to the movable bearing member (17, 20). The first and second coupling control means (27, 28) can be constituted by a cam rail (30) acting upon the cam follower portion (the cam follower roller 29) and keeping the movable bearing member (17, 20) detached upward from the vertical shaft (15, 18) for a fixed zone. With this configuration, a means for holding the movable bearing member in the uncoupled state of being detached upward from the vertical shaft is unnecessary, and further, the first coupling control means at the entrance side and the second coupling control means at the exit side can be implemented inexpensively only by using the same cam rail having a fixed length.

A preferable configuration example as the guide means for guiding the conveying traveling body so as to move along the travel path will be given. The conveying traveling body (1) can be provided with left and right two guide roller rows (21, 22), and each of the guide roller rows (21, 22) can include an intermediate-position roller (21*b*, 21*c*, 22*b*, 22*c*) provided rotatably about an axial center of the vertical shaft (15, 18) of each coupling unit (13*a* to 14*b*) at a position immediately below the vertical shaft (15, 18), and end-position rollers (21*a*, 21*d*, 22*a*, 22*d*) provided rotatably about vertical axial centers at front and rear both ends of the conveying traveling body (1). On the straight-ahead path section (6) of the travel path, a guide rail (23) can be laid that guides the conveying traveling body (1) via the respective rollers of at least one of the left and right two guide roller rows (21, 22). On the horizontal turn path section (5, 7) of the travel path, a circular guide rail (25) can be laid that guides the conveying traveling body (1) via the respective rollers of the guide roller row (21/22) which is located on the inner side in the curving direction of the path section. With this configuration, the respective wagons of the conveying traveling body traveling while spread in a fan shape can be guided smoothly especially on the horizontal turn path section.

In the case of employing the first coupling control means (27) or both the first and second coupling control means (27, 28), and the left and right two guide roller rows (21, 22), each of the first and second coupling control means can be juxtaposed with a guide rail (31) controlling moving paths of the respective rollers of the guide roller row (21/22) on a side where the coupling unit (13*a* to 14*b*) controlled by the coupling control means is located. By this configuration, effects by lateral and transverse displacement relative to the traveling direction of the coupling units whose coupled state is controlled by the first coupling control means or both the first and second coupling control means can be eliminated and the control of the coupling state can be performed reliably and excellently.

Furthermore, in the case of employing a traveling drive means, as the traveling drive means of the conveying traveling body, including a friction drive load bar attached to the conveying traveling body so as to continue across the entire length thereof and a friction drive unit provided with a friction drive wheel disposed on the travel path side and rotating in pressure contact with the load bar, the load bar (8) can have a plurality of load bar units (8*a* to 8*c*) on at least one of left and right side faces of the respective wagons (2 to 4), the load bar units divided for the respective wagons and disposed in series in the traveling direction, and the load bar units (8*a* to 8*c*) can be configured to be horizontally turnably coupled together by the vertical shaft (15) of the coupling unit (13*a*, 13*b*). The friction drive load bar (8, 9) is preferably disposed on the left and right both side faces of the conveying traveling body (1).

In the case of employing the load bar (8/9) and the second coupling control means (28), the second coupling control means (28) can be juxtaposed with a guide roller pair (32, 33) sandwiching from the left and right both sides the load bar units (8*a* to 8*c*/9*a* to 9*c*) on the side of the coupling unit (13*a*, 13*b*/14*a*, 14*b*) controlled by the second coupling control means (28) and controlling moving paths of the load bar units. With this configuration, the occurrence of the lateral and transverse displacement relative to the traveling direction of the coupling unit which is in the uncoupled state and separated from each other can be prevented by the guide roller pair with the use of the friction drive load bar. The returning operation to the coupled state by the second coupling control means can be performed reliably and smoothly.

According to another embodiment of the first aspect of the invention, all of the coupling units (112*a* to 113*b*) of the wagon-to-wagon coupling means (112, 113) are separated into coupling units at a left row (112*a*, 113*a*) and coupling units at a right row (112*b*, 113*b*) and configured to be switchable between the coupled state and the uncoupled state in an alternative way such that only the coupling units at either one of the left and right rows are brought into the coupled state. The first coupling control means (128, 131) disposed before the horizontal turn path section (105, 107) in the travel path is configured to switch the coupling units of the coupling units at the left and right two rows (112*a*, 113*a*/112*b*, 113*b*), which coupling units at the row on a side of the curving direction of the horizontal turn path section (105, 107), into the coupled state, when the conveying traveling body (101) with the coupling units at the row on a side opposite to the curving direction of the horizontal turn path section (105, 107) being in the coupled state passes.

According to the configuration of this other embodiment, the conveying traveling body traveling the straight-ahead path section has the wagons securely coupled by the coupling units at one of the left and right both rows, which coupling units being in the coupled state, so that not only can an object be conveyed by a single conveying traveling body having such a size that a plurality of front to rear wagons are integrated but also a drive means of type that tows the rear wagon by the front wagon can be utilized without problems as the traveling drive means for propelling the conveying traveling body, without limiting to a drive means of the type that pushes the front wagon by the rear-end wagon.

Furthermore, with respect to the horizontal turn path section where one side of the rows of the coupling units in the coupled state becomes the inner side in the curving direction, the conveying traveling body can be sent as-is into the horizontal turn path section and made to travel along the horizontal turn path section while the respective wagons are spread in a fan shape around the positions of the coupled coupling units. With respect to the horizontal turn path section where one side of the rows of the coupling units in the coupled state becomes the outer side in the curving direction, conversely, the respective coupling units in the uncoupled state at the opposite row are switched into the coupled state before the horizontal turn path section by the first coupling control means, so that again the conveying traveling body can be sent as-is into the horizontal turn path section and made to travel along the horizontal turn path section while the respective wagons are spread in a fan shape around the positions of the coupled coupling units, without problems. That is, the conveying traveling body can be made to travel smoothly while the respective wagons are spread in a fan shape on the horizontal turn path section regardless of the curving direction thereof.

Further, in the case of implementing the other embodiment, each of the pair of left and right coupling units (112*a* to 113*b*) can have a vertical shaft (118*a*, 118*b*, 120*a*, 120*b*) provided to one of the wagons and a hook-shaped coupling tool (117*a*, 117*b*, 119*a*, 119*b*) provided to the other wagon so as to be laterally fittable and detachable with respect to the vertical shaft. The respective hook-shaped coupling tools of the pair of left and right coupling units (112*a* to 113*b*) can be disposed such that lateral positions with respect to the vertical shafts are reverse to each other. The vertical shafts and hook-shaped coupling tools of the coupling units (112*a*, 113*a*/112*b*, 113*b*) at one of the left and right rows can be configured to be fitted to each other and the vertical shafts and hook-shaped coupling tools of the coupling units (112*b*, 113*b*/112*a*, 113*a*) at the other row can be configured to be detached from each other by laterally and relatively moving the vertical shafts and hook-shaped coupling tools of the respective coupling units (112*a* to 113*b*). With this configuration, the pair of left and right hook-shaped coupling tools only need to be laterally moved integrally when the pair of left and right coupling units are switched between the coupled state and the uncoupled state. The configuration of the operation means to reversibly switch the pair of left and right coupling units is simplified as compared to the case where such a coupling unit is provided in a left-right pair that uses a vertically movable bearing plate having a bearing hole instead of the hook-shaped coupling tool and is switched between the coupled state and the uncoupled state by vertically moving the movable bearing plate with respect to the vertical shaft.

In the case of implementing the above configuration, the vertical shafts (118*a*, 118*b*, 120*a*, 120*b*) and the hook-shaped coupling tools (117*a*, 117*b*, 119*a*, 119*b*) can be positionally fixed to the wagons (102 to 104) respectively. When the wagon (103) provided with these vertical shafts and the wagon (102, 104) provided with the hook-shaped coupling tools are laterally and relatively moved, the hook-shaped coupling tool can be configured to be fitted to the vertical shaft in each coupling unit (112*a*, 113*a*/112*b*, 113*b*)

at one of the left and right both rows and the hook-shaped coupling tool can be configured to be detached from the vertical shaft in each coupling unit at the other row. The coupling control means (128, 131) can be constituted by a controlling guide rail (126, 129) guiding the respective wagons (102 to 104) so as to laterally and relatively move the wagon (103) provided with the vertical shafts and the wagon (102, 104) provided with the hook-shaped coupling tools. With this configuration, movable components constituting the coupling units can be made completely unnecessary on the respective wagons, and the wagons can be constructed simply. Further, also as the means for switching the coupled state, this configuration only needs to slightly move a specific wagon laterally, and thus, can be implemented extremely easily and inexpensively by using the guide rail controlling the travel path of the wagons.

Further, the conveying traveling body (101) can be provided with left and right two guide roller rows (110, 111). Each guide roller row (110, 111) can include rollers (110*a* to 110*f*, 111*a* to 111*f*) pivotally supported at left and right both side portions of front and rear both ends of respective wagons (102 to 104) so as to be rotatable about vertical axial centers. The roller (110*c*, 110*d*, 111*c*, 111*d*) of the rollers which is disposed below the vertical shaft (118*a*, 118*b*, 120*a*, 120*b*) of each of the coupling units (112*a* to 113*b*) can be disposed concentric to the vertical shaft. The hook-shaped coupling tool (117*a*, 117*b*, 119*a*, 119*b*) of each of the coupling units (112*a* to 113*b*) can have a fitting groove (121) with respect to the vertical shaft, the fitting groove having an arc shape around the vertical axial center of the roller (110*b*, 110*e*, 111*b*, 111*e*) disposed therebelow and having an opened end portion adjacent to the vertical shaft. A straight-ahead guide rail (122L, 122R) that guides the respective wagons (102 to 104) via the rollers on the same side as the row of the coupling units in the coupled state of the respective left and right rows of the coupling units (112*a* to 113*b*) can be laid on the straight-ahead path section (106A to 106D) in the travel path of the conveying traveling body (101). A circular guide rail (123L, 123R) that guides the respective wagons (102 to 104) via the rollers on the same side as the row of the coupling units in the coupled state of the respective left and right rows of the coupling units (112*a* to 113*b*) can be laid on the horizontal turn path section (105, 107). When a lateral position of the circular guide rail (123L, 123R) in the horizontal turn path section (105, 107) and a lateral position of the straight-ahead guide rail (122L, 122R) in the straight-ahead path section (106A, 106C) before the horizontal turn path section (105, 107) are opposite, the controlling guide rail (126, 129) can be disposed on a way to the straight-ahead path section (106A to 106D) and a second straight-ahead guide rail (127L, 130R) connecting the controlling guide rail (126, 129) and the circular guide rail (123L, 123R) in the horizontal turn path section (105, 107) can be laid. By this configuration, the conveying traveling body can be made to travel smoothly and safely at all times on the straight-ahead path section and both counterclockwise and clockwise horizontal turn path sections in the travel path of the conveying traveling body. A practical layout of the travel path can be realized freely.

The traveling drive means for making the conveying traveling body travel along the travel path may be of any configuration. However, when the traveling drive means comprises load bars mounted to the conveying traveling body (101) parallelly to the traveling direction and a friction drive wheel (125*a*) provided on the travel path side so as to pressure-contact with side surfaces of the load bars, the load bars can be include of load bar units (108*a* to 108*c*, 109*a* to 109*c*) divided for the wagons (102 to 104) and respectively arranged along the left and right both side faces of the wagons (102 to 104). The rollers (110*a* to 110*f*, 111*a* to 111*f*) constituting the left and right two guide roller rows (110, 111) can be pivotally supported at front and rear both end portions of the respective load bar units (108*a* to 108*c*, 109*a* to 109*c*) at the left and right two rows. With this configuration, the pair of left and right load bars necessary for the friction drive means for smoothly frictionally driving the conveying traveling body on any of the counterclockwise and clockwise horizontal turn path sections can also be used as bearing seats for constituting the left and right two guide roller rows for making the conveying traveling body travel smoothly on any of the counterclockwise and clockwise horizontal turn path sections, and also the pair of left and right coupling units can be constructed simply by using the end portions of the respective load bar units.

According to the configuration of the second aspect of the invention, when the front wagon advances in a straight-ahead direction of the rear wagon, the two links of the wagon-to-wagon coupling means coupling these front and rear two wagons are vertically overlapped in an orientation perpendicular to the straight-ahead direction of the front and rear two wagons and the vertical support shafts pivotally supporting both ends of both links are positioned concentrically to each other. Thus, the front and rear two wagons are in a state that adjoin each other and can only integrally travel straight ahead, and the rear wagon does not depart rearward or sway laterally with respect to the front wagon, so that all wagons disposed in series can travel straight ahead integrally. Moreover, should a situation arise where the front wagon laterally changes its orientation and travels, the two links of the wagon-to-wagon coupling means coupling the front and rear wagons can be spread about the vertically mutually concentric vertical support shafts positioned on the inner side in the turning direction of the front wagon while one of the links which is pivotally supported to the front wagon on the outer side in the turning direction is integral with the front wagon and the other link is integral with the rear wagon. Thus, the front wagon can change its orientation toward any of the left and right sides with respect to the rear wagon and travel.

According to the configuration of the second aspect of the invention, as described above, the plurality of wagons disposed in series can be integrated and made to travel like a single long wagon only by guiding the respective wagons of the conveying traveling body so as to be able to travel along the travel path. Furthermore, on any of the counterclockwise and clockwise horizontal turn path sections as well, the respective wagons can be made to travel smoothly while spread in a fan shape around the coupling shafts (the vertical support shafts) between the respective wagons, which shafts become the inner side of the curve of the horizontal turn path section. Thus, the travel path of the conveying traveling body can be laid out freely by incorporating both the counterclockwise horizontal turn path section and the clockwise horizontal turn path section. Even with such a large conveying traveling body having a long entire length that cannot be constructed unless a plurality of wagons are disposed in series, the configuration is useful to make the curvature of the horizontal turn path section smaller and make the path length shorter to make the occupied floor area smaller. Furthermore, with the configuration of the present invention, mechanisms for respectively switching the pair of left and right coupling units provided to the left and right both side portions between both wagons, that is, switching one of the coupling units into the coupled state and the other coupling unit into the uncoupled state according to the curving direction of the horizontal turn path section, before the horizontal turn path section, and control of the mechanisms are completely unnecessary. Not only is the entire configuration simplified but also a situation in which the wagons cannot turn due to a failure of the control system can be avoided.

Further, since the front and rear wagons are always in the state of being coupled via the two links, the drive means of the type that tows the rear wagon by the front wagon can be utilized without problems as the traveling drive means for propelling the conveying traveling body, without limiting to the drive means of the type that pushes the front wagon by the rear wagon. Further, the respective wagons are in the state of being coupled by the coupling shafts (the vertical support shafts) which become the inner side in the curving direction also when the conveying traveling body travels the horizontal turn path section similar to when traveling the straight-ahead path section. Thus, both a pushing type and a pulling type can be used for the traveling drive means for making the conveying traveling body travel on the horizontal turn path section, similar to the straight-ahead path section.

In implementing the second aspect of the invention as well, it is as a matter of course that the guide means and traveling drive means for making the conveying traveling body (the respective wagons) travel along the travel path are necessary. As these guide means and traveling drive means, the ones having a variety of configurations can be used similar to the first aspect of the invention described earlier. As a matter of course, similar to the first aspect of the invention, the traveling drive means do not necessarily have to be of the same type in the entire travel path, and different types of drive means between the straight-ahead path section and the horizontal turn path section can be used depending on the circumstances.

In the case of implementing the conveyance device utilizing coupled wagons according to the second aspect of the invention, the two links (226, 227/228, 229) of the wagon-to-wagon coupling means (205, 206) can be disposed at positions entering below either one (203) of the front and rear adjacent wagons (202, 203/203, 204) when the front and rear both wagons (202, 203/203, 204) coupled by the links adjoin each other in the straight ahead orientation. With this configuration, even where such a configuration is adopted that the central wagon of the wagons serves as a large wagon long in the traveling direction for supporting the object as compared to the wagons at the front and rear both ends, it becomes possible to adopt such a configuration that intervals of the respective rollers of the left and right two guide roller rows are equalized and projecting amounts of the respective wagons at the time of traveling the horizontal turn path section which project toward the center side of the curve of the horizontal turn path section are equalized.

Further, rod members (209 to 211/212 to 214) can be disposed at left and right rows along the left and right both side faces of the respective wagons (202 to 204). The two links (226, 227/228, 229) of the wagon-to-wagon coupling means (205, 206) can have end portions pivotally supported above front and rear adjacent end portions of the rod members (209 to 211, 212 to 214) by the vertical support shafts (226*a* to 227*b*/228*a* to 229*b*). The intermediate rollers (232*b*, 232*c*/233*b*, 233*c*) of the left and right tow guide roller rows (234, 235) can be pivotally supported below either one of the front and rear adjacent end portions of the rod members (209 to 211/212 to 214), and the end rollers (232*a*, 232*d*/233*a*, 233*d*) can be pivotally supported below free end portions of the rod members (209, 211/212, 214) of the wagons (202, 204) at the front and rear both ends. With this configuration, all of the wagon-to-wagon coupling means and the left and right two guide roller rows can be configured by mounting the same to the pair of left and right rod members mounted to the respective wagons. Thus, the assembling work can be facilitated and moreover assembling with high precision is allowed as compared to the case where each component for constituting the wagon-to-wagon coupling means and the left and right two guide roller rows needs to be mounted to the wagons individually.

The above configuration can be easily implemented by being configured as follows. That is, the front and rear adjacent end portions of the rod members (209, 210/210, 211/212, 213/213, 214) are vertically overlapped and formed in an arc shape concentric to the vertical support shafts (226*a* to 227*b*/228*a* to 229*b*). When the respective wagons (202 to 204) adjoin each other in the straight ahead orientation, the rod members (209 to 211/212 to 214) at the left and right two rows constitute load bars at left and right two rows (207, 208) for friction drive continuing across the entire length of the conveying traveling body (201) and being horizontally bendable at positions of the vertical support shafts (226*a* to 227*b*/228*a* to 229*b*) positioned between the front and rear adjacent wagons. The link (226, 228) of the two links (226, 227/228, 229) which is located on the lower side has one end pivotally supported directly by a vertical support shaft (226*a*, 228*a*), above an upper end portion (209*d*, 211*d*) of the rod member (209, 211) targeted for pivotal support, and has the other end supported to an upper end portion of a long vertical support shaft (226*b*, 228*b*) erected from a lower end portion (213*d*, 213*e*) of the rod member (213) targeted for pivotal support. The link (227, 229) which is located on the upper side has both ends pivotally supported by vertical support shafts (227*a*, 227*b*/229*a*, 229*b*), to bearing members (210*f*, 210*g*, 212*e*, 214*e*) mounted at positions apart from the end portions of the rod members (210, 212, 214) each targeted for pivotal support and extending above the link (226, 228) which is located on the lower side. The upper end portion (212*d*, 214*d*) of the rod member (212, 214) overlapping on the lower end portion (213*d*, 213*e*) of the rod member (213) on which the long vertical support shaft (226*b*, 228*b*) is erected is formed with a notched groove (212*f*, 214*f*) to which the long vertical support shaft (226*b*, 228*b*) is fitted. A friction drive wheel (221*a*) disposed on the travel path side so as to pressure-contact with a side surface of at least one of the load bars at the left and right two rows (207, 208) constitutes the traveling drive means (222) for making the conveying traveling body (201) travel.

The travel path of the conveying traveling body (201) is preferably configured as follows. That is, the travel path of the conveying traveling body (201) is constructed by combining a straight-ahead path section (239, 241, 243), a counterclockwise horizontal turn path section (240), and a clockwise horizontal turn path section (242). On each of the horizontal turn path sections (240, 242), a circular guide rail (237, 238) is laid that guides the respective rollers of the guide roller row (234/235) of the left and right two guide roller rows (234, 235) which is located on the inner side in a curving direction of the horizontal turn path section (240, 242). At an upstream region of the straight-ahead path section (241, 243), a straight-ahead guide rail (236L, 236R) is laid that is connected to the circular guide rail (237, 238) laid on the horizontal turn path section (240, 242) upstream from the straight-ahead path section. At a downstream region of the straight-ahead path section (239, 241), a straight-ahead guide rail (236L, 236R) is laid that is connected to the circular guide rail (237, 238) laid on the horizontal turn path section (240, 242) downstream from the straight-ahead path section. When the straight-ahead guide rail at the upstream region of the straight-ahead path section and the straight-ahead guide rail at the downstream region are located on the same left or right side, both of these straight-ahead guide rails are connected with each other to continue. When located at laterally opposite positions, the straight-ahead guide rails (236L, 236R) at the both regions are laid such that an exit position of the upstream straight-ahead guide rail (236L) and an entrance position of the downstream straight-ahead guide rail (236R) are not apart in the traveling direction.

BRIEF DESCRIPTION OF THE DRAWINGS

FIGS. 1 to 18B illustrate a basic embodiment of the first aspect of the invention, and FIG. 1 is a schematic plan view illustrating a travel path of conveying traveling bodies.

FIG. 4 is a front view illustrating the pair of left and right load bars, a traveling guide means, a friction drive means, and the wheels.

FIG. 5 is a partially cutaway side view illustrating an essential part including the wagon-to-wagon coupling means of the conveying traveling body and the first coupling control means for coupling release.

FIG. 12 is a plan view illustrating a specific configuration of the second coupling control means which returns each coupling unit from the uncoupled state to the coupled state.

FIG. 13 is a side view of the second coupling control means as above viewed from the inside.

FIG. 14 is a view taken in the direction of arrow X of FIG. 13.

FIG. 15 is a view taken in the direction of arrow Y of FIG. 13.

FIG. 17 is a side view of an essential part explaining a time of abnormal operation of the second coupling control means as above.

FIGS. 18A and 18B illustrate variations of the basic embodiment of the first aspect of the invention and are schematic plan views illustrating traveling states of the conveying traveling bodies on the horizontal turn path sections.

FIGS. 19A to 28 illustrate another embodiment of the first aspect of the invention, and FIGS. 19A and 19B are schematic plan views explaining a travel path of the conveying traveling bodies.

FIG. 23 is a plan view illustrating an arrangement of the functional components of the conveying traveling body at the time when the coupling units at the row laterally opposite to the state illustrated in FIG. 20A are in the coupled state.

FIG. 24 is a front view of an essential part at the time when the conveying traveling body in the state illustrated in FIG. 21A is on the travel path.

FIG. 28 is a plan view illustrating a situation immediately before entering a clockwise horizontal turn path section subsequent to FIGS. 27A and 27B.

FIGS. 29A to 36 illustrate an embodiment of the second aspect of the invention, and FIG. 29A is a plan view illustrating an arrangement of functional components of a conveying traveling body, and FIG. 29B is a side view of the conveying traveling body.

FIG. 36 is a plan view illustrating an example of a layout of the travel path of the conveying traveling bodies.

DETAILED DESCRIPTION OF THE INVENTION

Figure 1:
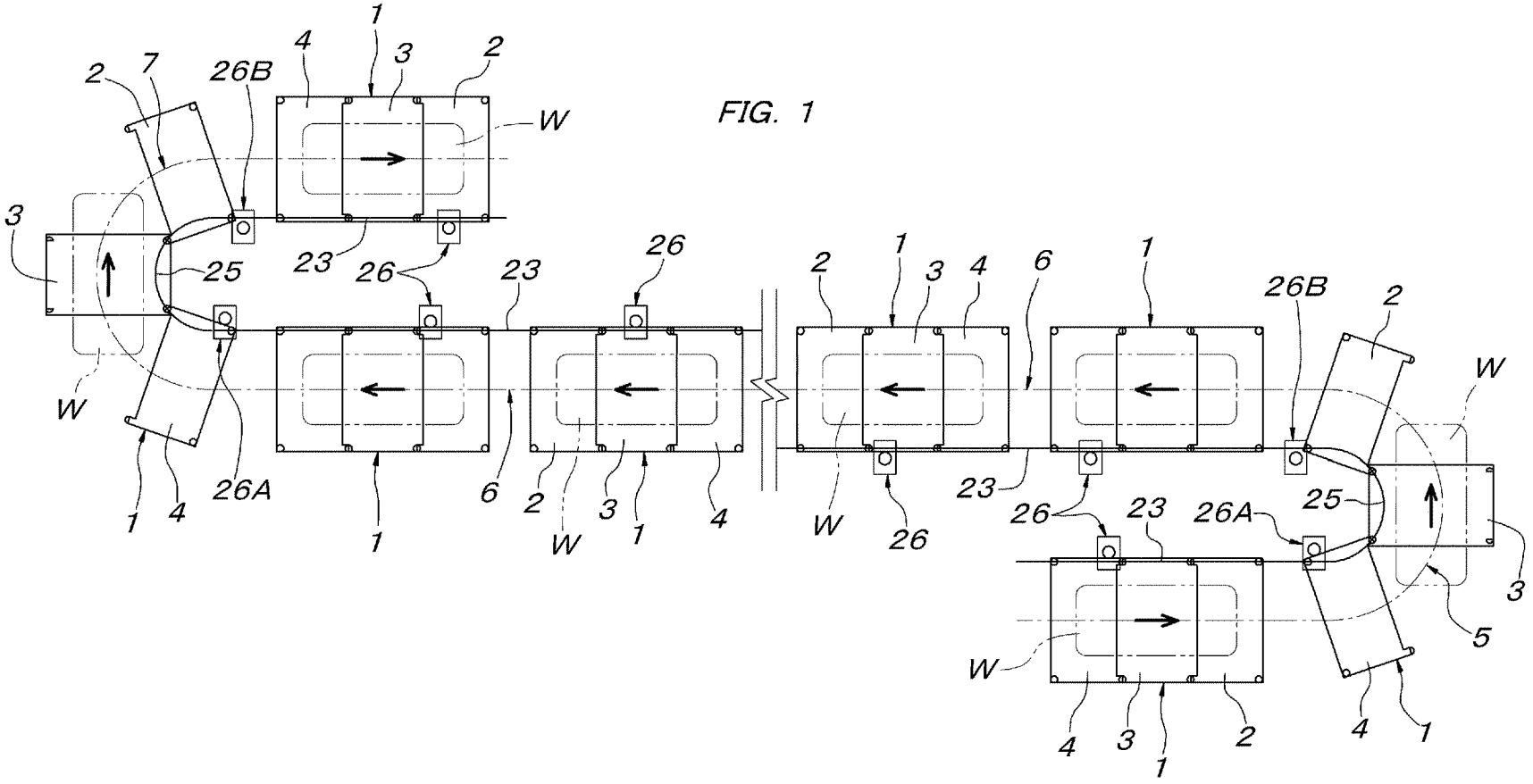

Hereinafter, an embodiment of the first aspect of the invention will be described based on FIGS. 1 to 18B. In FIG. 1, a conveying traveling body 1 is constituted of three wagons 2 to 4 disposed in series in a traveling direction. A central wagon 3 has a length in the traveling direction longer than the other wagons 2, 4 and serves as the central main wagon used for support of a workpiece W such as an automotive vehicle body and the working floor with respect to left and right both side portions of the workpiece W. The front- and rear-both end wagons 2, 4 have the same length and serve as the auxiliary wagons mainly used for the working floor with respect to front and rear both end portions of the workpiece W. A travel path of this conveying traveling body 1 is constructed by combining a counterclockwise horizontal turn path section 5, a straight-ahead path section 6, and a clockwise horizontal turn path section 7.

As illustrated in FIGS. 2A to 4, the conveying traveling body 1 has a pair of left and right load bars 8, 9 having the same length as the entire length of the conveying traveling body 1 and provided along left and right both side faces of the conveying traveling body 1. The load bars 8, 9 are constituted of load bar units 8*a* to 8*c* and 9*a* to 9*c* divided for respective wagons 2 to 4 and attached to bottom surfaces of the wagons along the left and right both side faces of the respective wagons 2 to 4. Each of the wagons 2 to 4 is provided with four, front and rear two pairs of left and right caster wheels 10 to 12 rolling on the floor surface. Between front and rear adjacent wagons 2, 3 and wagons 3, 4, wagon-to-wagon coupling means 13, 14 coupling these front and rear two wagons together are provided.

Each of the load bar units 8*a* to 8*c* and 9*a* to 9*c* constituting the load bars 8, 9 has a square columnar shape, has two places near both ends in the length direction whose upper surfaces are mounted to the bottom surface of each wagon 2 to 4 via mounting members 8*d* to 8*f* and 9*d* to 9*f*, and has left and right both side surfaces serving as friction drive surfaces. The wagon-to-wagon coupling means 13, 14 are constituted of coupling units 13*a*, 13*b* and 14*a*, 14*b* respectively coupling the three load bar units 8*a* to 8*c* and 9*a* to 9*c* disposed in series in the traveling direction to be assembled into the one load bar 8, 9.

The pair of left and right coupling units 13*a*, 13*b* constituting the wagon-to-wagon coupling means 13 between the wagons 2, 3 each comprise a vertical shaft 15 protruded upward from a one step lower step surface of a front end of the load bar unit 8*b*, 9*b* fixed to the wagon 3, and a movable bearing member 17 coupled to a rear end portion of the load bar unit 8*a*, 9*a* fixed to the wagon 2 so as to be vertically swingable about a horizontal support shaft 16. The pair of left and right coupling units 14*a*, 14*b* constituting the wagon-to-wagon coupling means 14 between the wagons 3, 4 each comprise a vertical shaft 18 protruded upward from a one step lower step surface of a rear end of the load bar unit 8*b*, 9*b* fixed to the wagon 3, and a movable bearing member 20 coupled to a front end portion of the load bar unit 8*c*, 9*c* fixed to the wagon 4 so as to be vertically swingable about a horizontal support shaft 19. The movable bearing member 17 on the load bar unit 8*a*, 9*a* side has a free end portion provided with a connection hole 17*a* vertically fittable and detachable with respect to the counterpart vertical shaft 15 on the front end portion of the load bar unit 8*b*, 9*b*. The movable bearing member 20 on the load bar unit 8*c*, 9*c* side has a free end portion provided with a connection hole 20*a* vertically fittable and detachable with respect to the counterpart vertical shaft 18 on the rear end portion of the load bar unit 8*b*, 9*b*.

The movable bearing members 17, 20 at the end portions of the load bar units 8*a*, 8*c* and 9*a*, 9*c*, and the one step lower end portions provided with the vertical shafts 15, 18 of both ends of the load bar unit 8*b*, 9*b* are configured such that the three load bar units 8*a* to 8*c* and 9*a* to 9*c* disposed in series form a single square columnar load bar 8, 9 in which the left and right both side surfaces (the friction drive surfaces) and upper and lower both side surfaces continue substantially flush when the connection holes 17*a*, 20*a* of the movable bearing members 17, 20 are in a coupled state of being fitted to the counterpart vertical shafts 15, 18. The load bar units 8*a*, 8*c* and 9*a*, 9*c* having the movable bearing members 17, 20 and the load bar unit 8*b*, 9*b* having the vertical shafts 15, 18 become horizontally relatively swingable about the vertical shafts 15, 18 when the connection holes 17*a*, 20*a* of the movable bearing members 17, 20 of the respective coupling units 13*a*, 13*b* and 14*a*, 14*b* are in the coupled state of being fitted to the counterpart vertical shafts 15, 18.

The conveying traveling body 1 is provided with left and right two guide roller rows 21, 22 provided on center lines along the length direction of the load bars 8, 9. Each guide roller row 21, 22 has intermediate-position rollers 21*b*, 21*c* and 22*b*, 22*c* provided rotatably about axial centers of the vertical shafts 15, 18 of the respective coupling units 13*a*, 13*b* and 14*a*, 14*b* at positions immediately below the vertical shafts 15, 18, and end-position rollers 21*a*, 21*d* and 22*a*, 22*d* provided to front and rear both ends of the load bar 8, 9, that is, the front end portion of the load bar unit 8*a*, 9*a* and the rear end portion of the load bar unit 8*c*, 9*c* so as to be rotatable about vertical axial centers. The vertical shafts 15, 18 constituting the coupling units 13*a*, 13*b* and 14*a*, 14*b* can be constructed by extending the vertical support shafts supporting the intermediate-position rollers 21*b*, 21*c* and 22*b*, 22*c* upward.

On the straight-ahead path section 6 in the travel path of the conveying traveling body 1, a channel guide rail 23 has a pair of left and right rail members to sandwich, from the left and right both sides, the respective rollers 21*a* to 21*d* or 22*a* to 22*d* of at least one of the pair of left and right guide roller rows 21, 22 of the conveying traveling body 1, and a pair of left and right wheel guide rails 24*a*, 24*b* to control rolling paths of the caster wheels 10 to 12 of the respective wagons 2 to 4 are disposed as a travel guide means for making the conveying traveling body 1 travel along the straight-ahead path section 6, as illustrated in FIG. 2A to FIG. 4. On the horizontal turn path section 5, 7 in the travel path of the conveying traveling body 1, a channel circular guide rail 25 includes a pair of left and right rail members to sandwich, from the left and right both sides, the respective rollers 21*a* to 21*d* or 22*a* to 22*d* of one of the pair of left and right guide roller rows 21 or 22 of the conveying traveling body 1, which row is located on a curving direction side of the horizontal path section 5, 7 is arranged as a travel guide means for making the conveying traveling body 1 travel along the horizontal turn path section 5, 7, as illustrated in FIGS. 9A to 11B illustrating the clockwise horizontal turn path section 7. In order for the respective rollers 21*a* to 21*d* or 22*a* to 22*d* of the guide roller row 21 or 22 to smoothly enter the circular guide rail 25 of the horizontal turn path section 5, 7, a guide rail 23 connected to the circular guide rail 25 laid along the horizontal turn path section 5, 7 is preferably laid at least at a terminal end region of the straight-ahead path section 6, which leads to the entrance of the horizontal turn path section 5, 7.

As a traveling drive means for making the conveying traveling body 1 travel along the travel path, a friction drive means utilizing the pair of left and right load bars 8, 9 provided to the conveying traveling body 1 is used. As illustrated in FIG. 2A to FIG. 4, this friction drive means 26 has a friction drive wheel 26*a* and a backup roller 26*b* to sandwich the load bar 8 or 9 from the left and right both sides, and a motor to rotationally drive the friction drive wheel 26*a* although an illustration thereof is omitted. The friction drive means 26 is a conventionally known one that provides a thrust to the conveying traveling body 1 via the load bar 8 or 9 by means of rotation of the friction drive wheel 26*a*. At a zone in the travel path of the conveying traveling body 1 where the conveying traveling bodies 1 are driven to travel at a constant speed at a regular interval, the friction drive means 26 are disposed on the moving path of the load bar 8 or 9 at an interval shorter than the entire length of the conveying traveling body 1, that is, the entire length of the load bar 8 or 9. In a pushing travel zone where the conveying traveling body 1 is pushed by the subsequent conveying traveling body 1 to make the respective conveying traveling bodies 1 travel at a constant speed in a bumper to bumper state of abutting against each other in the front-rear direction, it is known to dispose the friction drive means 26 at two places, the entrance and the exit, of the zone.

The friction drive means 26 driving the conveying traveling body 1 to travel on the horizontal turn path section 5, 7 is disposed such that the conveying traveling body 1 is propelled via the load bar 8 or 9 of the pair of left and right load bars 8, 9 of the conveying traveling body 1, which load bar is located on the inner side in the curving direction of the horizontal turn path section 5, 7 and is in the continuous state in which the respective load bar units 8*a* to 8*c* or 9*a* to 9*c* are coupled by the coupling units 13*a*, 14*a* or 13*b*, 14*b* of the wagon-to-wagon coupling means 13, 14, as illustrated in FIGS. 9A to 11B. Since the load bar 8 or 9 in the continuous state has a relatively large bending angle on the horizontal turn path section 5, 7 having such a curvature that the path length of the circular guide rail 25 in the horizontal turn path section 5, 7 is almost as long as the entire length of the load bar 8 or 9 in the continuous state as shown, it is desirable that friction drive means 26A, 26B are disposed at the entrance and the exit of the horizontal turn path section 5, 7 and the friction drive means 26B at the exit is configured to act upon the load bar 8 or 9 of the conveying traveling body 1 to be pulled out from the horizontal turn path section 5, 7 before the load bar 8 or 9 of the conveying traveling body 1 having been sent into the horizontal turn path section 5, 7 by the friction drive means 26A at the entrance leaves the friction drive means 26A at the entrance.

As a matter of course, if the horizontal turn path section 5, 7 has a large curvature and the path length of the circular guide rail 25 becomes sufficiently longer than the entire length of the load bar 8 or 9 in the continuous state, the bending angle of the load bar 8 or 9 in the continuous state becomes small, so that the friction drive means 26 can be disposed at an intermediate place or a plurality of places of the horizontal turn path section 5, 7. In either case, the friction drive wheel 26*a* and the backup roller 26*b* of the friction drive means 26, 26A, 26B to propel the conveying traveling body 1 on the horizontal turn path section 5, 7 are configured to be able to hold the load bar 8 or 9 to be driven therebetween with a necessary pressure contact force while following horizontal and lateral movement of the load bar 8 or 9 to be driven and moving horizontally and laterally.

To the horizontal turn path section 5, 7, a first coupling control means 27 is juxtaposed on the entrance side and a second coupling control means 28 is juxtaposed on the exit side, as illustrated in FIGS. 9A to 11B. The first coupling control means 27 switches from a coupled state to an uncoupled state the coupling units 13*a*, 14*a* or 13*b*, 14*b* of the load bar 8 or 9 of the pair of left and right load bars 8, 9 of the conveying traveling body 1 having been sent into the horizontal turn path section 5, 7, which load bar 8 or 9 moving outside the horizontal turn path section 5, 7. The second coupling control means 28 switches from the uncoupled state to the coupled state the coupling units 13*a*, 14*a* or 13*b*, 14*b* having been switched to the uncoupled state by the first coupling control means 27. In order to allow control by these coupling control means 27, 28, a cam follower roller 29 is pivotally supported to the movable bearing member 17, 20 of every coupling unit 13*a* to 14*b*, outside a support member erected at a position in the vicinity of the free end of the movable bearing member in a cantilever fashion by a horizontal support shaft parallel to the horizontal support shaft 16, 19 pivotally supporting the movable bearing member 17, 20, as illustrated in FIGS. 3A to 5. Each coupling control means 27, 28 is provided with a cam rail 30 for raising, via the cam follower roller 29, the movable bearing member 17, 20 of the coupling unit 13*a* to 14*b* to be controlled from a horizontal fallen-down posture and holding the movable bearing member at an uncoupled posture only for a fixed zone with the traveling of the conveying traveling body 1, as illustrated in FIGS. 5 to 8C.

When the conveying traveling body 1 travels the straight-ahead path section 6, all coupling units 13*a* to 14*b* of the wagon-to-wagon coupling means 13, 14 are in the coupled state and the three wagons 2 to 4 are integrated in a series-connected state. The conveying traveling body 1 in this state advances and travels the straight-ahead path section 6 by the friction drive means 26 and enters the horizontal turn path section 5, 7 connected to this straight-ahead path section 6. Operation of the conveying traveling body 1 traveling the clockwise horizontal turn path section 7 of the horizontal turn path sections 5, 7 will be described based on FIGS. 9A to 11B.

Once the conveying traveling body 1 reaches a position in which the front end portion of the load bar 9 on the right side of the conveying traveling body 1 is subjected to a frictional driving force by the friction drive means 26A provided to the entrance of the clockwise horizontal turn path section 7, the conveying traveling body 1 is subsequently sent into the clockwise horizontal turn path section 7 by the friction drive means 26A. After the end-position roller 21*b* located at the front end of the right guide roller row 22 enters the circular guide rail 25, the front auxiliary wagon 2 starts to turn around the vertical shaft 15 of the coupling unit 13*b* between the front auxiliary wagon 2 and the central main wagon 3 and on the load bar 9 side, toward the curving direction of the clockwise horizontal turn path section 7. Thus, the first coupling control means 27 is provided such that the cam follower roller 29 of the movable bearing member 17 of the opposite coupling unit 13*a* runs on the cam rail 30 of the first coupling control means 27 slightly therebefore.

Figure 6A:
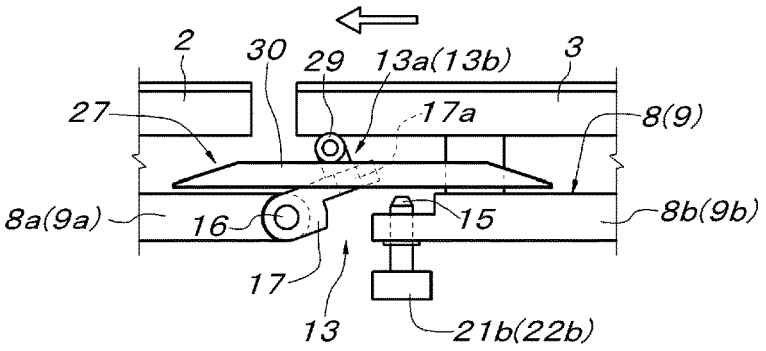
FIGS. 6A and 6B are side views of an essential part illustrating a state at the time when a front coupling unit is switched from a coupled state to an uncoupled state by the first coupling control means.
Figure 6B:
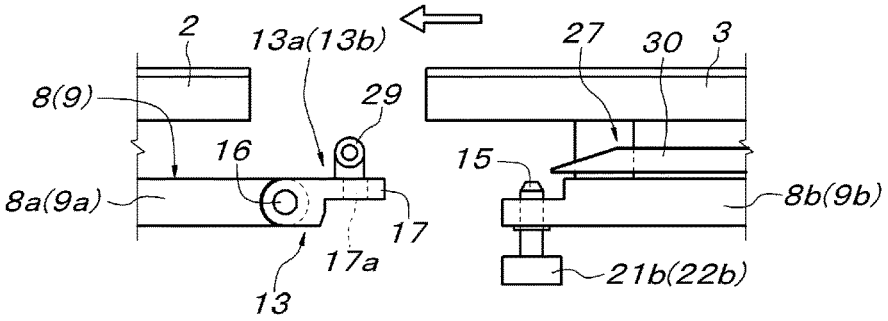

Accordingly, with the entry of the front auxiliary wagon 2 of the conveying traveling body 1 into the clockwise horizontal turn path section 7, the movable bearing member 17 at the rear end of the left load bar unit 8*a* fixed to the front auxiliary wagon 2 is raised by the cam follower roller 29 and the cam rail 30 of the first coupling control means 27, is moved upward about the horizontal support shaft 16, and is detached upward from the vertical shaft 15 at the front end of the left load bar unit 8*b* fixed to the central main wagon 3, and the left coupling unit 13*a* of the wagon-to-wagon coupling means 13 is switched from the coupled state into the uncoupled state, as illustrated in FIG. 6A. During the time when the left coupling unit 13*a* is switched to the uncoupled state, that is, the cam follower roller 29 rolls on the cam rail 30, the front auxiliary wagon 2 of the conveying traveling body 1 enters into the clockwise horizontal turn path section 7 and turns around the vertical shaft 15 of the coupling unit 13*b* between the front auxiliary wagon 2 and the central main wagon 3 and on the load bar 9 side, toward the curving direction of the clockwise horizontal turn path section 7, and the rear end portion (the movable bearing member 17) of the left load bar unit 8*a* fixed to the front auxiliary wagon 2 departs forward from the front end of the left load bar unit 8*b* fixed to the central main wagon 3. After that, the cam follower roller 29 of the left coupling unit 13*a* is detached from the cam rail 30 of the first coupling control means 27, and the movable bearing member 17 of the coupling unit 13*a* is restored to the original horizontal fallen-down posture by gravity at a position departed forward from the vertical shaft 15 as illustrated in FIG. 6B. Although an illustration of the detailed structure is omitted, each movable bearing member 17, 20 of the coupling units 13*a* to 14*b* is configured so as not to fall downward at least from the horizontal fallen-down posture which is an extended posture of the load bar unit 8*a*, 8*c* and 9*a*, 9*c*.

Figure 6C:
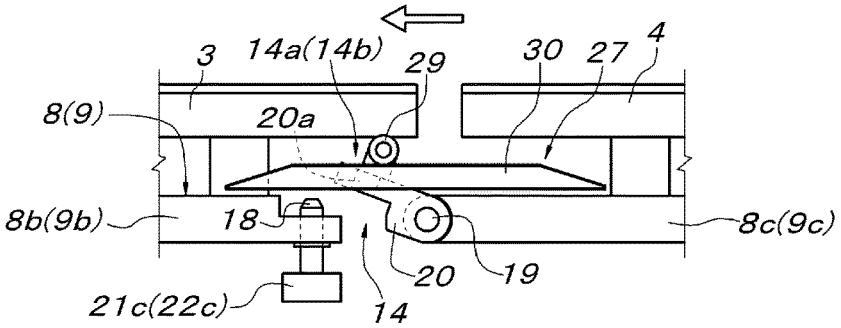
FIGS. 6C and 6D are side views of an essential part illustrating a state at the time when a rear coupling unit is switched from a coupled state to an uncoupled state by the first coupling control means.
Figure 6D:
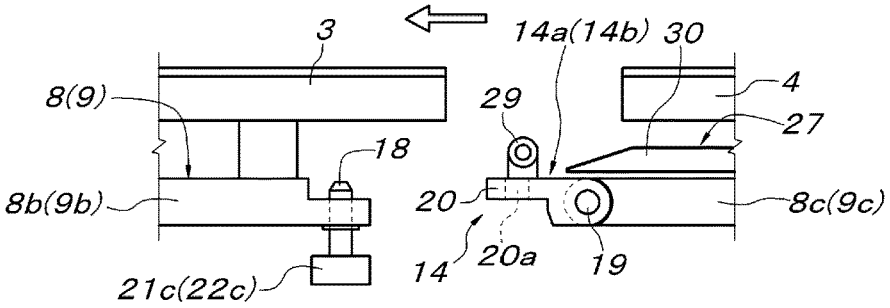
Figure 9B:
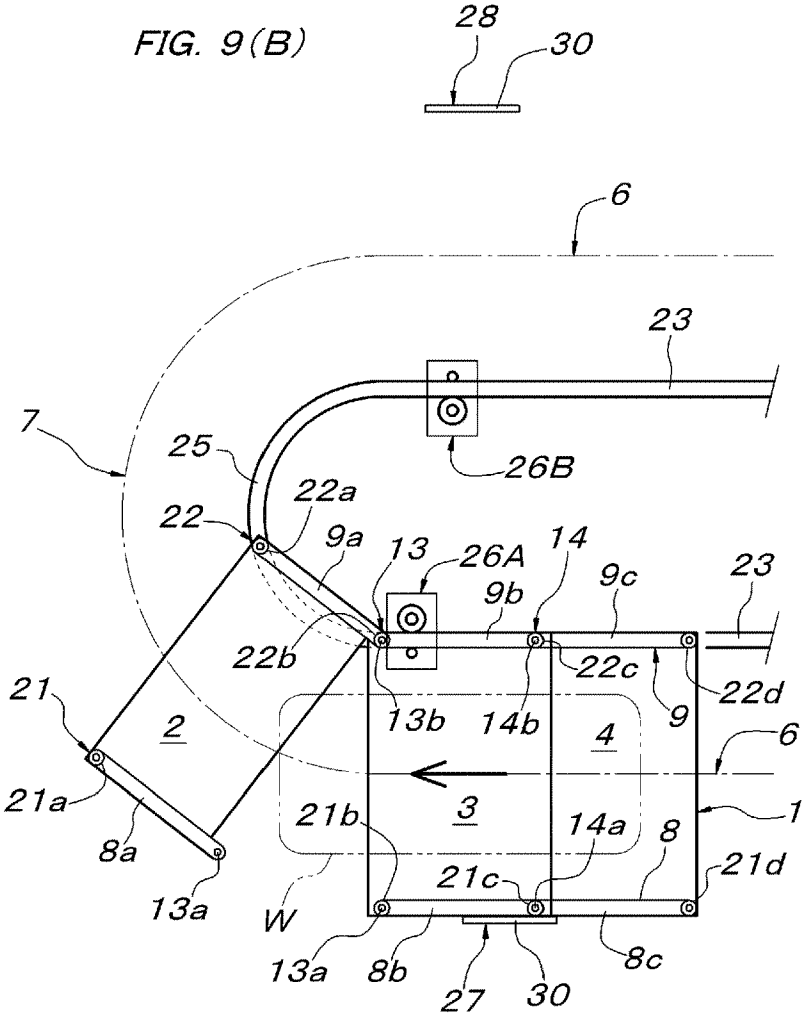
FIGS. 9A and 9B are plan views explaining a traveling state at the time when the conveying traveling body enters a clockwise horizontal turn path section.
Figure 9A:
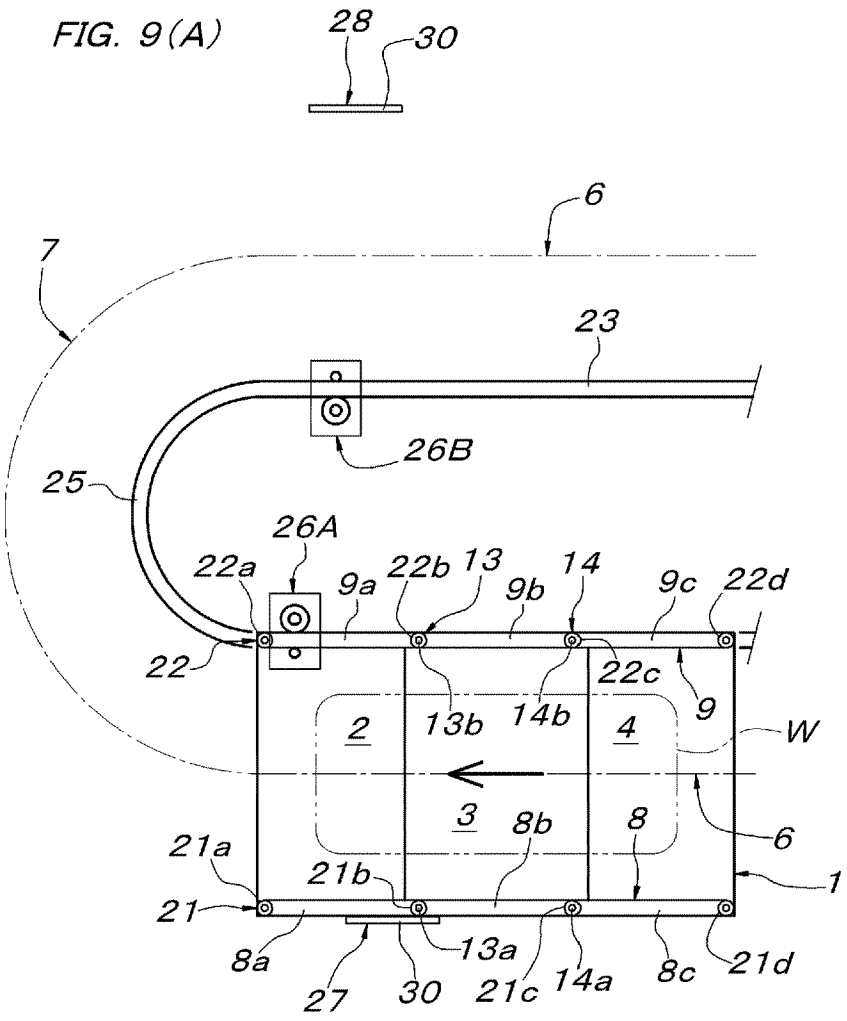

The entry of the conveying traveling body 1 into the clockwise horizontal turn path section 7 proceeds, and the coupling unit 14*a* on the outside (left side) of the wagon-to-wagon coupling means 14 between the central main wagon 3 and the rear auxiliary wagon 4 reaches the position of the first coupling control means 27 as illustrated in FIG. 9B. Thereafter, basically similar to the coupling unit 13*a* on the outside (left side) of the wagon-to-wagon coupling means 13 between the front auxiliary wagon 2 and the central main wagon 3 as described earlier, the coupling unit 14*a* is switched into the uncoupled state with the traveling of the conveying traveling body 1, as illustrated in FIG. 6C and FIG. 6D. A difference in operation between the front coupling unit 13*a* and the rear coupling unit 14*a* at the time of being switched into the uncoupled state is that the cam follower roller 29 of the movable bearing member 17 runs on the cam rail 30 relatively approaching from the side opposite to the side where the horizontal support shaft 16 which is the pivot of the vertical movement of the movable bearing member 17 is located, whereas the cam follower roller 29 of the movable bearing member 20 runs on the cam rail 30 relatively approaching from the side where the horizontal support shaft 19 which is the pivot of the vertical movement of the movable bearing member 20 is located.

Figure 10B:
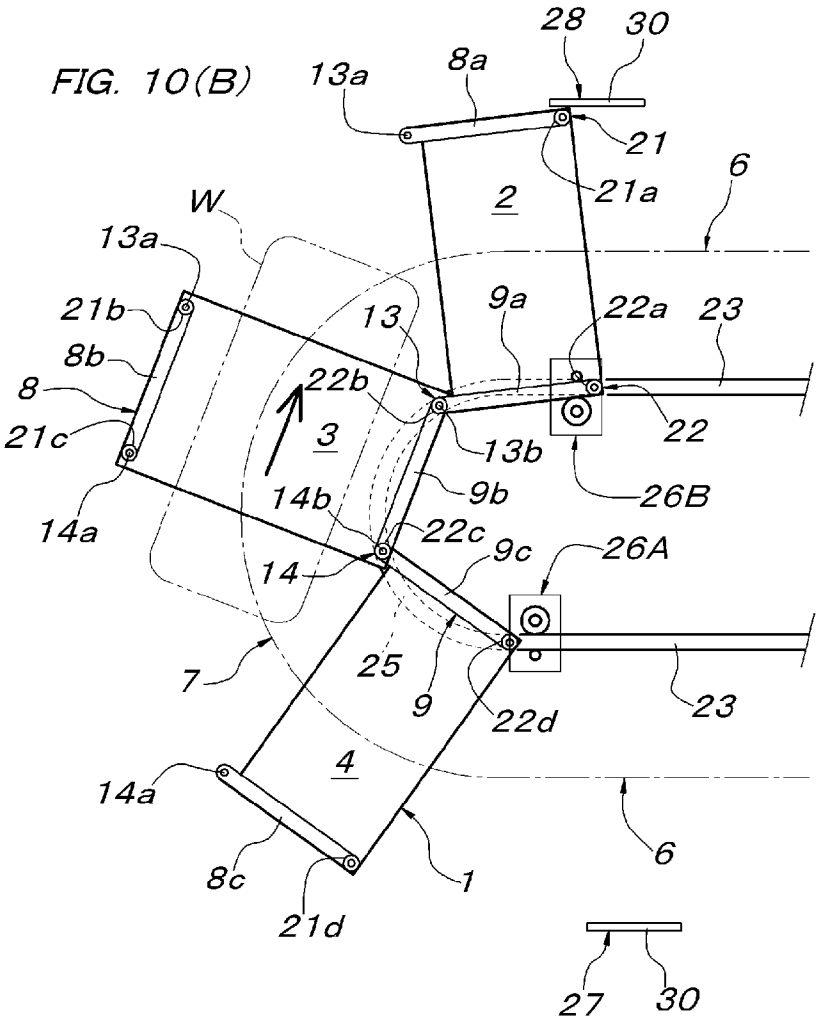
FIGS. 10A and 10B are plan views explaining a state where the conveying traveling body is traveling within the clockwise horizontal turn path section.
Figure 10A:
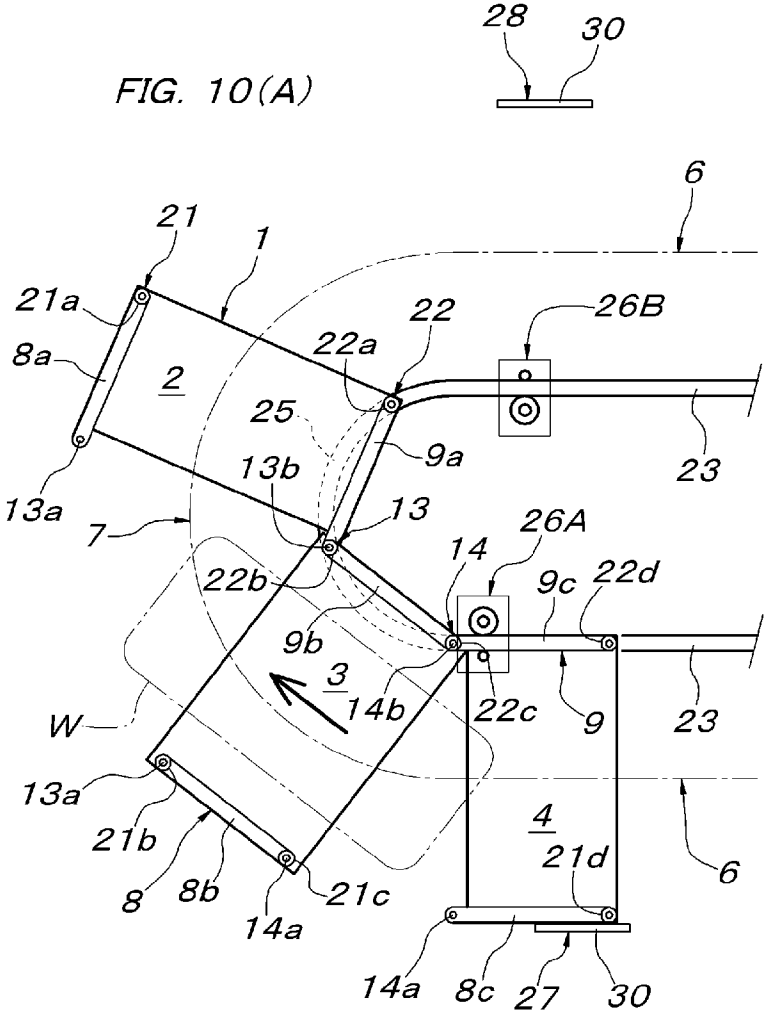

When the conveying traveling body 1 enters into the clockwise horizontal turn path section 7 by the control of the above first coupling control means 27, only the outer coupling units 13*a*, 14*a* of the pairs of left and right coupling units 13*a*, 13*b* and 14*a*, 14*b* of the wagon-to-wagon coupling means 13, 14 of the conveying traveling body 1, which outer coupling units opposite to the curving direction of the conveying traveling body 1, are sequentially automatically switched into the uncoupled state. Thus, the respective wagons 2 to 4 travel the clockwise horizontal turn path section 7 while spread in a fan shape around the vertical shafts 15, 18 of the coupled coupling units 13*b*, 14*b* located on the inner side in the curving direction of the conveying traveling body 1 as illustrated in FIGS. 10A and 10B. At this time, the conveying traveling body 1 can travel smoothly along the clockwise horizontal turn path section 7 since the respective rollers of the guide roller row 22 located on the inner side in the curving direction, that is, the intermediate-position rollers 22*b*, 22*c* concentric to the vertical shafts 15, 18 of the coupled coupling units 13*b*, 14*b* and the end-position rollers 22*a*, 22*d* at the front and rear both ends of the load bar 9 are guided by the circular guide rail 25.

At the same time as when the rear end of the load bar 9 of the conveying traveling body 1 traveling along the clockwise horizontal turn path section 7 departs from the friction drive means 26A at the entrance of the clockwise horizontal turn path section 7, the front end of the load bar 9 reaches the friction drive means 26B at the exit of the horizontal turn path section 7 as illustrated in FIG. 10B, remains subjected to the thrust from this friction drive means 26B, and continues to travel in a direction that leaves the horizontal turn path section 7. As a result, as illustrated in FIG. 11A, the uncoupled coupling unit 13*a* on the outside (left side) of the coupling units 13*a*, 13*b* of the wagon-to-wagon coupling means 13 of the conveying traveling body 1 passes through the position of the second coupling control means 28 at the exit of the horizontal turn path section 7. At this time, the conveying traveling body 1 travels while the front auxiliary wagon 2 and the central main wagon 3 having been spread in the fan shape are being closed around the vertical shaft 15 of the inner coupling unit 13*b* in the coupled state.

Figure 7A:
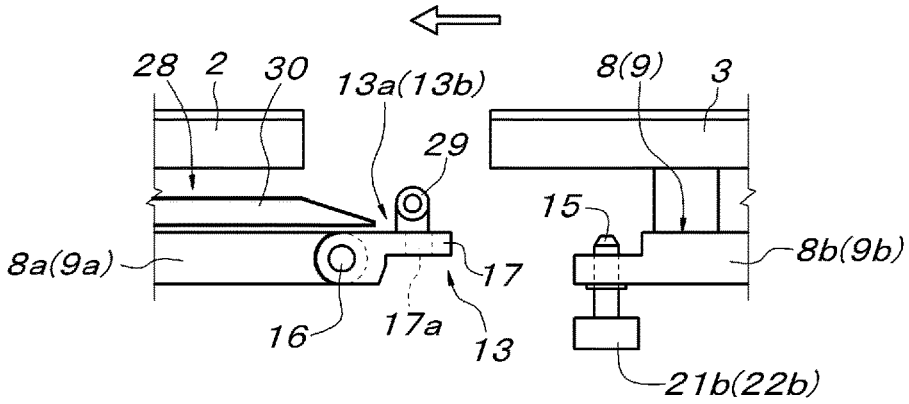
FIGS. 7A to 7C are side views of an essential part illustrating a state at the time when the front coupling unit is switched from the uncoupled state to the coupled state by the second coupling control means.
Figure 7B:
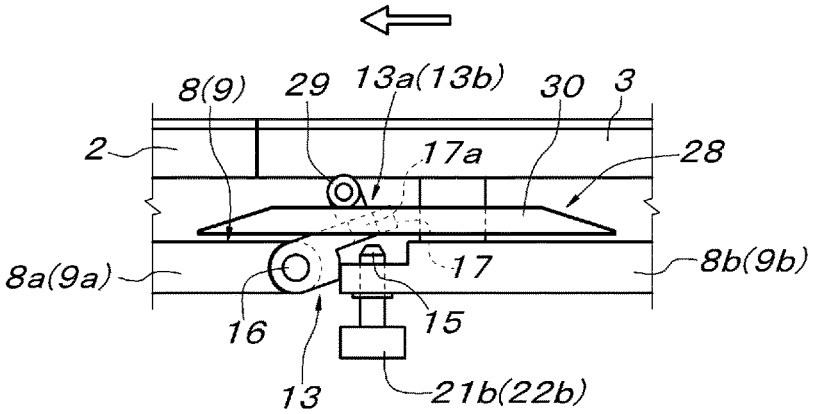
Figure 7C:
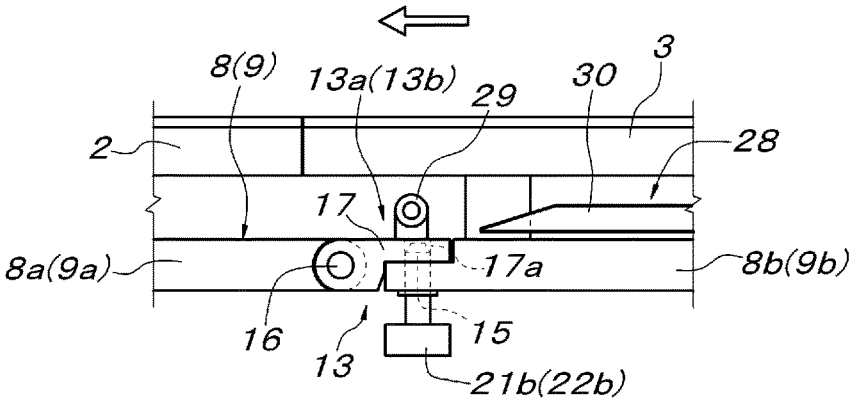

As illustrated in FIGS. 7A to 7C, with the leaving of the front auxiliary wagon 2 from the clockwise horizontal turn path section 7 for the straight-ahead path section 6, the front end of the outer load bar unit 8*b* fixed to the central main wagon 3 approaches the movable bearing member 17 of the coupling unit 13*a* extending, in the horizontal fallen-down posture, rearward from the rear end of the outer load bar unit 8*a* fixed to the front auxiliary wagon 2. In the middle of this approaching, the cam follower roller 29 of the movable bearing member 17 of the coupling unit 13*a* runs on the cam rail 30 of the second coupling control means 28 and is switched into a posture in the uncoupled state. While the cam follower roller 29 rolls on the cam rail 30 of the second coupling control means 28, the front end of the central main wagon 3 takes a straight-ahead posture of abutting against the rear end of the front auxiliary wagon 2, and the vertical shaft 15 at the front end of the load bar unit 8*b* of the coupling unit 13*a* is positioned immediately below the connection hole 17*a* of the movable bearing member 17 at the posture in the uncoupled state on the load bar unit 8*a* side of the coupling unit 13*a*. The traveling of the conveying traveling body 1 proceeds and the cam follower roller 29 of the movable bearing member 17 is detached from on the cam rail 30 of the second coupling control means 28. Thereafter, as illustrated in FIG. 7C, the movable bearing member 17 having been raised to the posture in the uncoupled state swings downward about the horizontal support shaft 16 by gravity, and the vertical shaft 15 is fitted to the connection hole 17*a* of the movable bearing member 17, and the coupling unit 13*a* is returned to the coupled state.

Figure 8A:
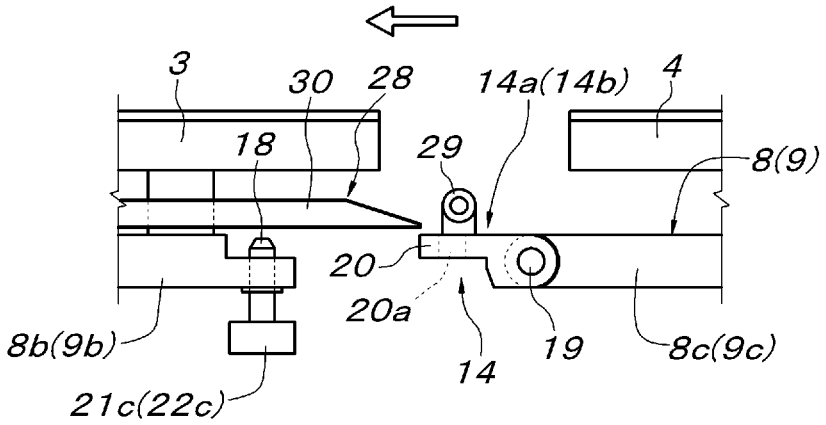
FIGS. 8A to 8C are side views of an essential part illustrating a state at the time when the rear coupling unit is switched from the uncoupled state to the coupled state by the second coupling control means.
Figure 8B:
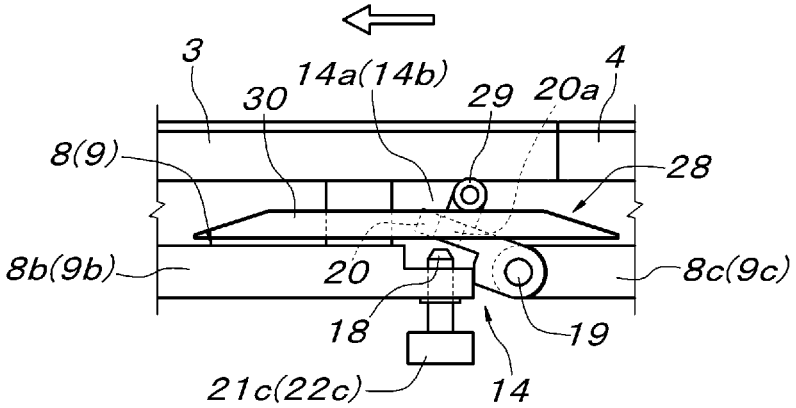
Figure 8C:
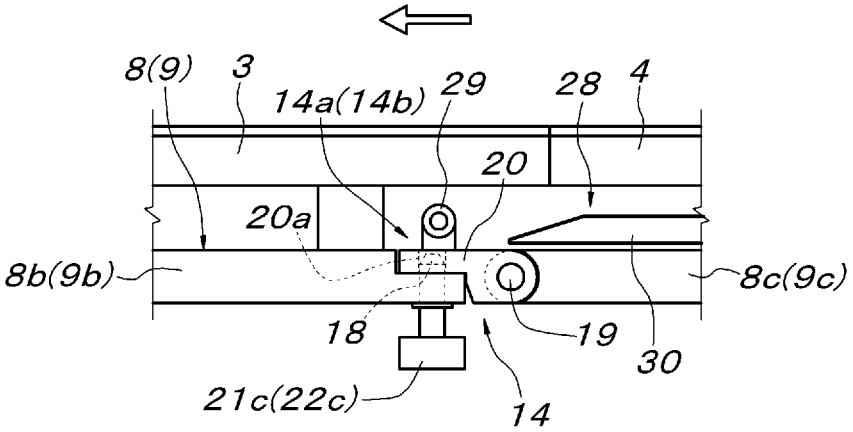
Figure 11B:
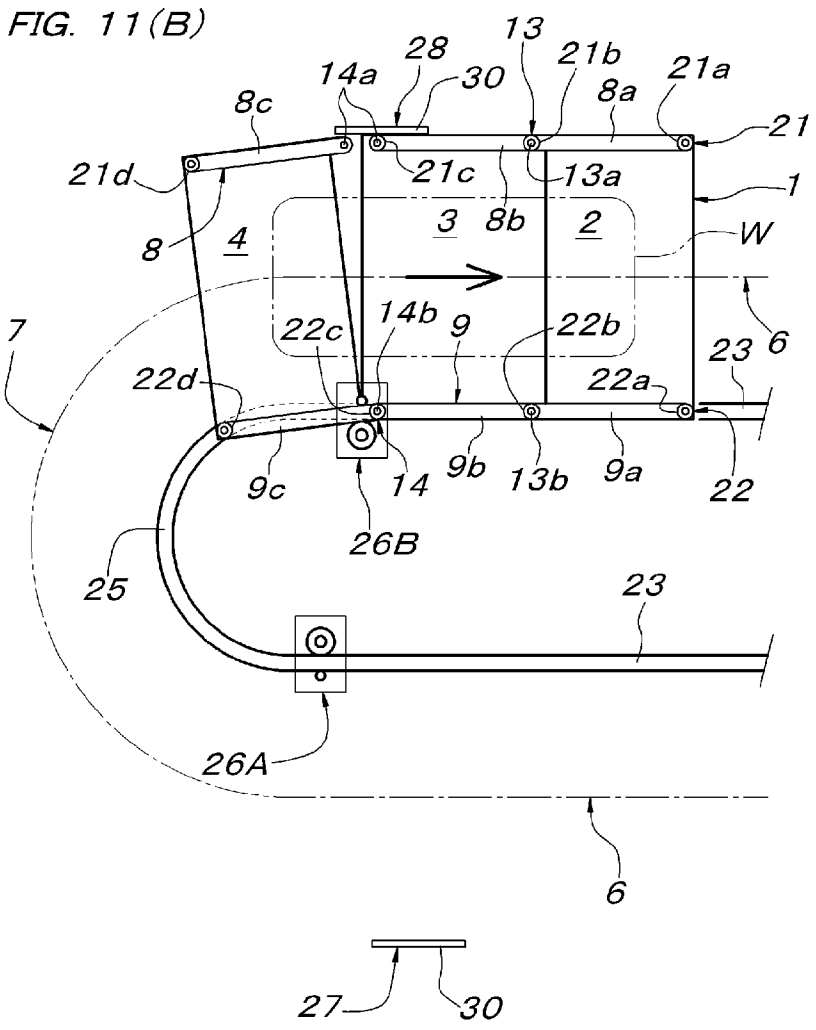
FIGS. 11A and 11B are plan views explaining a traveling state at the time when the conveying traveling body leaves the clockwise horizontal turn path section.
Figure 11A:
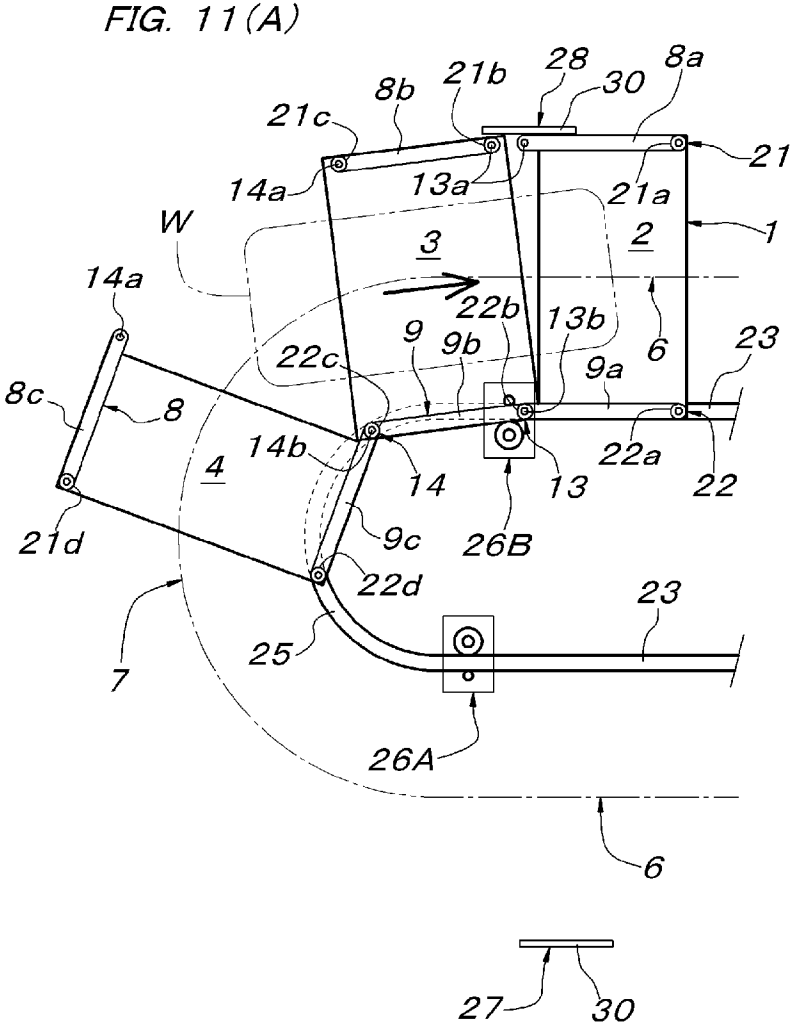
Figure 12:
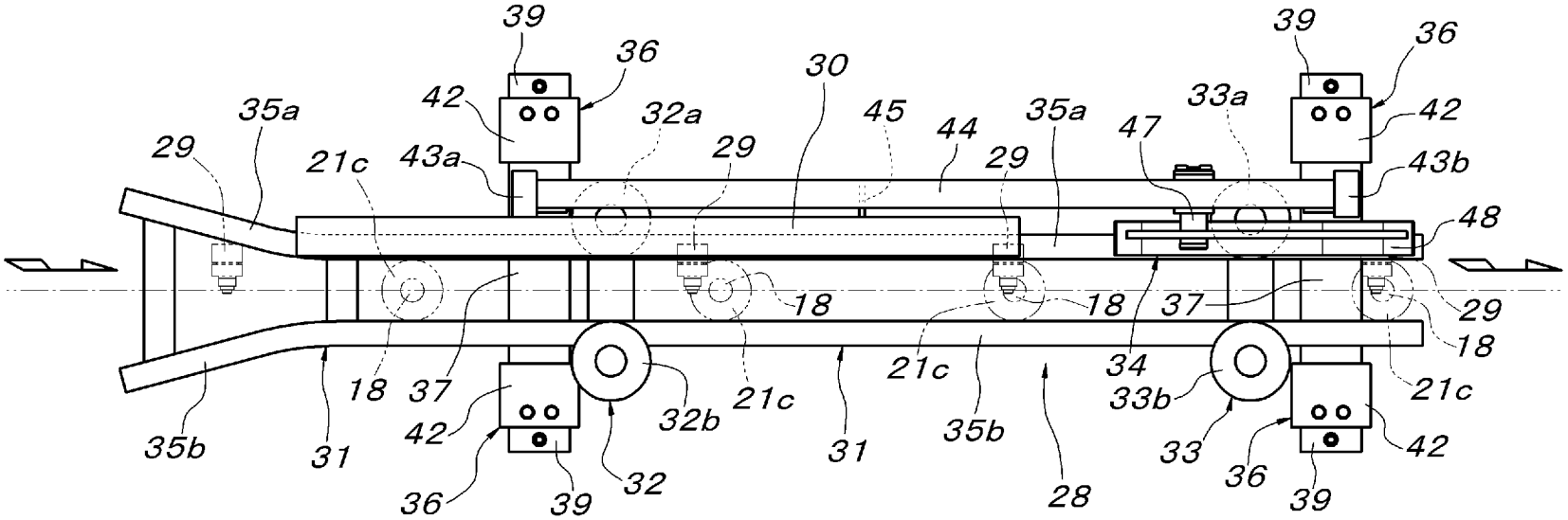

When a situation arises where the front auxiliary wagon 2 of the conveying traveling body 1 and the central main wagon 3 coupled thereto by the pair of left and right coupling units 13*a*, 13*b* of the wagon-to-wagon coupling means 13 are sent from the clockwise horizontal turn path section 7 to the straight-ahead path section 6 as illustrated in FIG. 11B and the rear auxiliary wagon 4 leaves the clockwise horizontal turn path section 7, the second coupling control means 28 returns the outer coupling unit 14*a* of the wagon-to-wagon coupling means 14 from the uncoupled state to the coupled state as illustrated in FIGS. 8A, 8B and 8C. This operation is basically the same as the operation when the second coupling control means 28 returns the outer coupling unit 13*a* of the wagon-to-wagon coupling means 13 between the front auxiliary wagon 2 and the central main wagon 3 from the uncoupled state to the coupled state with the traveling of the conveying traveling body 1. A difference thereof is that the cam follower roller 29 of the movable bearing member 17 runs on the cam rail 30 relatively approaching from the side where the horizontal support shaft 16 which is the pivot of the vertical movement of the movable bearing member 17 is located, whereas the cam follower roller 29 of the movable bearing member 20 runs on the cam rail 30 relatively approaching from the side opposite to the side where the horizontal support shaft 19 which is the pivot of the vertical movement of the movable bearing member 20 is located.

The conveying traveling body 1 travels the clockwise horizontal turn path section 7 in the above manner. On the counterclockwise horizontal turn path section 5 as well, similar to the time of traveling the above clockwise horizontal turn path section 7, the conveying traveling body 1 entering the counterclockwise horizontal turn path section 5 travels the counterclockwise horizontal turn path section 5 while the respective wagons 2 to 4 are spread in a fan shape around the vertical shafts 15, 18 of the coupled coupling units 13*a*, 14*a* located on the inner side in the curving direction of the counterclockwise horizontal turn path section 5, since the coupling units 13*b*, 14*b* of the pairs of left and right coupling units 13*a* to 14*b* of the wagon-to-wagon coupling means 13, 14, which coupling units located on the outside (right side) opposite to the curving direction of the counterclockwise horizontal turn path section 5, are sequentially switched from the coupled state to the uncoupled state by the first coupling control means 27 at the entrance of the counterclockwise horizontal turn path section 5. When the conveying traveling body 1 leaves this counterclockwise horizontal turn path section 5 for the straight-ahead path section 6, the respective wagons 2 to 4 are closed around the vertical shafts 15, 18 of the coupling units 13*a*, 14*a* from the state of being spread in the fan shape to the connected state where the front and rear both ends adjoin each other. After that, the respective coupling units 13*b*, 14*b* in the uncoupled state are sequentially automatically restored to the original coupled state by the second coupling control means 28 at the exit of the counterclockwise horizontal turn path section 5.

Figure 2A:
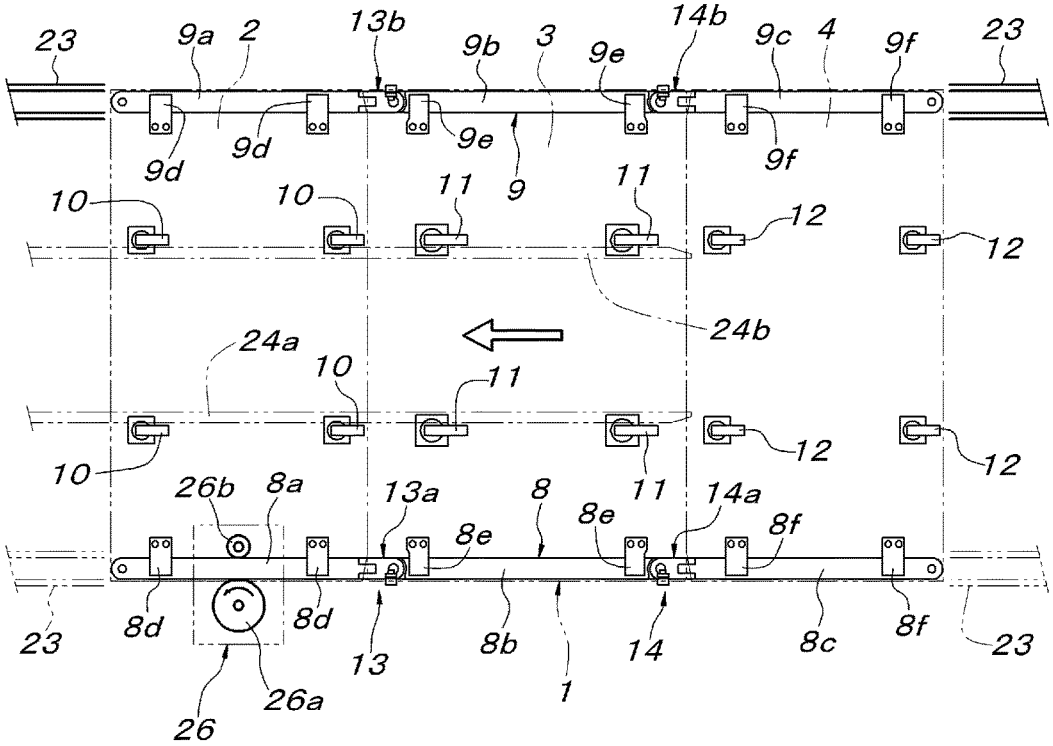
FIG. 2A is a plan view illustrating a pair of left and right load bars, wagon-to-wagon coupling means, and wheels.
Figure 2B:
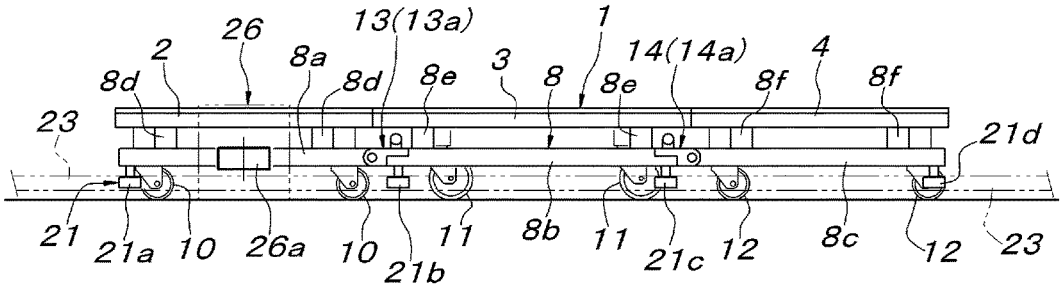
FIG. 2B is a side view of a conveying traveling body.
Figure 3A:
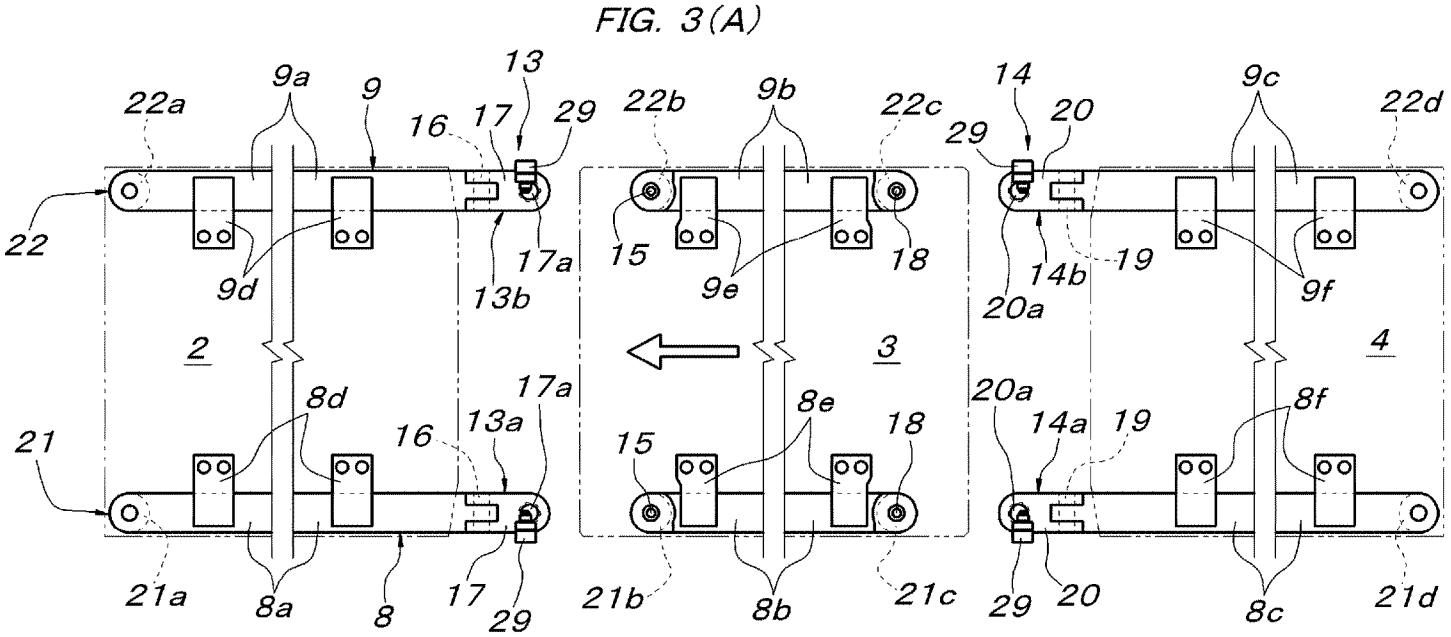
FIG. 3A is a plan view illustrating details of the pair of left and right load bars and wagon-to-wagon coupling means.
Figure 3B:
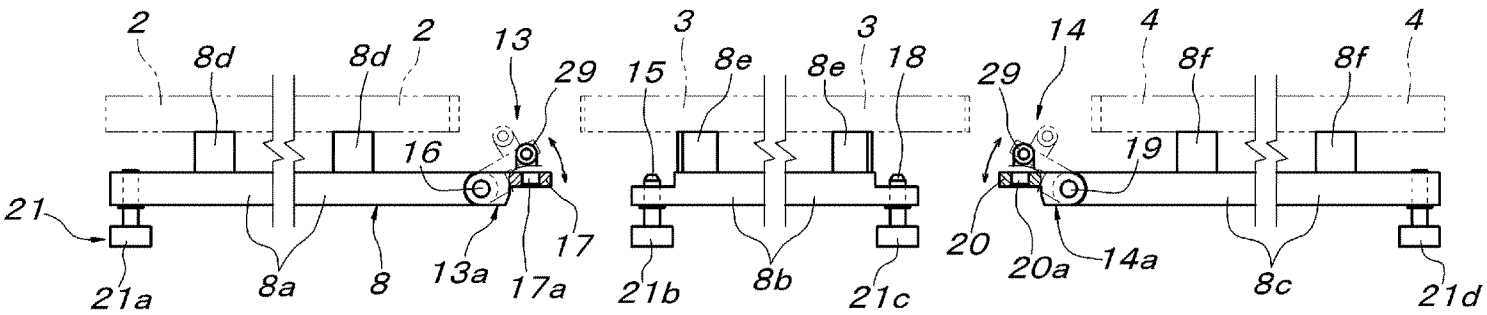
FIG. 3B is a partially cutaway side view of the same.
Figure 4:
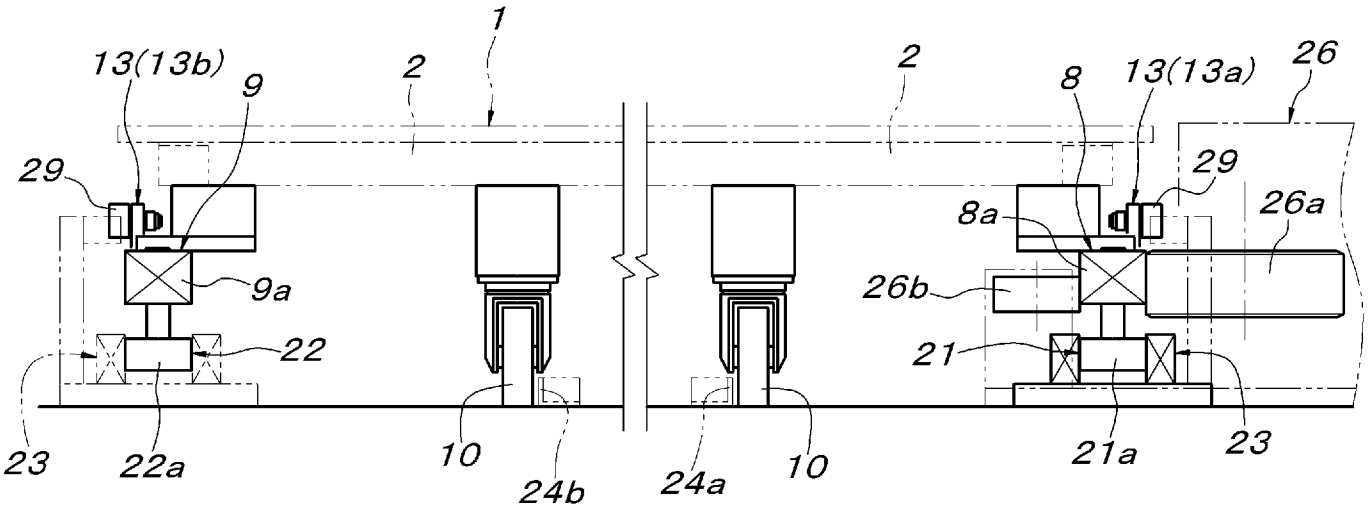
Figure 5:
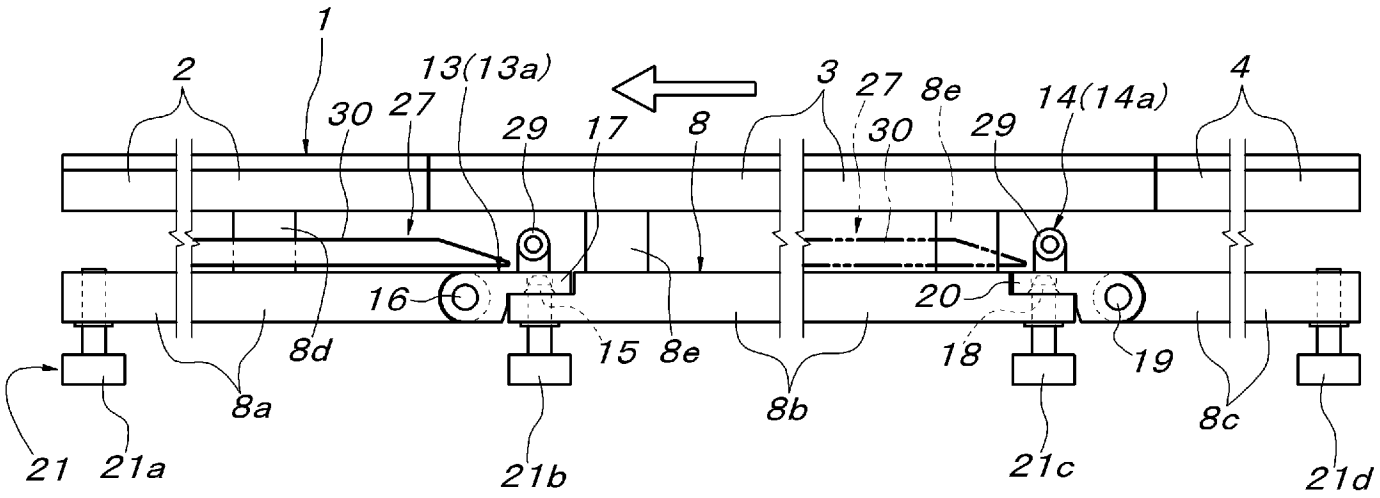

The length in the traveling direction of the front and rear both auxiliary wagons 2, 4 is short relative to that of the central main wagon 3. If the lengths of the load bar units 8*a* to 8*c* and 9*a* to 9*c* divided and fixed to the respective wagons 2 to 4 are also made to conform to the lengths in the traveling direction of the respective wagons 2 to 4 to make the length of the load bar units 8*a*, 8*c* and 9*a*, 9*c* shorter and make the length of the load bar units 8*b* and 9*b* longer, the longer load bar unit 8*b* or 9*b* fixed to the central main wagon 3 of the respective inner load bar units 8*a* to 8*c* or 9*a* to 9*c* guided by the guide rail row 21 or 22 when the conveying traveling body 1 travels the horizontal turn path section 5, 7 has a greater distance projecting inward from the circular guide rail 25. Thus, the need to set the curvature of the horizontal turn path section 5, 7 large in conformity with the longer load bar unit 8*b* or 9*b* arises in order to effortlessly and smoothly perform the traveling of the conveying traveling body 1 on the horizontal turn path section 5, 7 in which the respective wagons 2 to 4 travel while spread in a fan shape. In order to solve such a problem, intervals in the traveling direction between the respective rollers 21*a* to 21*d* of the guide roller row 21 and between the respective rollers 22*a* to 22*d* of the guide roller row 22 are configured to become almost equal in the embodiment of the present invention, as illustrated in FIGS. 2A and 2B.

More specifically, the length of the load bar units 8*a*, 8*c* and 9*a*, 9*c* fixed to the front and rear both auxiliary wagons 2, 4 is made longer and the length of the load bar units 8*b*, 9*b* fixed to the central main wagon 3 is made shorter thereby configuring such that the lengths of all load bar units 8*a* to 9*c* become almost equal. At the same time, to extended end portions of the load bar units 8*a*, 8*c* and 9*a*, 9*c* extending from the front and rear both auxiliary wagons 2, 4 toward the side where the central main wagon 3 is located in a cantilever fashion, the movable bearing members 17, 20 but not the intermediate-position rollers 21*b*, 21*c* and 22*b*, 22*c* constituting the guide roller rows 21, 22 are pivotally supported, and to both ends of the load bar units 8*b*, 9*b* whose both ends in the length direction fall within the range of the length of the central main wagon 3, the intermediate-position rollers 21*b*, 21*c* and 22*b*, 22*c* and the vertical shafts 15, 18 erected upward concentric to the respective rollers are provided.

Furthermore, the load bars 8, 9 disposed on the bottom surface sides of the wagons along the left and right both side faces of the conveying traveling body 1 are preferably configured to be recessed inside from the left and right both side faces of the respective wagons 2 to 4 in a plan view even if only slightly to prevent working oils and greases from adhering to the friction drive surfaces of the load bars 8, 9 and adversely affecting the friction drive when the working oils and greases having flown down on the respective wagons 2 to 4 drop from the left and right both side faces of the respective wagons 2 to 4. As a matter of course, the cam follower rollers 29 pivotally supported on the movable bearing members 17, 20 are also preferably provided so as not to protrude outside from the left and right both side faces of the central main wagon 3 in a plan view, if possible.

When the pairs of left and right coupling units 13*a* to 14*b* of the wagon-to-wagon coupling means 13, 14 of the conveying traveling body 1 are switched from the coupled state to the uncoupled state by the first coupling control means 27, the connection holes 17*a*, 20*a* of the movable bearing members 17, 20 are detached upward from the vertical shafts 15, 18 in the mutually fitted state in the coupling units 13*a* to 14*b*. Thus, the desired coupling release action can be carried out reliably as long as the cam follower rollers 29 of the movable bearing members 17, 20 run on the cam rail 30 of the first coupling control means 27. When the pairs of left and right coupling units 13*a* to 14*b* of the wagon-to-wagon coupling means 13, 14 of the conveying traveling body 1 are returned from the uncoupled state to the coupled state by the second coupling control means 28, there is a possibility that the connection holes 17*a*, 20*a* of the movable bearing members 17, 20 in the uncoupled state may not be able to fit the counterpart vertical shafts 15, 18 smoothly and reliably unless the connection holes 17*a*, 20*a* of the movable bearing members 17, 20 are positioned immediately above the vertical shafts 15, 18 when the cam follower rollers 29 are detached from the cam rail 30 of the second coupling control means 28. In order to solve this problem, it is conceivable that the moving paths of the vertical shafts 15, 18 and movable bearing members 17, 20 of the coupling units 13*a*, 14*a* or 13*b*, 14*b* in the uncoupled state may be controlled by a guide rail when the vertical shafts 15, 18 and the movable bearing members 17, 20 move within the region of the cam rail 30 of the second coupling control means 28.

A specific structure of the second coupling control means 28 will be described based on FIGS. 12 to 17. This second coupling control means 28 is provided with a guide rail 31, front and rear two guide roller pairs 32, 33, and a cam follower roller pushing-down movable body 34 aside from the cam rail 30. The guide rail 31 includes a pair of left and right rail members 35*a*, 35*b* sandwiching from the left and right both sides the intermediate-position rollers 21*b*, 21*c* or 22*b*, 22*c* concentrically located immediately below the vertical shafts 15, 18 of the coupling units 13*a*, 14*a* or 13*b*, 14*b* in a zone from slightly before the cam follower rollers 29 of the coupling units 13*a*, 14*a* or 13*b*, 14*b* run on the cam rail 30 until the cam follower rollers 29 are detached from on the cam rail 30 and advance a fixed distance. The guide rail 31 has both ends in the length direction whose vicinity positions are respectively supported on the floor surface by slide support portions 36. End portions at the entrance side of the rail members 35*a*, 35*b* are inclined so as to extend laterally outward in a flared manner and allow the intermediate-position rollers 21*b*, 21*c* or 22*b*, 22*c* to be guided between both rail members 35*a*, 35*b* reliably.

The slide support portion 36 mounting the guide rail 31 has a lateral strip movable base plate 37 fastened on bottom surfaces of both rail members 35*a*, 35*b*, and integrating both rail members 35*a*, 35*b*, a strip fixed base plate 39 fixed on the floor surface by bolts 38 at both ends, a strip slide support plate 40 fastened on the upper surface of the strip fixed base plate 39 and horizontally slidably supporting the strip movable base plate 37, and a positioning cover member 42 fixed on both end portions of the strip fixed base plate 39 by bolts 41. A horizontal slide region of the strip movable base plate 37 on the strip slide support plate 40 is controlled within a fixed range by the positioning cover members 42.

Outside the rail member 35*a* located immediately below the cam rail 30, columnar members 43*a*, 43*b* are respectively protruded from the strip movable base plates 37 of the front and rear both slide support portions 36. A horizontal beam member 44 is disposed between upper end portions of this pair of front and rear columnar members 43*a*, 43*b*. The cam rail 30 has one end side fastened on an inner surface of one of the columnar members 43*a* and has the other end side coupled and supported at an intermediate position of the horizontal beam member 44 via a coupling plate 45. The guide roller pairs 32, 33 have a pair of left and right rollers 32*a*, 32*b* and 33*a*, 33*b* pivotally supported rotatably about vertical axial centers by a pair of left and right bearings 46*a*, 46*b* fastened outside the rail members 35*a*, 35*b* at positions inside the front and rear two slide support portions 36. The guide roller pairs 32, 33 sandwich from the left and right both sides the load bar units 8*a* to 8*c* or 9*a* to 9*c* provided with, on the undersides of the end portions thereof, the intermediate-position rollers 21*b*, 21*c* or 22*b*, 22*c* guided by the guide rail 31, and control the moving paths of the load bar units.

The cam follower roller pushing-down movable body 34 is arranged at a position downstream apart from the cam rail 30 and in a plan view within an extension region of the cam rail 30. The cam follower roller pushing-down movable body 34 is pivotally supported at an end portion side thereof closer to the cam rail 30 to a side surface of the horizontal beam member 44 by a lateral horizontal support shaft 47 so as to be vertically swingable within a fixed range. The cam follower roller pushing-down movable body 34 includes a strip cam plate 48 hanging over the moving path of the cam follower roller 29 detached from on the cam rail 30. The strip cam plate 48 is located above the moving track of the cam follower roller 29 in the normal operation when being in a lower limit position of the vertical swing range. The strip cam plate 48 includes, at a free end portion side thereof downstream apart from the horizontal support shaft 47, an operating portion 48*a* approaching above the moving track of the cam follower roller 29 in the normal operation.

With the second coupling control means 28 of the above configuration, as described earlier, the moving path of the load bar units 8*a*, 8*c* or 9*a*, 9*c* having the movable bearing members 17, 20 of the coupling units 13*a*, 14*a* or 13*b*, 14*b* and the moving path of the load bar unit 8*b* or 9*b* having the vertical shafts 15, 18, in other words, the moving paths of the vertical shafts 15, 18 and movable bearing members 17, 20 of the coupling units 13*a*, 14*a* or 13*b*, 14*b* can be controlled accurately with respect to the lateral and transverse direction relative to the travel path direction from a stage in which the cam follower rollers 29 roll on the cam rail 30 to a stage in which the cam follower rollers 29 are detached from on the cam rail 30 and the switching operation is terminated when the coupling units 13*a*, 14*a* or 13*b*, 14*b* of the wagon-to-wagon coupling means 13, 14 are switched from the uncoupled state to the coupled state by the cam follower rollers 29 and the cam rail 30. As a matter of course, the rollers 21*a* to 21*d* or 22*a* to 22*d* constituting the left or right guide roller row 21 or 22 of the conveying traveling body 1 move between the rail members 35*a*, 35*b* of the guide rail 31 provided to the second coupling control means 28 when passing through the position of the second coupling control means 28, and the moving paths are controlled.

Due to that particularly the moving paths of the movable bearing members 17, 20 having, immediately therebelow, no rollers 21*a* to 21*d* or 22*a* to 22*d* whose moving paths are controlled by the guide rail 31 can be controlled by the guide roller pairs 32, 33 provided to the second coupling control means 28 as above, the operation of switching the coupling units 13*a*, 14*a* or 13*b*, 14*b* of the wagon-to-wagon coupling means 13, 14 from the uncoupled state to the coupled state by the cam follower rollers 29 and the cam rail 30 can be performed reliably.

When the moving paths of the load bar units 8*a* to 8*c* or 9*a* to 9*c* are controlled by the guide rail 31 and front and rear two guide roller pairs 32, 33 provided to the second coupling control means 28, in actuality, the load bar units 8*a* to 8*c* or 9*a* to 9*c* are in the course of transferring from the circular horizontal turn path section 5, 7 to the straight-ahead path section 6. If the guide rail 31 provided with the front and rear two guide roller pairs 32, 33 is an immovable one fixed with respect to the ground, unreasonable friction occurs between the guide rail 31 and the rollers 21*a* to 21*d* or 22*a* to 22*d* or between the front and rear two guide roller pairs 32, 33 and the load bar units 8*a* to 8*c* or 9*a* to 9*c*, so that smooth operation cannot be expected. However, in this embodiment, the entire second coupling control means 28 is supported by the slide support portions 36 at the front and rear two places, in a state of being horizontally slidable within the allowable horizontal slide range of the strip movable base plate 37 on the strip slide support plate 40. Thus, by a horizontal force applied to the guide rail 31 and the guide roller pairs 32, 33, the entire second coupling control means 28 can slide in the acting direction of the force and absorb the force. Therefore, the desired coupling release action can be performed smoothly and reliably.

Figure 13:
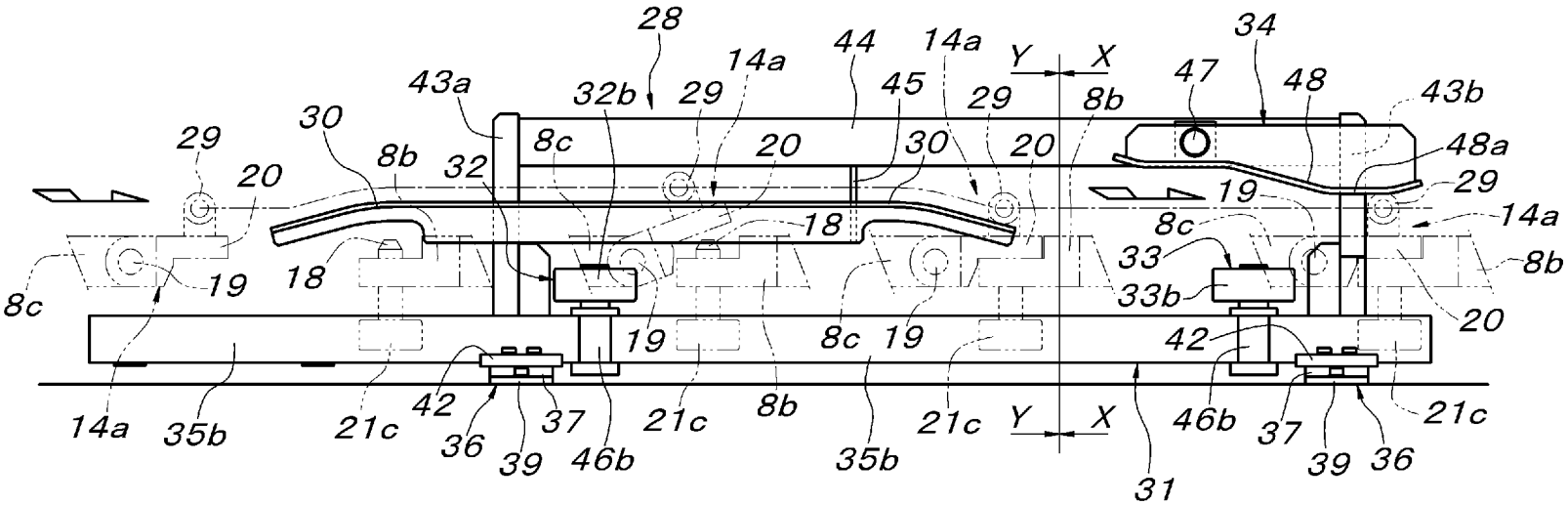
Figure 14:
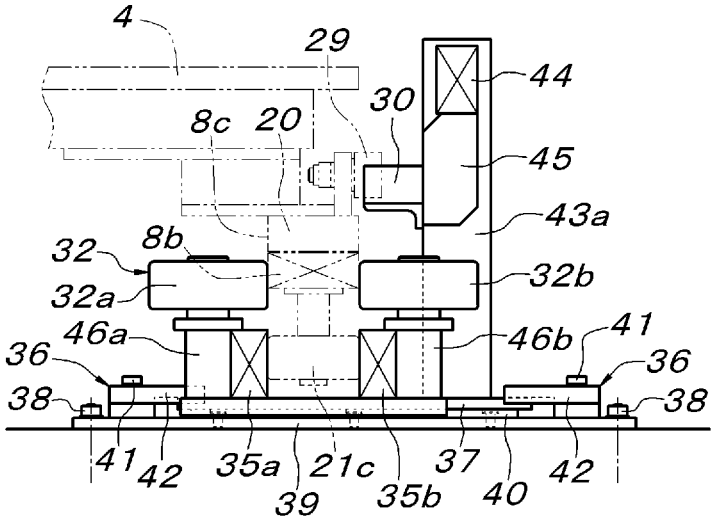
Figure 15:
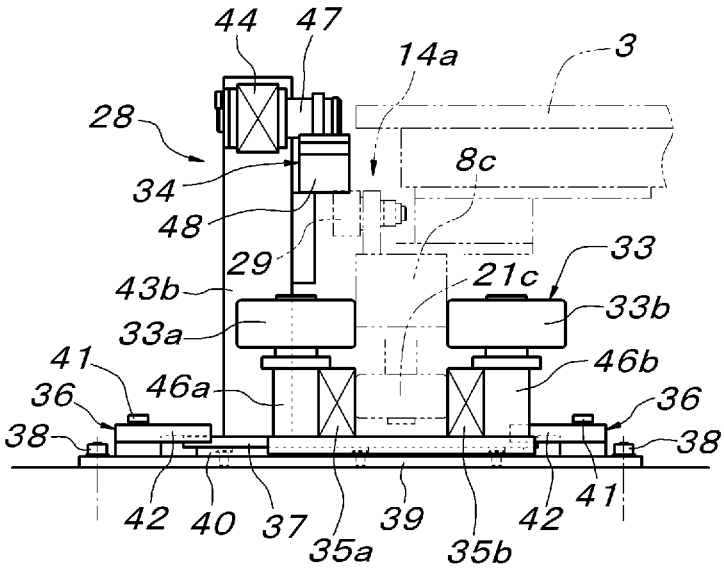
Figure 16A:
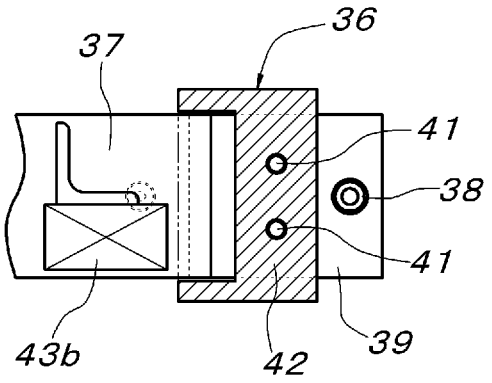
FIG. 16A is a cross sectional plan view of an essential part illustrating a slide support portion of the second coupling control means as above.
Figure 16B:
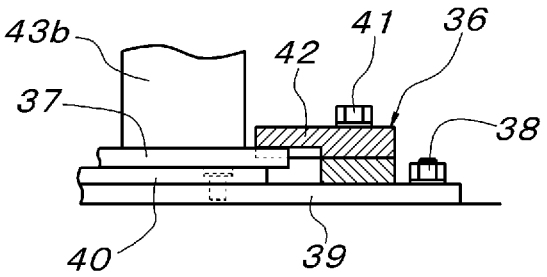
FIG. 16B is a longitudinal sectional front view of the essential part illustrating the same slide support portion.
Figure 17:
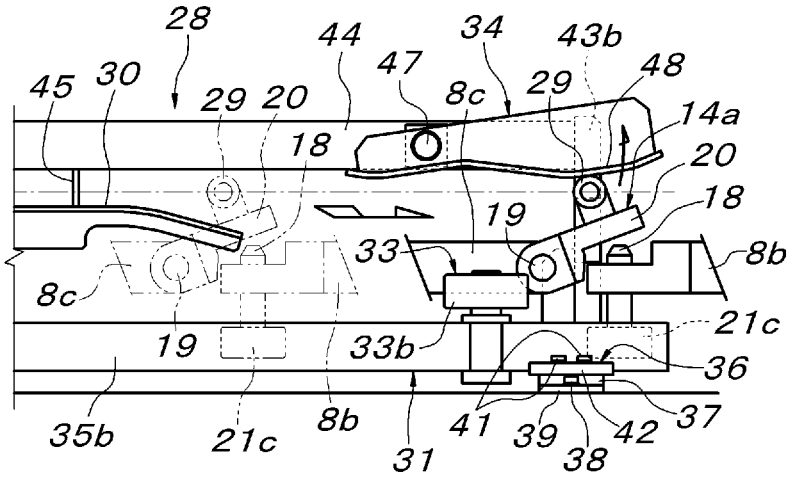

In the second coupling control means 28, the cam follower roller 29 is detached from on the cam rail 30, whereby the movable bearing member 17, 20 swings downward about the horizontal support shaft 16, 19 by gravity together with the cam follower roller 29, and the coupling unit 13*a*, 14*a* or 13*b*, 14*b* is restored to the coupled state. When the second coupling control means 28 functions normally in this manner, the cam follower roller pushing-down movable body 34 is located above the moving track of the cam follower roller 29 and does not interfere with the cam follower roller 29, as illustrated in FIG. 13. However, if the behavior of the movable bearing member 17, 20 around the horizontal support shaft 16, 19 worsens and the movable bearing member 17, 20 advances remaining uncoupled even after the cam follower roller 29 is detached from on the cam rail 30 or if the movable bearing member 17, 20 does not move downward to the coupled state which is the lower limit position, the cam follower roller 29 attempts to pass while pushing up the operating portion 48*a* of the cam follower roller pushing-down movable body 34 as illustrated in FIG. 17 and a downward reaction force acts upon the cam follower roller 29. As a result, the movable bearing member 17, 20 is forcibly pushed down together with the cam follower roller 29 and reliably switched to the coupled state. Under circumstances where the movable bearing member 17, 20 does not move downward to the coupled state which is the lower limit position by the downward reaction force applied from the cam follower roller pushing-down movable body 34, as a matter of course, the cam follower roller pushing-down movable body 34 is reversely pushed up by the cam follower roller 29 and swings upward about the horizontal support shaft 47. Therefore, in combination with a detector such as a limit switch for detecting the upward swing of the cam follower roller pushing-down movable body 34 at this time, abnormal circumstances where the coupling units 13*a*, 14*a* or 13*b*, 14*b* are not returned to the coupled state by the second coupling control means 28 can be automatically detected thereby to take measures in response to circumstances.

The above second coupling control means 28 can be utilized as the first coupling control means 27 just as it is. However, as described earlier, the vertical shafts 15, 18 and movable bearing members 17, 20 of the coupling units 13*a*, 14*a* or 13*b*, 14*b* in the coupled state are controlled in their moving paths by the intermediate-position roller 21*b*, 21*c* or 22*b*, 22*c* located immediately therebelow being guided by the guide rail 31 in the first coupling control means 27. Thus, the front and rear two guide roller pairs 32, 33 can be omitted.

The load bars 8, 9 providing the friction drive surfaces are not essential and are unnecessary depending on traveling drive means for making the conveying traveling body 1 travel along the travel path. In this case, the end-position rollers 21*a*, 21*d* and 22*a*, 22*d* of the left and right two guide roller rows 21, 22 can be pivotally supported to the bottom portions of the front and rear both auxiliary wagons 2, 4 by using appropriate bearings, and the intermediate-position rollers 21*b*, 21*c* and 22*b*, 22*c*, the vertical shafts 15, 18, and the movable bearing members 17, 20 can be mounted to the bottom portion of the central main wagon 3 by using members corresponding to the both end portions of the load bar units 8*b*, 9*b* provided with these. Even where the friction drive means 26, 26A, 26B are used, it is not limited to the configuration that the load bars 8, 9 are attached along the left and right both side faces of the conveying traveling body 1. For example, a single load bar can be used that is divided and mounted to the respective wagons 2 to 4 of the conveying traveling body 1. The mounting position of the single load bar in this case may be a central position in the width direction of the conveying traveling body 1 or may be either one of the left and right both side faces.

Figure 18A:
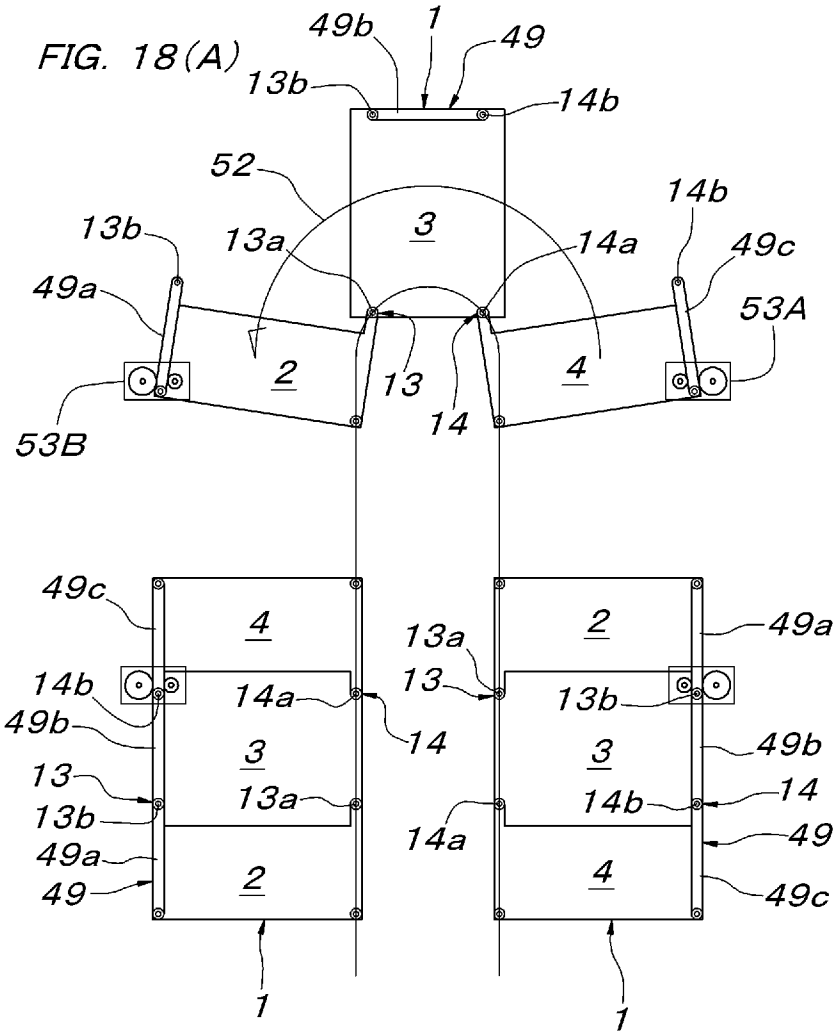
Figure 18B:
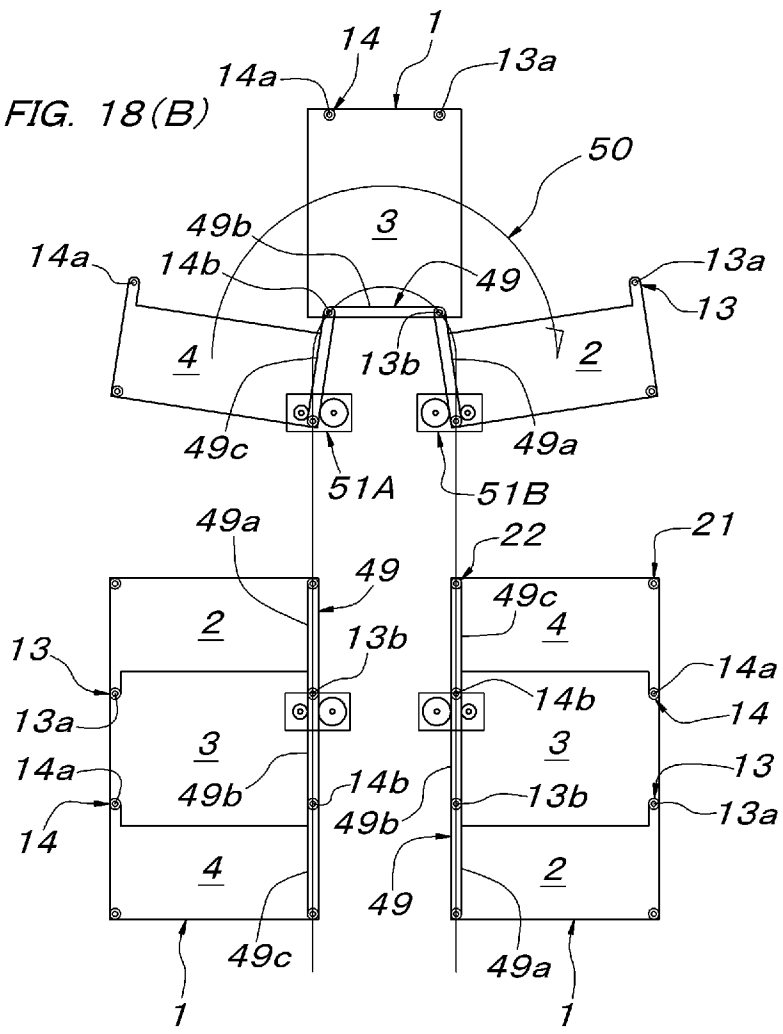

FIGS. 18A and 18B illustrates an example in which a single load bar 49 includes load bar units 49*a* to 49*c* divided for respective wagons 2 to 4 is mounted only to one side face of the respective wagons 2 to 4 (the side where the coupling units 13*b*, 14*b* are located). On a clockwise horizontal turn path section 50 where the conveying traveling body 1 travels in an orientation that the load bar 49 becomes the inner side in the curving direction, a friction drive means 51A and a friction drive means 51B sandwiching and frictionally driving the load bar 49 have only to be disposed at the entrance and the exit of the moving path of the inner load bar 49 in the clockwise horizontal turn path section 50, as illustrated in FIG. 18A. On a counterclockwise horizontal turn path section 52 where the conveying traveling body 1 travels in an orientation that the load bar 49 becomes the outer side in the curving direction, a friction drive means 53A and a friction drive means 53B sandwiching and frictionally driving the load bar 49 have only to be disposed at the entrance and the exit of the moving path of the outer load bar 49 in the counterclockwise horizontal turn path section 52, as illustrated in FIG. 18B. Although the illustrations are omitted, the wagon-to-wagon coupling means 13, 14, the left and right two guide roller rows 21, 22, and the first and second coupling control means 27, 28 disposed at the entrance and the exit of the horizontal turn path sections 50, 52 are used also in this embodiment in the same manner as in the earlier embodiment. The respective coupling units 13*a*, 14*a* of the wagon-to-wagon coupling means 13, 14 and the respective rollers 21*a* to 21*d* of the guide rail row 21 necessary for the side face of respective wagons on the side where the load bar 49 is not disposed can be provided using the earlier explained procedure.

On the counterclockwise horizontal turn path section 52 illustrated in FIG. 18B, outer side faces of the respective wagons 2 to 4 are frictionally driven as viewed from the center of the curve of the counterclockwise horizontal turn path section 52. In order for the thrust to be reliably transmitted to the positions of the coupling units 13*b*, 14*b* between the respective wagons 2 to 4 guided by the circular guide rail 25 to allow the respective wagons 2 to 4 to travel the counterclockwise horizontal turn path section 52 smoothly, the curvature of the counterclockwise horizontal turn path section 52 is made larger and a friction drive means has only to be disposed also at an intermediate position of the counterclockwise horizontal turn path section 52 as needed.

Next, another embodiment of the first aspect of the invention will be described based on FIGS. 19A to 28. In FIG. 19A to FIG. 20B, a conveying traveling body 101 is constituted of three wagons 102 to 104 disposed in series in the traveling direction. A central wagon 103 has a length in the traveling direction longer than the other wagons 102, 104 and serves as the central main wagon used for support of the workpiece W such as an automotive vehicle body and the working floor with respect to left and right both side portions of the workpiece W. Front- and rear-both end wagons 102, 104 have the same length and serve as the auxiliary wagons mainly used for the working floor with respect to front and rear both end portions of the workpiece W. A travel path of this conveying traveling body 101 is constructed by combining a counterclockwise horizontal turn path section 105, an entrance-side straight-ahead path section 106A of the counterclockwise horizontal turn path section 105, an exit-side straight-ahead path section 106B of the counterclockwise horizontal turn path section 105, a clockwise horizontal turn path section 107, an entrance-side straight-ahead path section 106C of the clockwise horizontal turn path section 107, and an exit-side straight-ahead path section 106D of the clockwise horizontal turn path section 107.

As illustrated in FIGS. 21A to 24, the conveying traveling body 101 has a pair of left and right load bars 108, 109 having the same length as the entire length of the conveying traveling body 101 and provided along left and right both side faces of the conveying traveling body 101, left and right two guide roller rows 110, 111, a wagon-to-wagon coupling means 112 coupling between front and rear adjacent wagons 102, 103, a wagon-to-wagon coupling means 113 coupling between front and rear adjacent wagons 103, 104, and four, front and rear two pairs of left and right caster wheels 114 to 116 mounted on bottom portions of respective wagons 102 to 104 and rolling on the floor surface. The load bars 108, 109 are constituted of load bar units 108*a* to 108*c* and 109*a* to 109*c* divided for respective wagons 102 to 104 and attached to bottom surfaces of the wagons along the left and right both side faces of respective wagons 102 to 104. Each of these load bar units 108*a* to 108*c* and 109*a* to 109*c* has a square columnar shape, has two places near both ends in the length direction whose upper surfaces are mounted to the bottom surface of each wagon 102 to 104 via mounting members 108*d* to 108*f* and 109*d* to 109*f*, and has left and right both side surfaces serving as friction drive surfaces.

The load bar units 108*a*, 109*a* and 108*c*, 109*c* of the respective load bar units 108*a* to 108*c* and 109*a* to 109*c* constituting the load bar units 108, 109, which load bar units mounted to the front- and rear-both end wagons 102, 104 short in entire length have a length extending into a region of the central wagon 103 long in entire length. Thus, the load bar units 108*b*, 109*b* mounted to the central wagon 103 have both ends located at positions recessed inside from the front and rear both ends of the central wagon 103 by the same length. By this configuration, the lengths of all load bar units 108*a* to 109*c* can be made the same or an approximate length thereof regardless of difference in entire length of the wagons 102 to 104.

The guide roller row 110 includes rollers 110*a* to 110*f* pivotally supported below front and rear both ends of respective load bar units 108*a* to 108*c* constituting the load bar 108 on the same side so as to be rotatable about vertical axial centers. The guide roller row 111 comprises rollers 111*a* to 111*f* pivotally supported below front and rear both ends of respective load bar units 109*a* to 109*c* constituting the load bar 109 on the same side so as to be rotatable about vertical axial centers. Each of the rollers 110*a* to 111*f* is pivotally supported at a central position in the width direction of each of the load bar units 108*a* to 109*c* equal in width, and has a diameter as much as the width of each load bar unit 108*a* to 109*c*.

The wagon-to-wagon coupling means 112, 113 comprises respective pairs of left and right coupling units 112*a*, 112*b* and 113*a*, 113*b*. The pair of left and right coupling units 112*a*, 112*b* are constituted of hook-shaped coupling tools 117*a*, 117*b* having plate materials mounted above rear end portions of the pair of left and right load bar units 108*a*, 109*a* mounted to the front-end wagon 102, and vertical shafts 118*a*, 118*b* protruded above front end portions of the pair of left and right load bar units 108*b*, 109*b* mounted to the central wagon 103 so as to be concentric to the rollers 110*c*, 111*c* pivotally supported therebelow. The pair of left and right coupling units 113*a*, 113*b* are constituted of hook-shaped coupling tools 119*a*, 119*b* having plate materials mounted above front end portions of the pair of left and right load bar units 108*c*, 109*c* mounted to the rear-end wagon 104, and vertical shafts 120*a*, 120*b* protruded above rear end portions of the pair of left and right load bar units 108*b*, 109*b* mounted to the central wagon 103 so as to be concentric to the rollers 110*d*, 111*d* pivotally supported therebelow.

The hook-shaped coupling tools 117*a*, 117*b* and 119*a*, 119*b* of the respective coupling units 112*a* to 113*b* extend laterally outward relative to the vertical shafts 118*a*, 118*b* and 120*a*, 120*b* adjacent thereto in the front-rear direction, and each include a fitting groove 121 having an arc shape about the vertical axial center of respective rollers 110*b*, 111*b* and 110*e*, 111*e* located below the hook-shaped coupling tools and being opened on the vertical shaft 118*a*, 118*b* and 120*a*, 120*b* side located inside.

Figure 21A:
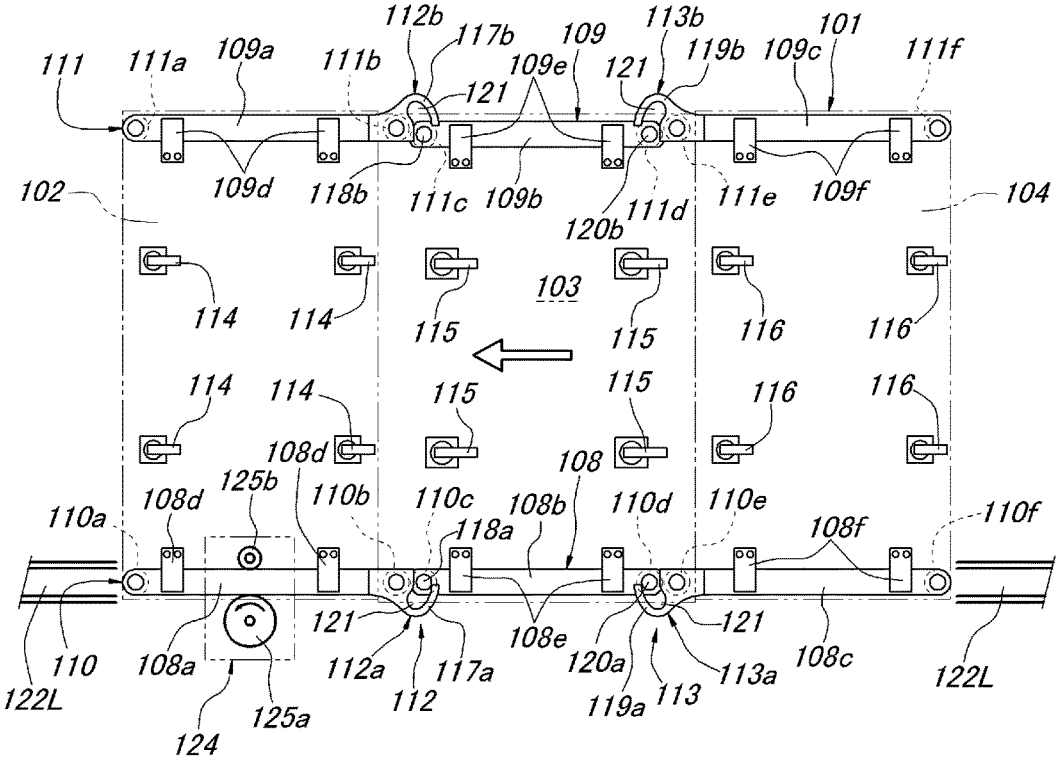
FIG. 21A is a plan view illustrating an arrangement of functional components of the conveying traveling body.
Figure 22A:
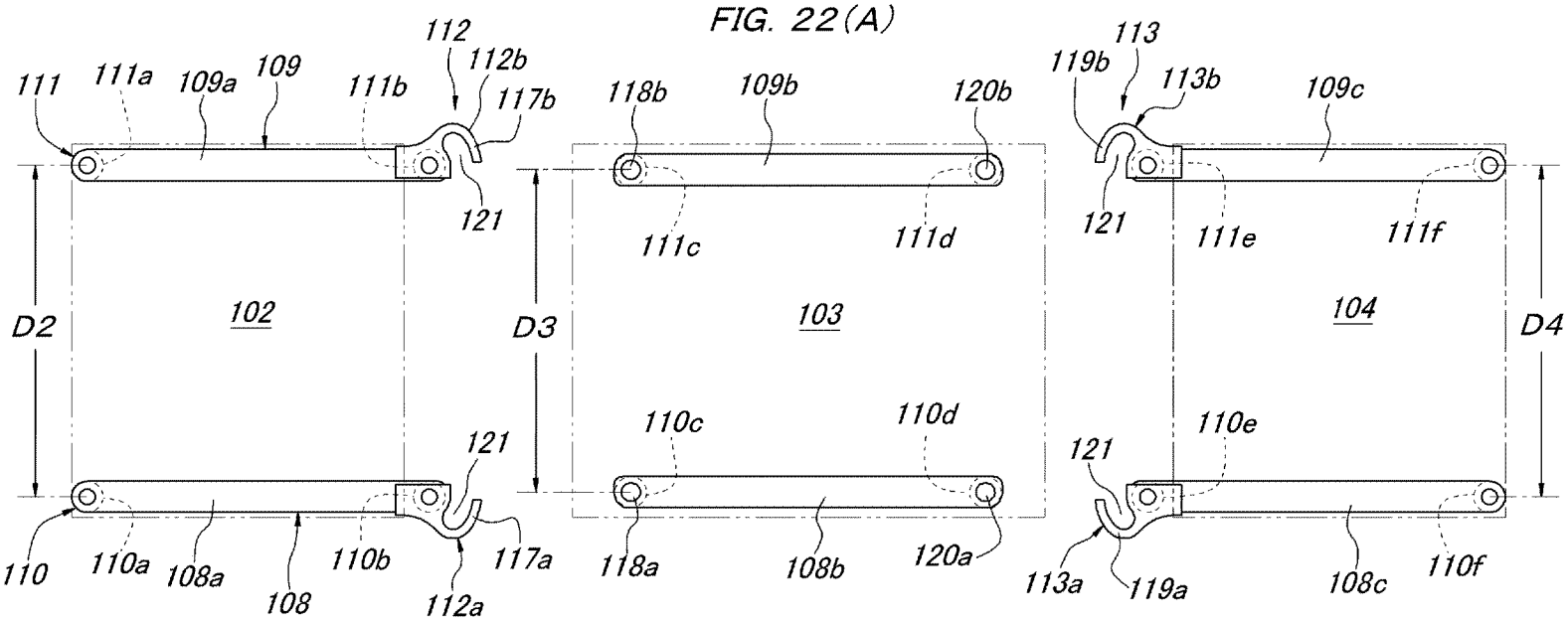
FIG. 22A is a plan view explaining load bar units provided to respective wagons of the conveying traveling body, wagon-to-wagon coupling means, and left and right two guide roller rows.
Figure 22B:
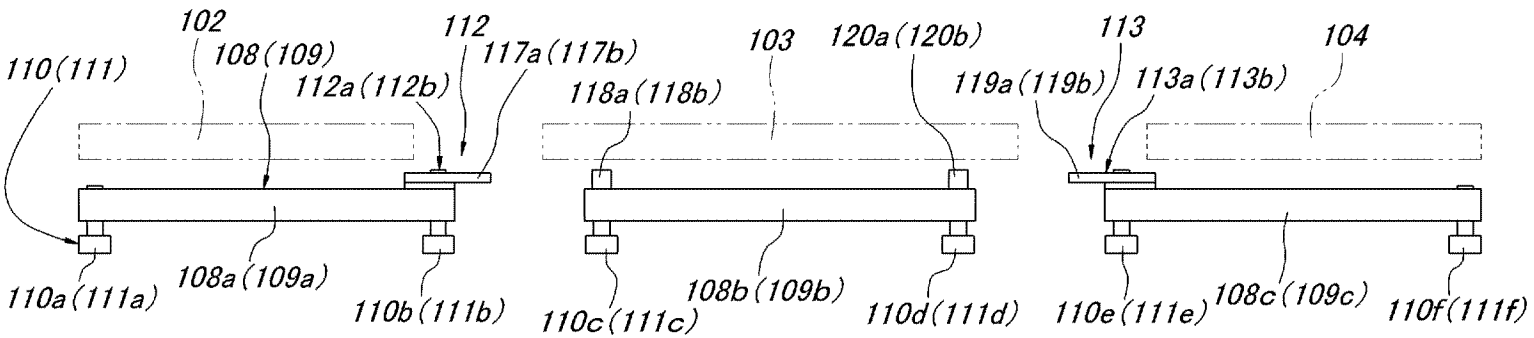
FIG. 22B is a side view of the same.
Figure 23:
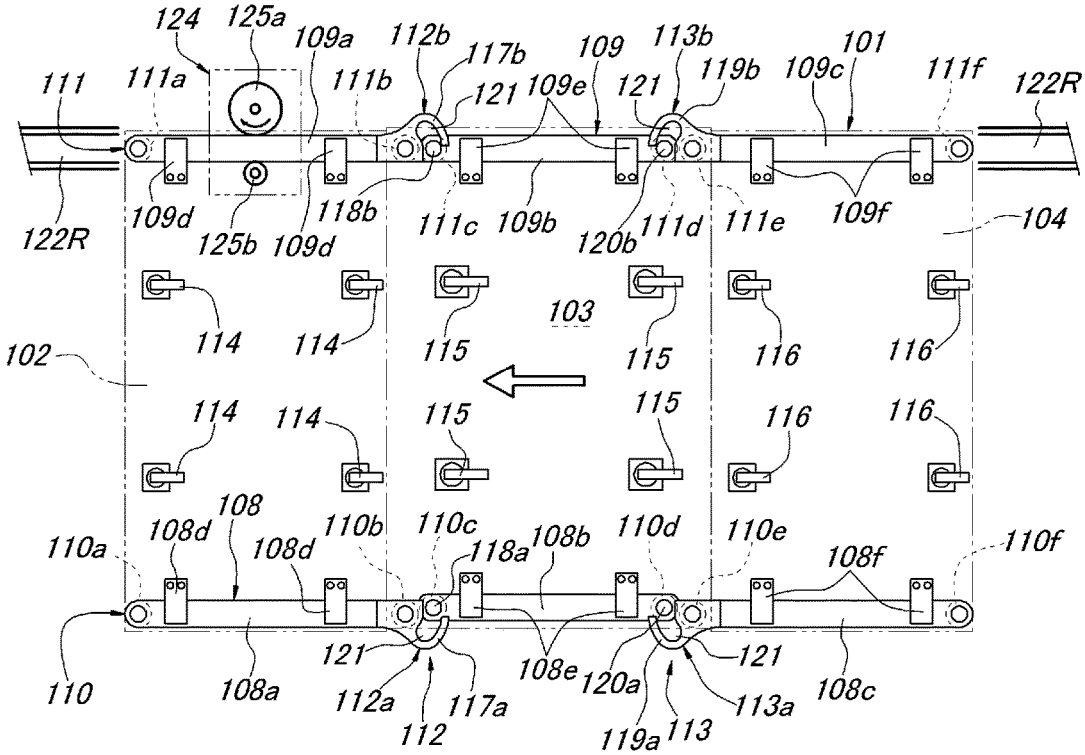

As illustrated in FIGS. 22A and 22B, a distance D2 between the pair of left and right load bar units 108*a*, 109*a* of the front-end wagon 102 and a distance D4 between the pair of left and right load bar units 108*c*, 109*c* of the rear-end wagon 104 are equal to each other. A distance D3 between the pair of left and right load bar units 108*b*, 109*b* of the central wagon 103 is slightly shorter than the distance D2 and the distance D4. More specifically, as illustrated in FIG. 21A, when the central wagon 103 is relatively laterally moved relative to the front- and rear-both end wagons 102, 104 toward the left side where the load bar 108 is located up to a lateral movement limit position, the left load bar units 108*a* to 108*c* and the respective rollers 110*a* to 110*f* of the guide roller row 110 pivotally supported thereto are configured to be positioned on a straight line, and the coupling units 112*a*, 113*a* on the same side are configured to be brought into a coupled state in which the fitting grooves 121 of the hook-shaped coupling tools 117*a*, 119*a* of the coupling units 112*a*, 113*a* fit the vertical shafts 118*a*, 120*a* located inside to the extent not much more than a radius of the vertical shafts 118*a*, 120*a*, and the coupling units 112*b*, 113*b* on the other side are configured to be brought into an uncoupled state in which the vertical shafts 118*b*, 120*b* thereof are detached inside from the fitting grooves 121 of the hook-shaped coupling tools 117*b*, 119*b* located outside. Thus, as illustrated in FIG. 23, when the central wagon 103 is relatively laterally moved relative to the front- and rear-both end wagons 102, 104 toward the right side where the load bar 109 is located up to a lateral movement limit position, the right load bar units 109*a* to 109*c* and the respective rollers 111*a* to 111*f* of the guide roller row 111 pivotally supported thereto are positioned on a straight line, and the coupling units 112*b*, 113*b* on the same side are brought into a coupled state in which the fitting grooves 121 of the hook-shaped coupling tools 117*b*, 119*b* of the coupling units 112*b*, 113*b* fit the vertical shafts 118*b*, 120*b* located inside to the extent not much more than a radius of the vertical shafts 118*b*, 120*b*, and the coupling units 112*a*, 113*a* on the other side are brought into an uncoupled state in which the vertical shafts 118*a*, 120*a* thereof are detached inside from the fitting grooves 121 of the hook-shaped coupling tools 117*a*, 119*a* located outside.

Figure 19A:
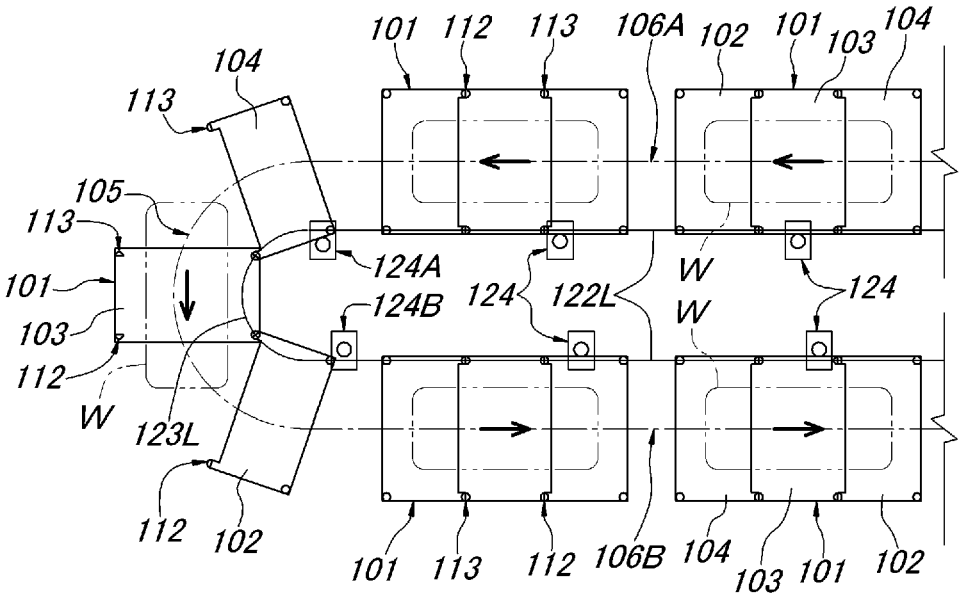
Figure 24:
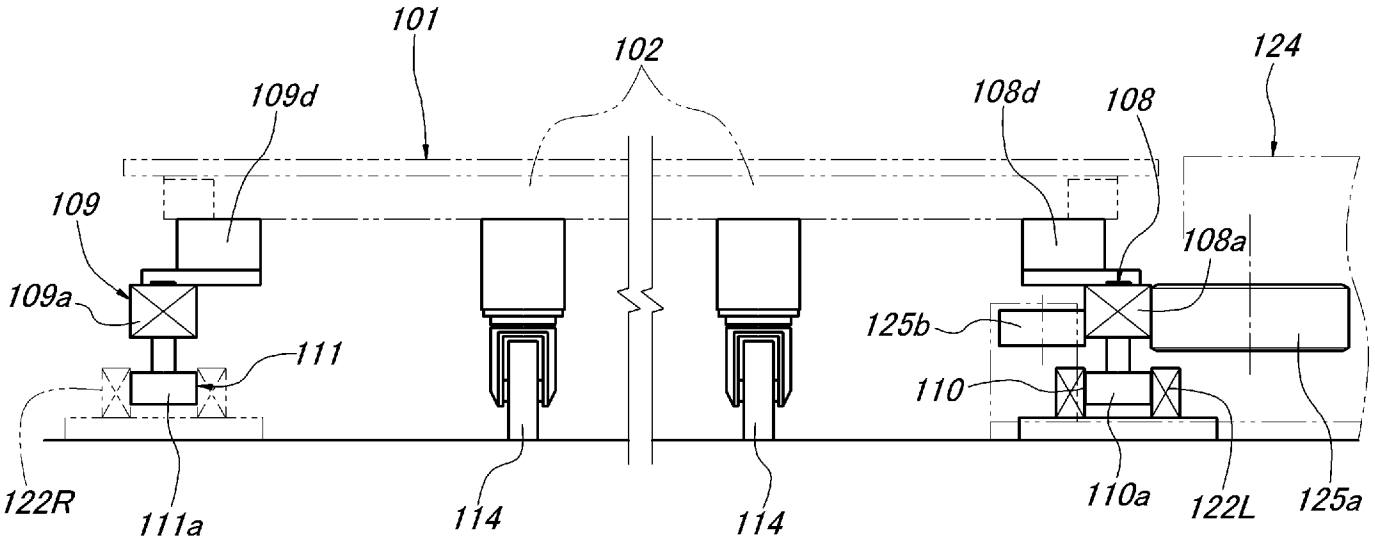
Figures 25A, 25B:
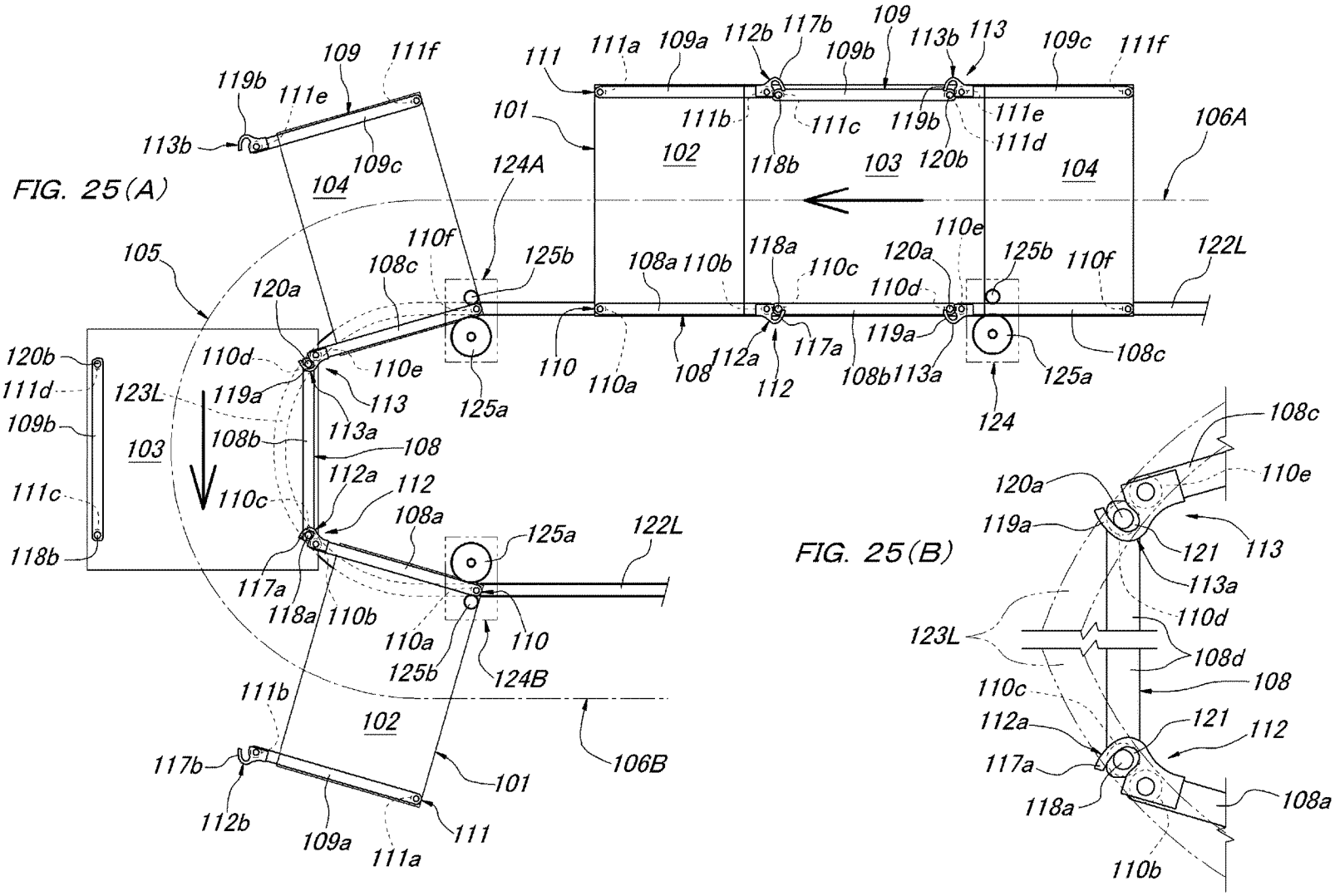
FIG. 25A is a plan view illustrating a state at the time when the conveying traveling body with the coupling units at the left row being in the coupled state turns a counter-clockwise horizontal turn path section from a straight-ahead path section.
FIG. 25B is an enlarged plan view illustrating an essential part at the horizontal turn path section.
Figure 28:
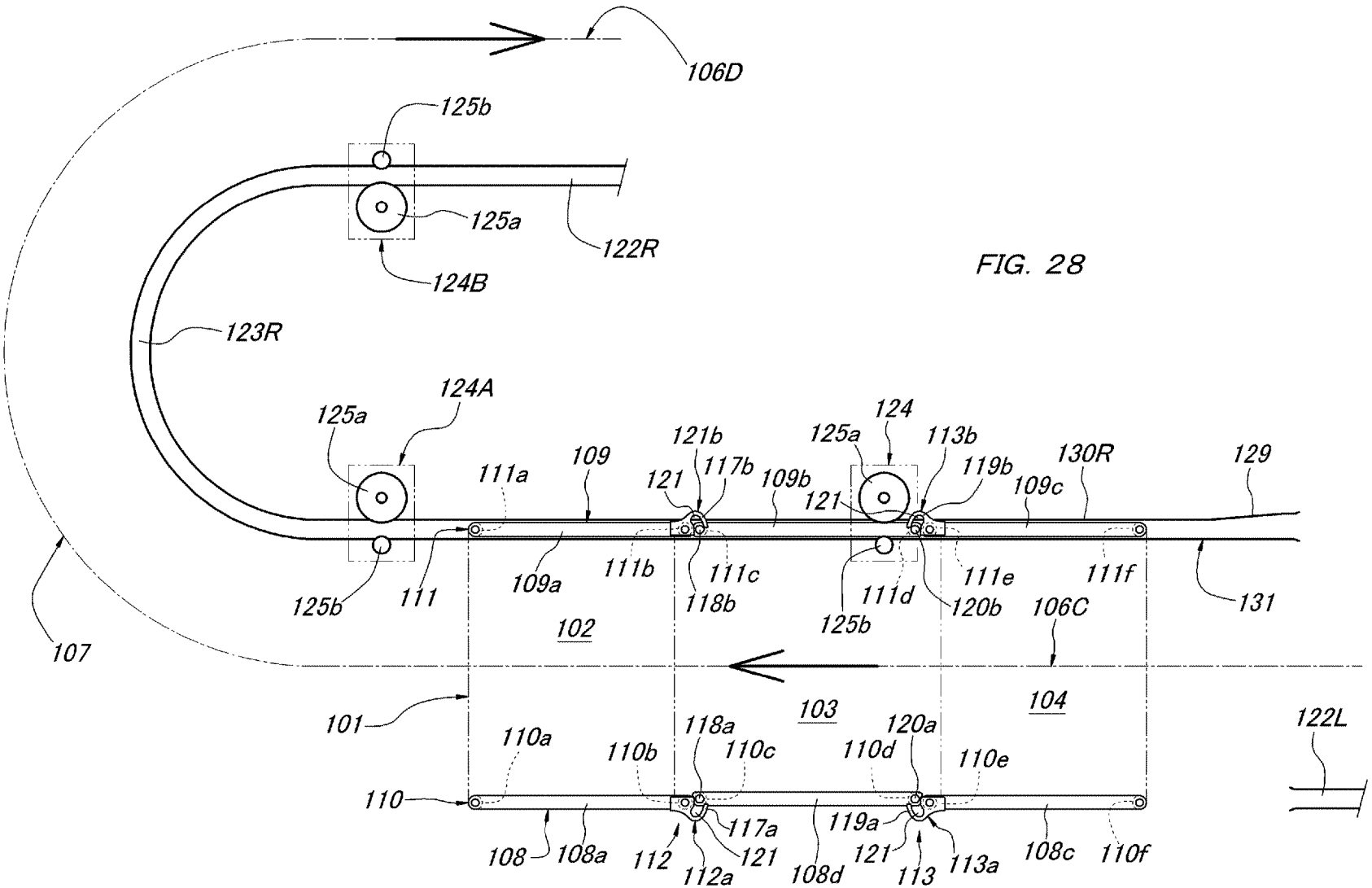

On the entrance-side straight-ahead path section 106A of the counterclockwise horizontal turn path section 105 and the exit-side straight-ahead path section 106B of the counterclockwise horizontal turn path section 105 illustrated in FIG. 19A, a left straight-ahead guide rail 122L is laid that sandwiches from the left and right both sides and guides the respective rollers 110*a* to 110*f* of the guide roller row 110 of the left and right two guide roller rows 110, 111 of the conveying traveling body 101 traveling, which guide roller row 110 juxtaposed to the left load bar 108 coupled by the coupling units 112*a*, 113*a*, as illustrated in FIG. 21A and FIG. 24. On the counterclockwise horizontal turn path section 105, a left circular guide rail 123L is laid that sandwiches from the left and right both sides and guides the respective rollers 110*a* to 110*f* of the left guide roller row 110 moving the inner side in the curving direction of the path section, as illustrated in FIGS. 25A and 25B. On the entrance-side straight-ahead path section 106C of the clockwise horizontal turn path section 107 and the exit-side straight-ahead path section 106D of the clockwise horizontal turn path section 107 illustrated in FIG. 19B, a right straight-ahead guide rail 122R is laid that sandwiches from the left and right both sides and guides the respective rollers 111*a* to 111*f* of the guide roller row 111 of the left and right two guide roller rows 110, 111 of the conveying traveling body 101 traveling, which guide roller row 111 juxtaposed to the right load bar 109 coupled by the coupling units 112*b*, 113*b*, as illustrated in FIG. 23. On the clockwise horizontal turn path section 107, a right circular guide rail 123R is laid that sandwiches from the left and right both sides and guides the respective rollers 111*a* to 111*f* of the right guide roller row 111 moving the inner side in the curving direction of the path section, as illustrated in FIG. 28.

Friction drive means 124 utilizing the load bar 108 or 109 with respective load bar units 108*a* to 108*c* or 109*a* to 109*c* coupled by the coupling units 112*a*, 113*a* or 112*b*, 113*b* are disposed on the travel path side of the conveying traveling body 101 as the traveling drive means for making the conveying traveling body 101 travel. These friction drive means 124 are conventionally known ones that are include a friction drive wheel 125*a* and a backup roller 125*b*, sandwiching the load bar 108 or 109, and a motor (not shown) rotationally driving the friction drive wheel 125*a*. Installation intervals between the friction drive means 124 on the travel path are, as conventionally known, made the same as or slightly shorter than the entire length of the conveying traveling body 101 (the entire length of the load bar 108, 109) when the conveying traveling bodies 101 are made to travel at a constant speed at a predetermined interval, and the friction drive means 124 are installed at the entrance and the exit on the pushing drive zone where the conveying traveling bodies 101 are made to continue bumper to bumper and integrally travel. In this embodiment, the path length further inside in the curving direction of the horizontal turn path section 105, 107 is slightly shorter than the entire length of the load bar 108, 109, and thus, it is configured such that friction drive means 124A, 124B are disposed at the entrance and the exit of the horizontal turn path section 105, 107 and the front end of the load bar 108 or 109 is driven by the friction drive means 124B at the exit just before the rear end of the load bar 108 or 109 to be driven is separated from the friction drive means 124A at the entrance.

Figure 21B:
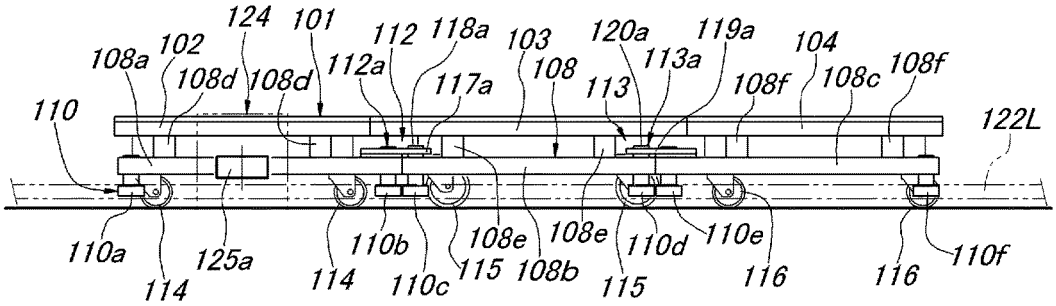
FIG. 21B is a side view of the conveying traveling body.

The conveying traveling body 101 traveling from the entrance-side straight-ahead path section 106A of the counterclockwise horizontal turn path section 105 to the exit-side straight-ahead path section 106B via the counterclockwise horizontal turn path section 105 as illustrated in FIG. 19A is such that the central wagon 103 is laterally moved leftward to the lateral movement limit position relative to the front- and rear-both end wagons 102, 104 and the hook-shaped coupling tools 117*a*, 119*a* are fitted to respective vertical shafts 118*a*, 120*a* of the left coupling units 112*a*, 113*a* to be brought into the coupled state and also the vertical shafts 118*b*, 120*b* are detached inside from respective hook-shaped coupling tools 117*b*, 119*b* of the right coupling units 112*b*, 113*b* to be brought into the uncoupled state, as illustrated in FIGS. 21A and 21B. As a result, the respective wagons 102 to 104 are such that only left portions thereof are coupled by the left coupling units 112*a*, 113*a* and only the left load bar 108 of the pair of left and right load bars 108, 109 comes into a straight line by the respective load bar units 108*a* to 108*c* being coupled by the coupling units 112*a*, 113*a*. Furthermore, only the left guide roller row 110 of the pair of left and right guide roller rows 110, 111 is in a state where their respective rollers 110*a* to 110*f* are disposed in series on a straight line. Accordingly, on the respective path sections 106A, 105, 106B illustrated in FIG. 19A, the conveying traveling body 101 forward-traveling with the left load bar 108 driven by the friction drive means 124, 124A, 124B can travel along the respective path sections 106A, 105, 106B by the respective rollers 110*a* to 110*f* of the left guide roller row 110 being guided by the left straight-ahead guide rail 122L and the left circular guide rail 123L.

Figure 19B:
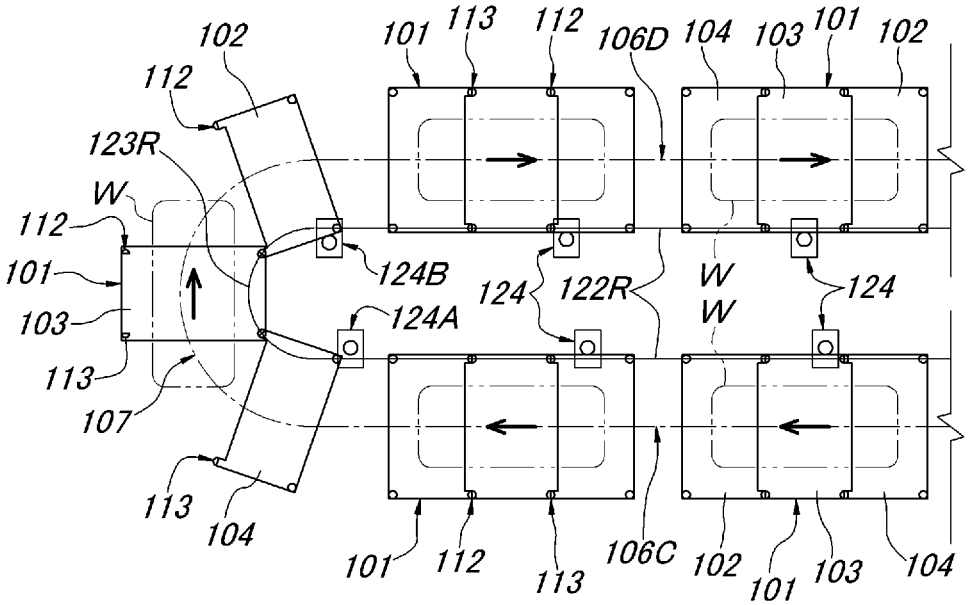

The conveying traveling body 101 traveling from the entrance-side straight-ahead path section 106C of the clockwise horizontal turn path section 107 to the exit-side straight-ahead path section 106D via the clockwise horizontal turn path section 107 as illustrated in FIG. 19B is such that the central wagon 103 is laterally moved rightward to the lateral movement limit position relative to the front- and rear-both end wagons 102, 104 and the hook-shaped coupling tools 117*b*, 119*b* are fitted to respective vertical shafts 118*b*, 120*b* of the right coupling units 112*b*, 113*b* to be brought into the coupled state and also the vertical shafts 118*a*, 120*a* are detached inside from respective hook-shaped coupling tools 117*a*, 119*a* of the left coupling units 112*a*, 113*a* to be brought into the uncoupled state, as illustrated in FIG. 23. As a result, the respective wagons 102 to 104 are such that only right portions thereof are coupled by the right coupling units 112*b*, 113*b* and only the right load bar 109 of the pair of left and right load bars 108, 109 comes into a straight line by the respective load bar units 109*a* to 109*c* being coupled by the coupling units 112*b*, 113*b*. Furthermore, only the right guide roller row 111 of the pair of left and right guide roller rows 110, 111 is in a state where their respective rollers 111*a* to 111*f* are disposed in series on a straight line. Accordingly, on the respective path sections 106C, 107, 106D illustrated in FIG. 19B, the conveying traveling body 101 forward-traveling with the right load bar 109 driven by the friction drive means 124, 124A, 124B can travel along the respective path sections 106C, 107, 106D by the respective rollers 111*a* to 111*f* of the right guide roller row 111 being guided by the right straight-ahead guide rail 122R and the right circular guide rail 123R.

The conveying traveling body 101 traveling the counterclockwise horizontal turn path section 105 or the clockwise horizontal turn path section 107 travels the counterclockwise horizontal turn path section 105 or the clockwise horizontal turn path section 107 in a state that the respective wagons 102 to 104 are horizontally bent and spread in a fan shape around the vertical shafts 118*a*, 120*a* of the respective coupling units 112*a*, 113*a* or the vertical shafts 118*b*, 120*b* of the respective coupling units 112*b*, 113*b* coupling the wagons 102 to 104 (the respective load bar units 108*a* to 108*c* of the left load bar 108 or the respective load bar units 109*a* to 109*c* of the right load bar 109). The load bar 108 or 109 separated from the friction drive means 124A at the entrance continues to be driven by the friction drive means 124B at the exit and is sent into the end-side straight-ahead path section 106B or 106D. As illustrated in FIG. 25B illustrating the state on the counterclockwise horizontal turn path section 105, the hook-shaped coupling tools 117*a*, 119*a* (or 117*b*, 119*b*) of the respective coupling units 112*a*, 113*a* (or 112*b* and 113*b*) have the circular fitting grooves 121 deeply fitted to the counterpart vertical shafts 118*a*, 120*a* (or vertical shafts 118*b*, 120*b*) when the respective wagons 102 to 104 are spread in a fan shape around the vertical shafts 118*a*, 120*a* (or vertical shafts 118*b*, 120*b*).

Figure 20A:
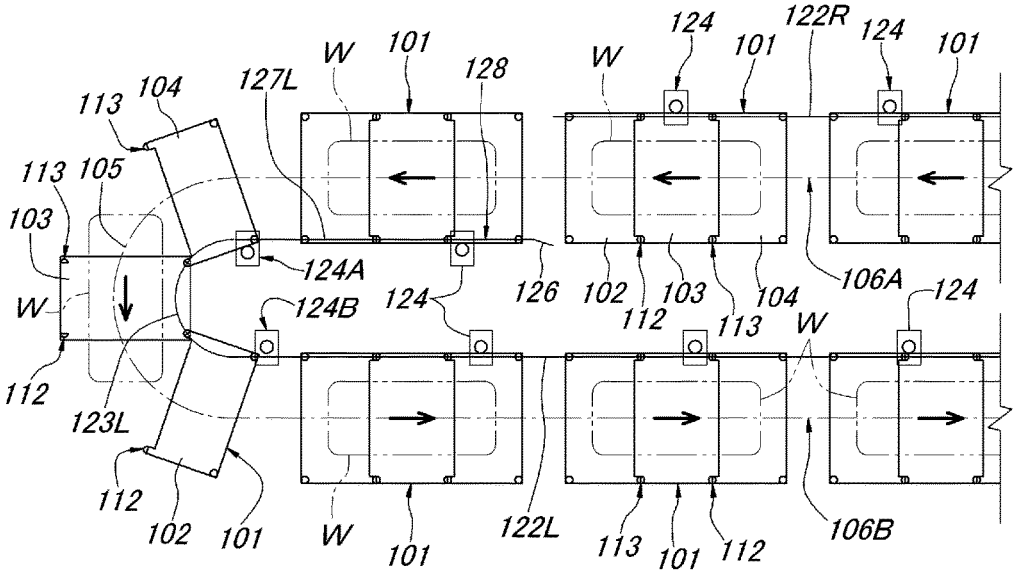
FIGS. 20A and 20B are schematic plan views explaining a travel path provided with a coupling control means for the conveying traveling body.

As illustrated in FIG. 20A, in a case of the configuration that the traveling of the conveying traveling body 101 is guided by the right straight-ahead guide rail 122R as in a case where the entrance-side straight-ahead path section 106A of the counterclockwise horizontal turn path section 105 is connected to the exit-side straight-ahead path section 106D of the clockwise horizontal turn path section 107 illustrated in for example FIG. 19B, the right straight-ahead guide rail 122R is terminated at an appropriate position before the counterclockwise horizontal turn path section 105, and a second left straight-ahead guide rail 127L connected to the left circular guide rail 123L laid on the counterclockwise horizontal turn path section 105 is laid on a zone from the vicinity of the terminal end of the right straight-ahead guide rail 122R to the counterclockwise horizontal turn path section 105, and a controlling guide rail 126 is formed at the entrance of the second left straight-ahead guide rail 127L. A coupling control means 128 is constituted by the second left straight-ahead guide rail 127L having the controlling guide rail 126.

Figure 20B:
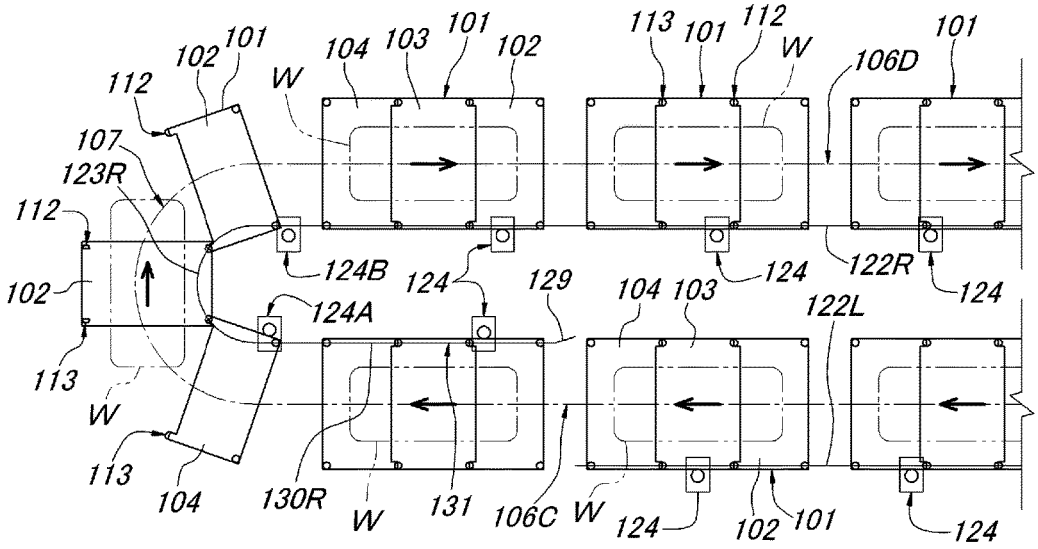

Similarly, as illustrated in FIG. 20B, in a case of the configuration that the traveling of the conveying traveling body 101 is guided by the left straight-ahead guide rail 122L as in a case where the entrance-side straight-ahead path section 106C of the clockwise horizontal turn path section 107 is connected to the exit-side straight-ahead path section 106B of the counterclockwise horizontal turn path section 105 illustrated in for example FIG. 19A, the left straight-ahead guide rail 122L is terminated at an appropriate position before the clockwise horizontal turn path section 107, and a second right straight-ahead guide rail 130R connected to the right circular guide rail 123R laid on the clockwise horizontal turn path section 107 is laid on a zone from the vicinity of the terminal end of the left straight-ahead guide rail 122L to the clockwise horizontal turn path section 107, and a controlling guide rail 129 is formed at the entrance of the second right straight-ahead guide rail 130R. A coupling control means 131 is constituted by the second right straight-ahead guide rail 130R having the controlling guide rail 129.

As illustrated in FIG. 21A and FIG. 23, when the central wagon 103 is laterally moved to the lateral movement limit position relative to the front- and rear-both end wagons 102, 104, the coupling units 112*a*, 113*a* or 112*b*, 113*b* on the lateral movement direction side are brought into the coupled state and the coupling units 112*b*, 113*b* or 112*a*, 113*a* on the opposite side are brought into the uncoupled state. Thus, the guide roller row 110 or 111 on the coupling released side of the pair of left and right guide roller rows 110, 111 is in a state that the respective pairs of front and rear rollers 110*a*, 110*b*, 110*e*, 110*f* or 111*a*, 111*b*, 111*e*, 111*f* provided to the front- and rear-both end wagons 102, 104 project outside a virtual straight line in the front-rear direction which the pair of front and rear rollers 110*c*, 110*d* or 111*c*, 111*d* of the central wagon 103 pass. The controlling guide rails 126, 129 of the coupling control means 128, 131 pressingly move to the inside the rollers 110*a*, 110*b*, 110*e*, 110*f* or 111*a*, 111*b*, 111*e*, 111*f* provided to the front- and rear-both end wagons 102, 104 of the guide roller row 110 or 111 on the coupling released side, laterally move the front- and rear-both end wagons 102, 104 inside up to the lateral movement limit position relative to the central wagon 103, switch the guide roller row 110 or 111 (the load bar 108 or 109) on the coupling released side into a state in which all of the rollers 110*a* to 110*f* or 111*a* to 111*f* thereof are positioned on a straight line, and switch the uncoupled coupling units 112*a*, 113*a* or 112*b*, 113*b* into the coupled state.

Hereinafter, a configuration and operation of the coupling control means 131 illustrated in FIG. 20B will be described based on FIGS. 26A to 28. On the entrance-side straight-ahead path section 106C of the clockwise horizontal turn path section 107, the conveying traveling body 101 guided by the left straight-ahead guide rail 122L is in a state illustrated in FIG. 21A, wherein the central wagon 103 is laterally moved leftward up to the lateral movement limit position relative to the front- and rear-both end wagons 102, 104, and the left coupling units 112*a*, 113*a* are in the coupled state and the right coupling units 112*b*, 113*b* are in the uncoupled state, and the respective rollers 110*a* to 110*f* of the left guide roller row 110 positioned on a straight line are fitted to the left straight-ahead guide rail 122L, and the left load bar 108 in the straight-line state is driven by the friction drive means 124. With forward-traveling of the conveying traveling body 101 after reaching the terminal end of the left straight-ahead guide rail 122L, as illustrated in FIGS. 26A and 26B, the headmost roller 110*a* of the left guide roller row 110 is separated forward from the left straight-ahead guide rail 122L and the headmost roller 111*a* of the right guide roller row 111 enters the second right straight-ahead guide rail 130R while being pressingly moved inside by the controlling guide rail 129.

Figures 26A, 26B:
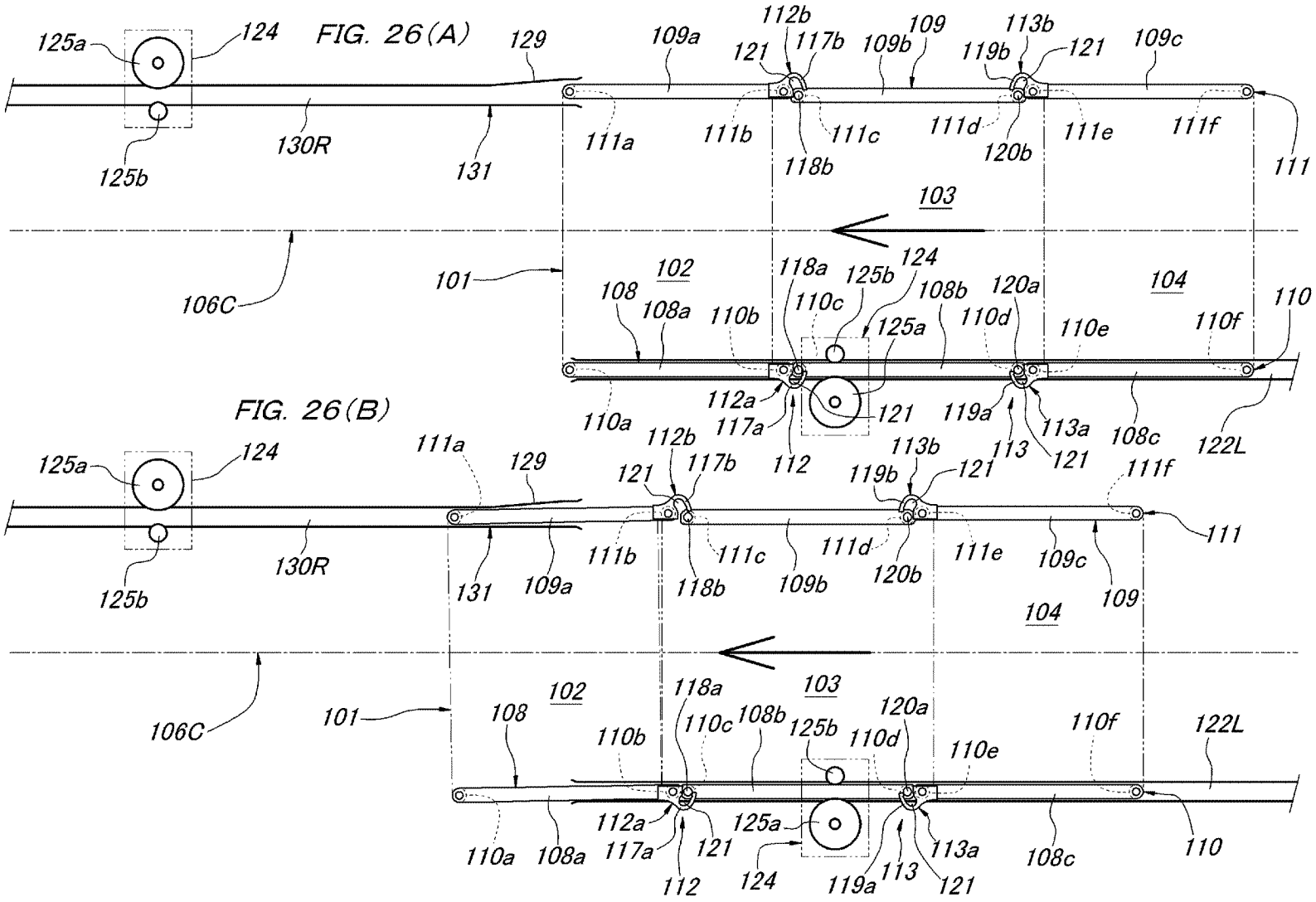
FIGS. 26A and 26B are plan views illustrating a situation at the first half stage of coupling control in sending the conveying traveling body into the clockwise horizontal turn path section from the straight-ahead path section illustrated in FIG. 25A.
Figures 27A, 27B:
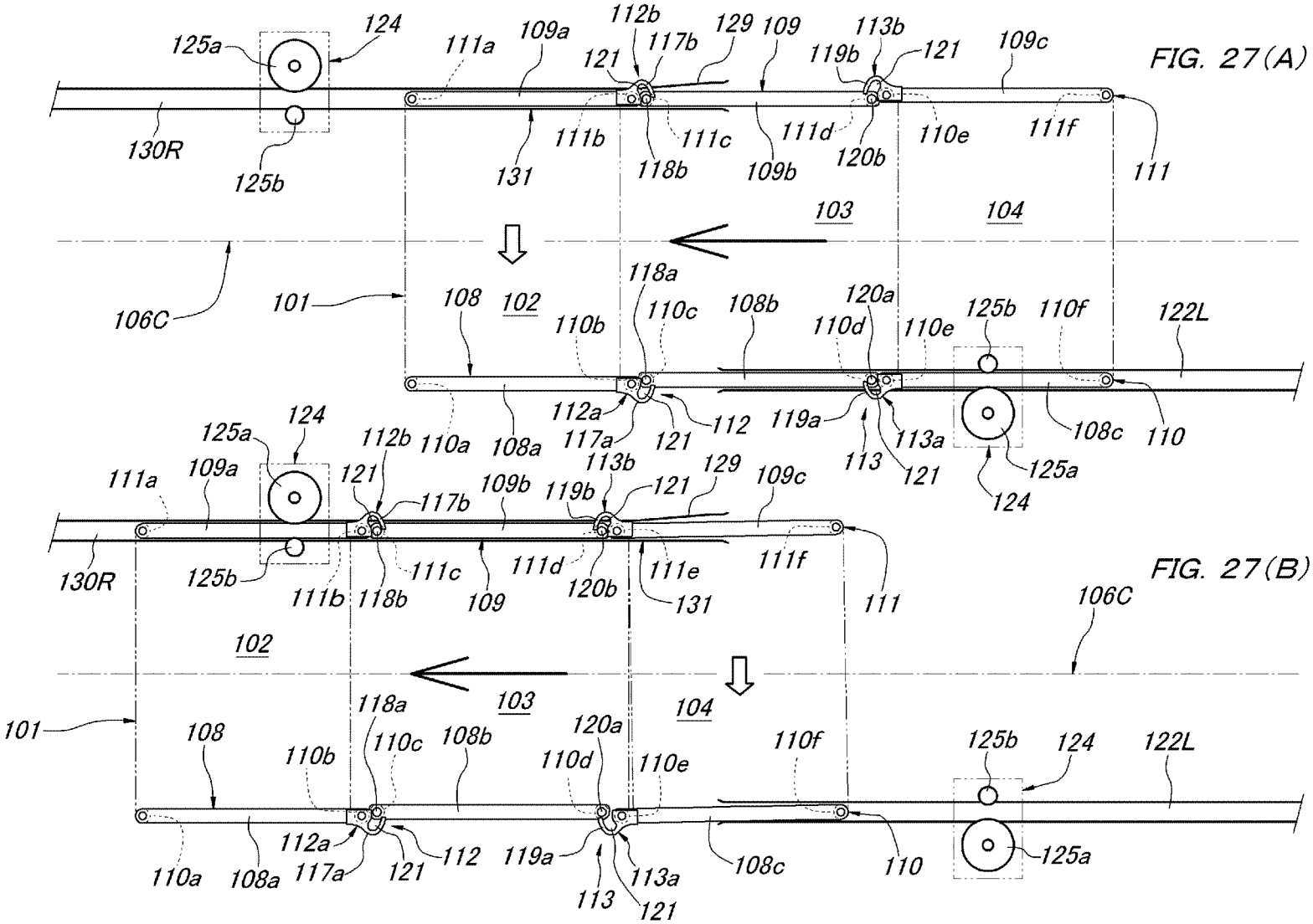
FIGS. 27A and 27B are plan views illustrating a situation at the latter half stage following the first half stage illustrated in FIGS. 26A and 26B.

By the above operation of the controlling guide rail 129 with respect to the headmost roller 111*a*, the front-end wagon 102 tilts horizontally leftward about the left rear-end roller 110*b* still guided by the left straight-ahead guide rail 122L, as illustrated in FIG. 26B. At this time, the hook-shaped coupling tool 117*b* on the wagon 102 side of the right coupling unit 112*b* is slightly moved forward relative to the vertical shaft 118*b* on the wagon 103 side. However, the right coupling units 112*b*, 113*b* are in the uncoupled state where the hook-shaped coupling tools 117*b*, 119*b* are separated outside with respect to the vertical shafts 118*b*, 120*b*, and thus, the both never interfere with each other. By subsequent forward-traveling of the conveying traveling body 101, as illustrated in FIG. 27A, the right rear-end roller 111*b* of the front-end wagon 102 enters into the second right straight-ahead guide rail 130R from the controlling guide rail 129, and the front-end wagon 102 tilting leftward tilts inward around the right headmost roller 111*a* to be oriented straight ahead. At this time, the hook-shaped coupling tool 117*b* on the wagon 102 side of the coupling unit 112*b* is fitted into the vertical shaft 118*b* on the wagon 103 side from the outside, and the coupling unit 112*b* is switched from the uncoupled state to the coupled state. The left coupling unit 112*a* in the coupled state is switched into the uncoupled state by the hook-shaped coupling tool 117*a* on the wagon 102 side being separated outside from the vertical shaft 118*a* on the wagon 103 side.

After the left coupling unit 112*a* is switched into the uncoupled state and the right coupling unit 112*b* is switched into the coupled state, the right pair of front and rear rollers 111*c*, 111*d* of the central wagon 103 sequentially enter the second right straight-ahead guide rail 130R via the controlling guide rail 129. Since positioned on a virtual straight line in the front-rear direction which the right pair of front and rear rollers 111*a*, 111*b* of the front-end wagon 102 having been displaced inside and oriented straight ahead pass, the right pair of front and rear rollers 111*c*, 111*d* of the central wagon 103 enter the second right straight-ahead guide rail 130R at as-is positions without undergoing the operation of the controlling guide rail 129. Subsequently, as illustrated in FIG. 27B, the right front-end roller 111*e* of the rear-end wagon 104, which is positioned projecting outside with respect to the right rear-end roller 111*d* of the central wagon 103, enters the second right straight-ahead guide rail 130R while being pressingly moved inside by the controlling guide rail 129. As a result, the hook-shaped coupling tool 119*b* on the wagon 104 side of the right coupling unit 113*b* is fitted to the vertical shaft 120*b* on the wagon 103 side from the outside and then switched into the coupled state. Simultaneously, the left coupling unit 113*a* is switched into the uncoupled state by the hook-shaped coupling tool 119*a* on the wagon 104 side being separated rearward and outside from the vertical shaft 120*a* on the wagon 103 side. Finally, as illustrated in FIG. 28, the right rear-end roller 111*f* of the rear-end wagon 104 enters the second right straight-ahead guide rail 130R via the controlling guide rail 129, whereby the rear-end wagon 104 is returned to the straight ahead orientation, and the respective wagons 102 to 104 of the conveying traveling body 101 are disposed in series in the straight ahead orientation, and all of the rollers 111*a* to 111*f* of the right guide roller row 111 positioned on a straight line are guided by the second right straight-ahead guide rail 130R.

When the rear-end load bar unit 108*c* of the left load bar 108 is separated forward from the friction drive means 124 at the final position juxtaposed on the left straight-ahead guide rail 122L, the front-end load bar unit 109*a* of the right load bar 109 guided in the straight ahead orientation by the second right straight-ahead guide rail 130R is driven by the friction drive means 124 juxtaposed on the second right straight-ahead guide rail 130R, and the conveying traveling body 101 is transferred from the left straight-ahead guide rail 122L to the second right straight-ahead guide rail 130R without stopping and continues to travel forward successively by the friction drive means 124 juxtaposed on the second right straight-ahead guide rail 130R.

The conveying traveling body 101 on the entrance-side straight-ahead path section 106C of the clockwise horizontal turn path section 107 having the left guide roller row 110 guided by the left straight-ahead guide rail 122L and driven by the friction drive means 124 via the left load bar 108 in the straight-line state is sent into the clockwise horizontal turn path section 107 by the above operation of the coupling control means 131 while having the right guide roller row 111 guided by the second right straight-ahead guide rail 130R before the clockwise horizontal turn path section 107 and driven by the friction drive means 124 via the right load bar 109 in the straight-line state. Thus as described earlier based on FIG. 19B, the conveying traveling body 101 can travel forward through the clockwise horizontal turn path section 107 to the straight-ahead path section 106D at the exit thereof.

A configuration of the coupling control means 128 provided when the entrance-side straight-ahead path section 106A of the counterclockwise horizontal turn path section 105 guides the conveying traveling body 101 by the right straight-ahead guide rail 122R as illustrated in FIG. 20A is symmetrical to the configuration of the coupling control means 131 provided on the entrance-side straight-ahead path section 106C of the clockwise horizontal turn path section 107 as described above based on FIG. 20B, and the operation thereof is exactly the same except the other way around in the lateral direction. Therefore, explanatory drawings of the specific configuration corresponding to FIGS. 26A to 28 and descriptions of the operation are omitted.

Figures 29A, 29B:
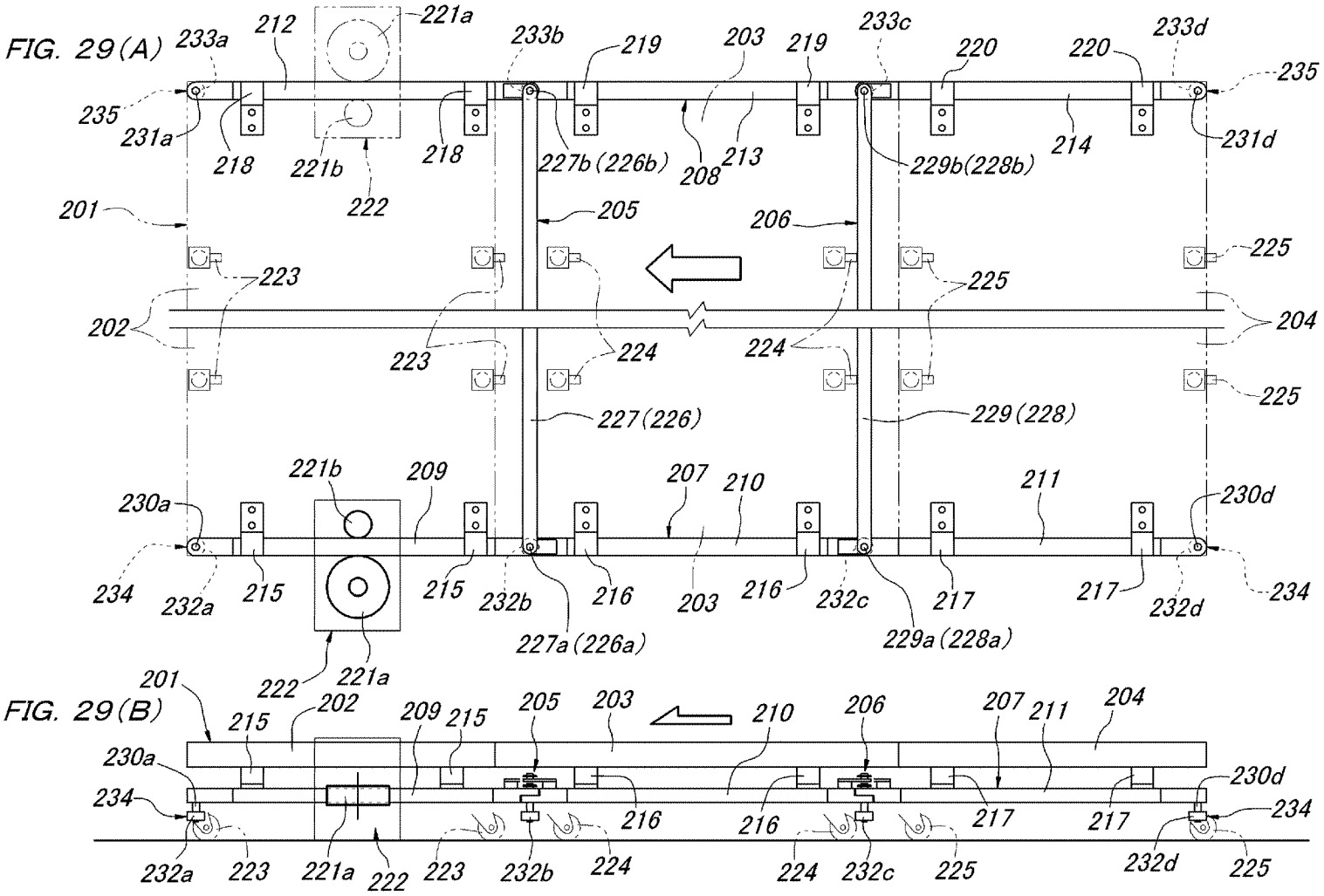

Next, an embodiment of the second aspect of the invention will be described based on FIGS. 29A to 36. In FIGS. 29A and 29B, a conveying traveling body 201 is constituted of three wagons, a front-end wagon 202, a central wagon 203, and a rear-end wagon 204, disposed in series in a traveling direction and having the same width. The central wagon 203 supports a workpiece such as an automotive vehicle body in an automobile assembly line and has such a length in the traveling direction that front and rear both end portions of the workpiece project above the front- and rear-both end wagons 202, 204. The front- and rear-both end wagons 202, 204 have the same length in the traveling direction and are short in length as compared to the central wagon 203. The front-end wagon 202 and the central wagon 203 are coupled by a front wagon-to-wagon coupling means 205, and the central wagon 203 and the rear-end wagon 204 are coupled by a rear wagon-to-wagon coupling means 206.

To the conveying traveling body 201, a pair of left and right load bars 207, 208 continuing across the entire length of the conveying traveling body 201 is provided on bottom surface sides of left and right both side faces of the conveying traveling body 201. These load bars 207, 208 have square columnar rod members 209 to 211 and 212 to 214 divided for respective wagons 202 to 204. Each of the rod members 209 to 214 is mounted on the underside of the left and right both side faces of respective wagons 202 to 204 via front and rear mounting members 215 to 220. This pair of left and right load bars 207, 208 constitute a traveling drive means for making the conveying traveling body 201 travel, together with a friction drive wheel 221*a* and a backup roller 221*b* pressure-contacted to at least either one of the load bars 207, 208 from the left and right both sides. Front and rear two pairs of left and right caster wheels 223 to 225 rolling on the floor surface are mounted on bottom portions of the respective wagons 202 to 204.

Hereinafter, a detailed description will be given based on FIGS. 30A to 34D. The rod members 209 to 214 constituting the load bars 207, 208 have main bodies 209*a* to 214*a* made of square pipes and end members 209*b*, 209*c* to 214*b*, 214*c* fixed at front and rear both ends thereof. The rear end member 209*c* of the rod member 209, the front end member 211*b* of the rod member 211, the rear end member 212*c* of the rod member 212, and the front end member 214*b* of the rod member 214 mounted to the front- and rear-both end wagons 202, 204 are formed with upper bearing portions 209*d*, 211*d*, 212*d*, 214*d* extending from upper halves of respective end members and having arc-shaped distal ends. The front and rear both end members 210*b*, 210*c*, 213*b*, 213*c* of the rod members 210, 213 mounted to the last central wagon 203 are formed with lower bearing members 210*d*, 210*e*, 213*d*, 213*e* extending from lower halves of respective end members and having arc-shaped distal ends. Thus, when the respective wagons 202 to 204 are in a state of being adjacent to each other in the straight ahead orientation (the state illustrated in FIGS. 29A and 29B), front and rear adjacent end members 209*c*, 210*b*/210*c*, 211*b*/212*c*, 213*b*/213*c*, 214*b* of the respective end members 209*b*, 209*c* to 214*b*, 214*c* of the rod members 209 to 214 have respective upper bearing portions 209*d*, 211*d*, 212*d*, 214*d* and respective lower bearing portions 210*d*, 210*e*, 213*d*, 213*e* vertically overlapped with each other, and the respective rod members 209 to 211 and 212 to 214 disposed in series form the load bars 207, 208 having approximately the same height and width across the entire length and having continuous left and right both side surfaces.

The front wagon-to-wagon coupling means 205 includes a lower link 226 and an upper link 227 having approximately the same length as the lateral width of the respective wagons 202 to 204 and formed of band plate materials. The lower link 226 has its left end portion pivotally supported above the center of the upper bearing portion 209*d* of the rear end member 209*c* of the left rod member 209 of the front-end wagon 202, directly by a vertical support shaft 226*a*. The lower link 226 has its right end portion supported to an upper end portion of a long vertical support shaft 226*b* erected from the center of the lower bearing portion 213*d* of the front end member 213*b* of the left rod member 213 of the central wagon 203, at a position higher than the upper surface of the rod member 213. The upper link 227 has its left end portion pivotally supported by a vertical support shaft 227*a*, above a bearing member 210*f* mounted on the front end member 210*b* of the left rod member 210 of the central wagon 203 via a spacer and extending to an upper position of the lower bearing portion 210*d* of the front end member 210*b* in a cantilever fashion. The upper link 227 has its right end portion pivotally supported by a vertical support shaft 227*b*, above a bearing member 212*e* mounted on the rear end member 212*c* of the right rod member 212 of the front-end wagon 202 via a spacer and extending to an upper position of the upper bearing portion 212*d* of the rear end member 212*c* in a cantilever fashion.

Figure 30A:
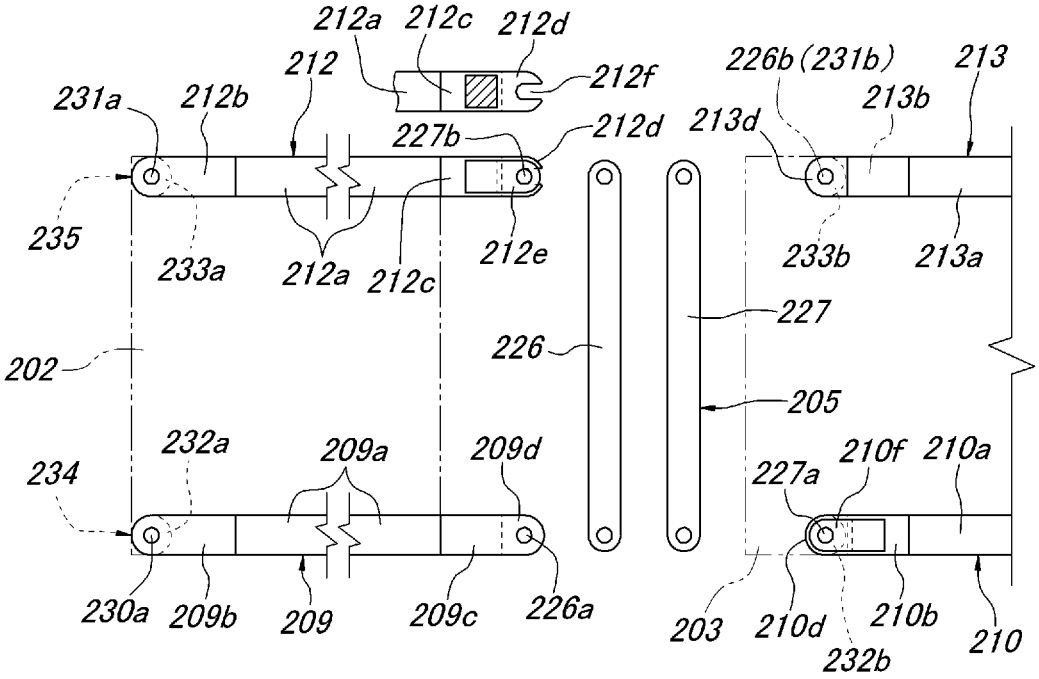
FIGS. 30A and 30B are plan views illustrating a pair of left and right rod members mounted to each wagon of the conveying traveling body and respective two links constituting wagon-to-wagon coupling means.
Figure 33A:
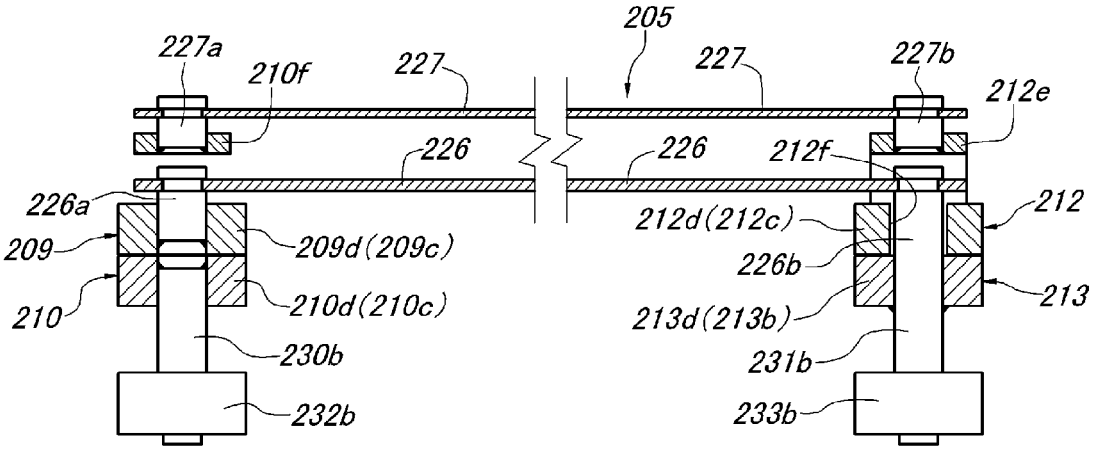
FIG. 33A is a longitudinal sectional rear view illustrating a front wagon-to-wagon coupling means.
Figure 34A:
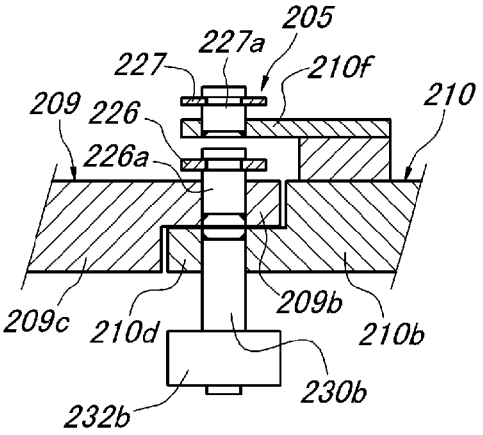
FIG. 34A is a longitudinal sectional side view at a position of a left vertical support shaft of the front wagon-to-wagon coupling means.
Figure 34B:
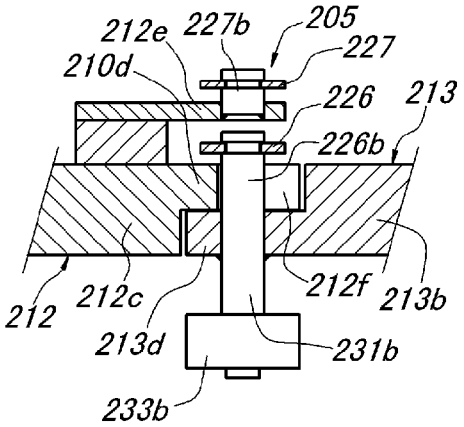
FIG. 34B is a longitudinal sectional side view at a position of a right vertical support shaft of the same wagon-to-wagon coupling means.

Thus, in the state of the front-end wagon 202 and the central wagon 203 adjoining each other in the straight ahead orientation, the upper and lower both links 226, 227 are overlapped with each other, and both ends of the lower link 226 enter below the bearing members 210*f*, 212*e* pivotally supporting both ends of the upper link 227, and the vertical support shafts 226*a*, 226*b* pivotally supporting the both ends of the lower link 226 and the vertical support shafts 227*a*, 227*b* pivotally supporting the both ends of the upper link 227 are positioned concentric to each other, as illustrated in FIG. 33A, FIG. 34A, and FIG. 34B. At this time, the upper bearing portion 212*d* of the rear end member 212*c* of the right rod member 212 of the front-end wagon 202 enters below the right end of the lower link 226, whereby the upper bearing portion 212*d* and the long vertical support shaft 226*b* pivotally supporting the right end of the lower link 226 interfere with each other. In order to avoid this interference, the upper bearing portion 212*d* is formed with a notched groove 212*f* from the arc-shaped distal end to the central portion as illustrated in FIG. 30A, and an intermediate portion of the long vertical support shaft 226*b* is configured to enter into the notched groove 212*f*.

The rear wagon-to-wagon coupling means 206 includes a lower link 228 and an upper link 229 having approximately the same length as the lateral width of the respective wagons 202 to 204 and formed of band plate materials. The lower link 228 has its left end portion pivotally supported above the center of the upper bearing portion 211*d* of the front end member 211*b* of the left rod member 211 of the rear-end wagon 204, directly by a vertical support shaft 228*a*. The lower link 228 has its right end portion supported to an upper end portion of a long vertical support shaft 228*b* erected from the center of the lower bearing portion 213*e* of the rear end member 213*c* of the right rod member 213 of the central wagon 203, at a position higher than the upper surface of the rod member 213. The upper link 229 has its left end portion pivotally supported by a vertical support shaft 229*a*, above a bearing member 210*g* mounted on the rear end member 210*c* of the left rod member 210 of the central wagon 203 via a spacer and extending to an upper position of the lower bearing portion 210*e* of the rear end member 210*c* in a cantilever fashion. The upper link 229 has its right end portion pivotally supported by a vertical support shaft 229*b*, above a bearing member 214*e* mounted on the front end member 214*b* of the right rod member 214 of the rear-end wagon 204 via a spacer and extending to an upper position of the upper bearing portion 214*d* of the front end member 214*b* in a cantilever fashion.

Figure 30B:
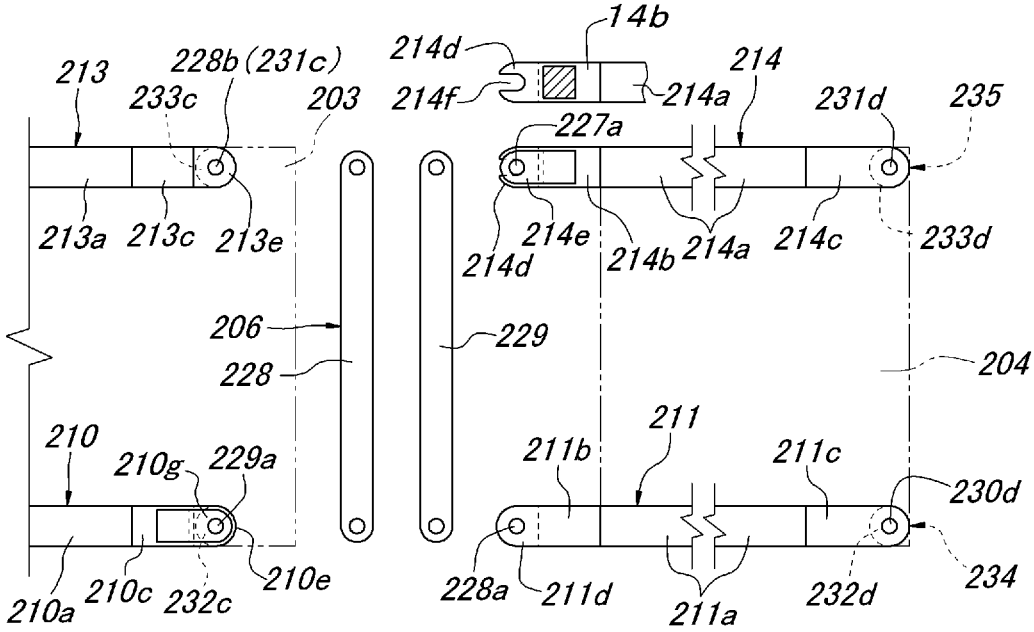
Figure 31A:
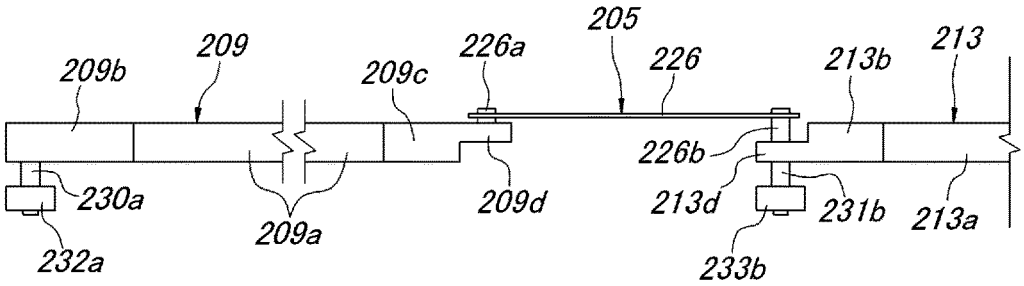
FIGS. 31A and 31B are side views illustrating mounting states of lower links placed between a central wagon and wagons at front and rear both ends.
Figure 31B:
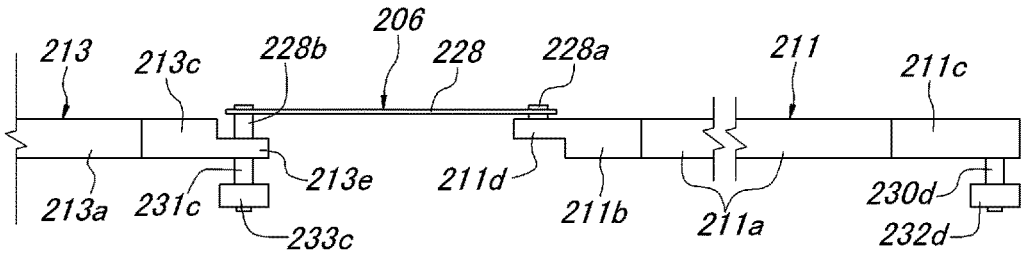
Figure 32A:
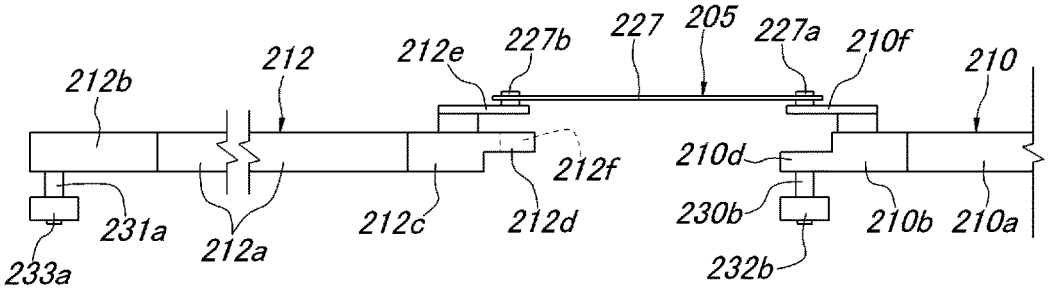
FIGS. 32A and 32B are side views illustrating mounting states of upper links placed between the central wagon and the wagons at the front and rear both ends.
Figure 32B:
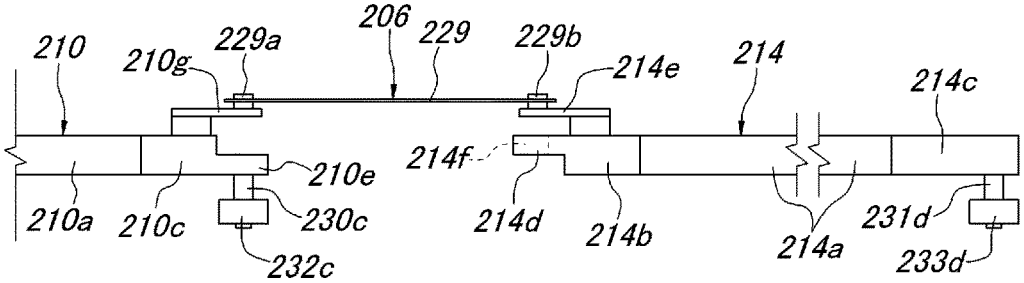
Figure 33B:
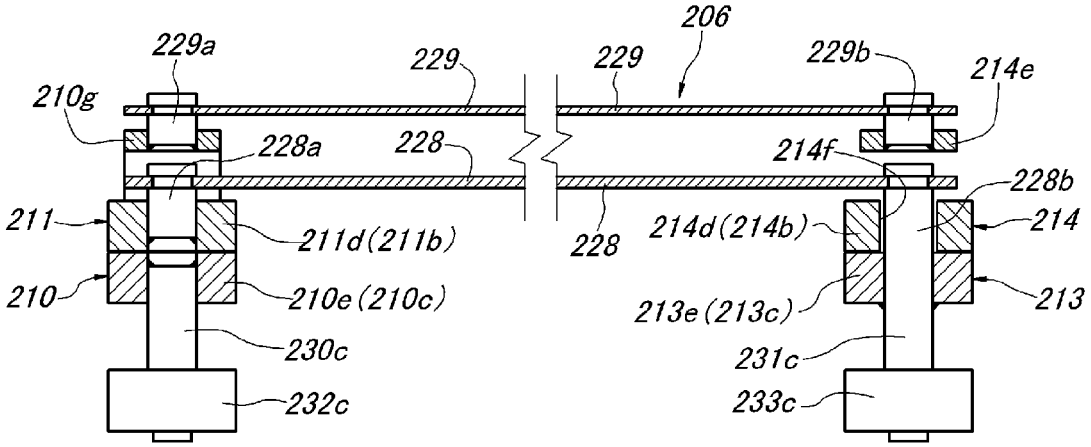
FIG. 33B is a longitudinal sectional rear view illustrating a rear wagon-to-wagon coupling means.
Figure 34C:
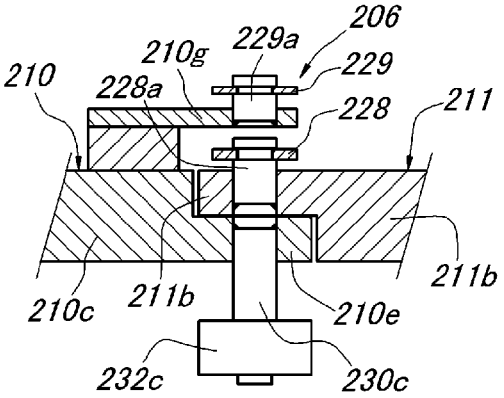
FIG. 34C is a longitudinal sectional side view at a position of a left vertical support shaft of the rear wagon-to-wagon coupling means.
Figure 34D:
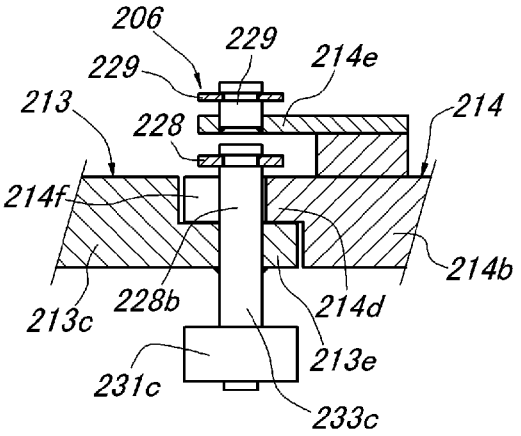
FIG. 34D is a longitudinal sectional side view at a position of a right vertical support shaft of the same wagon-to-wagon coupling means.

Thus, in the state of the central wagon 203 and the rear-end wagon 204 adjoining each other in the straight ahead orientation, the upper and lower both links 228, 229 are overlapped with each other, and both ends of the lower link 228 enter below the bearing members 210*g*, 210*e* pivotally supporting both ends of the upper link 229, and the vertical support shafts 228*a*, 228*b* pivotally supporting the both ends of the lower link 228 and the vertical support shafts 229*a*, 229*b* pivotally supporting the both ends of the upper link 229 are positioned concentric to each other, as illustrated in FIG. 33B, FIG. 34C, and FIG. 34D. At this time, the upper bearing portion 214*d* of the front end member 214*b* of the right rod member 214 of the rear-end wagon 204 enters below the right end of the lower link 228, whereby the upper bearing portion 214*d* and the long vertical support shaft 228*b* pivotally supporting the right end of the lower link 228 interfere with each other. In order to avoid this interference, the upper bearing portion 214*d* is formed with a notched groove 214*f* from the arc-shaped distal end to the central portion as illustrated in FIG. 30B, and an intermediate portion of the long vertical support shaft 228*b* is configured to enter into the notched groove 214*f*.

As described earlier, the length in the traveling direction of the central wagon 203 is long relative to that of the front- and rear-both end wagons 202, 204. All of the rod members 209 to 211 and 212 to 214 for constituting the load bars mounted to the respective wagons 202 to 204 are configured to have the same length but not a length conforming to the length in the traveling direction of respective wagons 202 to 204 to which the rod members are mounted. Therefore, the rod members 209, 211 and 212, 214 mounted to the front- and rear-both end wagons 202, 204 enter into a region of the central wagon 203, as illustrated in FIGS. 29A and 29B. With this, the front wagon-to-wagon coupling means 205 and the rear wagon-to-wagon coupling means 206 are provided at positions recessed inside from the front and rear both ends of the central wagon 203.

As illustrated in FIG. 31A to FIG. 32B, below the front end members 209*b*, 212*b* of the left and right both rod members 209, 212 of the front-end wagon 202 and below the rear end members 211*c*, 214*c* of the left and right both rod members 211, 214 of the rear-end wagon 204, rollers 232*a*, 232*d* and 233*a* and 233*d* are pivotally supported respectively by vertical support shafts 230*a*, 230*d* and 231*a*, 231*d* concentric to the center of the arc-shaped surface of the distal end of these end members. Further, below the end members 210*b*, 210*c* at the front and rear both ends of the left rod member 210 of the central wagon 203, rollers 232*b*, 232*c* are pivotally supported respectively by vertical support shafts 230*b*, 230*c* so as to be concentric to the vertical support shafts 227*a*, 229*a* pivotally supporting the left ends of the upper links 227, 229 at upper positions of the end members 210*b*, 210*c*. Below the end members 213*b*, 213*c* at the front and rear both ends of the right rod member 213 of the central wagon 203, rollers 233*b*, 233*c* are pivotally supported respectively by vertical support shafts 231*b*, 231*c* so as to be concentric to the long vertical support shafts 226*b*, 228*b* pivotally supporting the right ends of the lower links 226, 228 at upper positions of the end members 213*b*, 213*c*. As illustrated in FIG. 33A to FIG. 34D, the vertical support shafts 231*b*, 231*c* pivotally supporting the rollers 233*b*, 233*c* can be integrated with the long vertical support shafts 226*b*, 228*b* immediately thereabove to reduce the number of parts.

The rollers 232*a* to 232*d* and 233*a* to 233*d* pivotally supported as above constitute left and right two guide roller rows 234, 235 integral with the load bars 207, 208. In the state of the respective wagons 202 to 204 adjoining each other in the straight ahead orientation, the rollers 232*a* to 232*d* and 233*a* to 233*d* are aligned in a straight line parallel to the traveling direction of the conveying traveling body 201, similar to the respective rod members 209 to 211 and 212 to 214 constituting the load bars 207, 208.

Figure 35A:
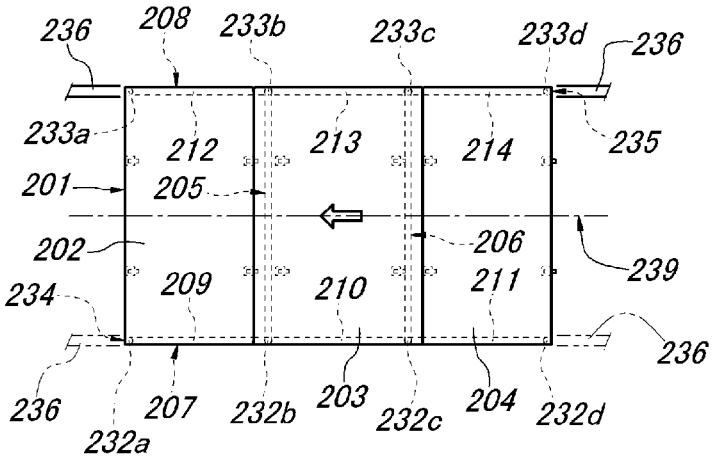
FIG. 35A is a plan view illustrating a state of the conveying traveling body at the time of traveling straight ahead.

In the thus configured conveying traveling body 201, the upper and lower both links 226, 227 and 228, 229 of the front and rear both wagon-to-wagon coupling means 205, 206 are overlapped with each other in an orientation orthogonal to the traveling direction of the conveying traveling body 201 and the vertical support shafts 226*a*, 227*a*, 226*b*, 227*b* and 228*a*, 229*a*, 228*b*, 229*b* at both ends of the upper and lower both links 226, 227 and 228, 229 are positioned concentric to each other in the state of the respective wagons 202 to 204 being in the straight ahead posture of adjoining in the straight ahead orientation, as illustrated in FIG. 35A. Thus, the front and rear adjacent wagons 202, 203 and 203, 204 do not swing relatively in the lateral direction. The conveying traveling body 201 can be made to travel straight ahead reliably and smoothly only by guiding the four rollers 232*a* to 232*d* or 233*a* to 233*d* of one of the left and right two guide roller rows 234, 235 by means of a straight-ahead channel guide rail 236 to which the rollers are fitted.

Figure 35B:
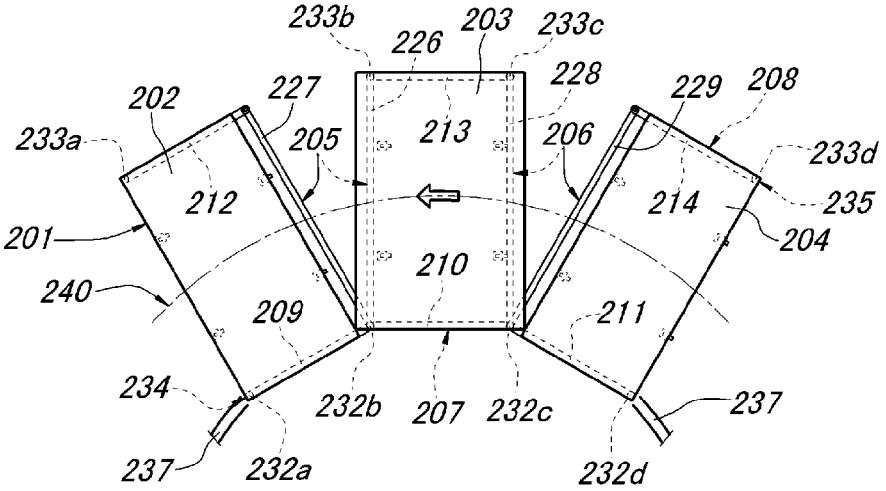
FIG. 35B is a plan view illustrating a traveling state of the conveying traveling body on the counterclockwise horizontal turn path section.

When the conveying traveling body 201 is desired to be turned counterclockwise and horizontally, the four rollers 232*a* to 232*d* of the left guide roller row 234 of the conveying traveling body 201 are guided by a counterclockwise circular channel guide rail 237 to which these rollers are fitted, as illustrated in FIG. 35B. When the conveying traveling body 201 is desired to be turned clockwise and horizontally, the four rollers 233*a* to 233*d* of the right guide roller row 235 of the conveying traveling body 201 are guided by a clockwise circular channel guide rail 238 to which these rollers are fitted. The conveying traveling body 201 guided by the counterclockwise circular guide rail 237 is bent horizontally leftward around the vertical support shafts 226*a*, 227*a* and 228*a*, 229*a* positioned on the left side of the front and rear both wagon-to-wagon coupling means 205, 206 and vertically concentric to each other (the vertical support shafts 230*b*, 230*c* of the intermediate rollers 232*b*, 232*c* of the left guide roller row 234) and travels in the posture where the respective wagons 202 to 204 are horizontally spread in a fan shape. At this time, the vertical support shafts 226*b*, 227*b* and 228*b*, 229*b* positioned on the right side of the front and rear both wagon-to-wagon coupling means 205, 206 and vertically concentric to each other are separated back and forth in the traveling direction integrally with the wagons 202 to 204 together with the rod members 212 to 214 to which respective vertical support shafts are mounted, and the upper and lower links 226, 227 and 228, 229 are opened in a V-shape around the vertical support shafts 226*a*, 227*a* and 228*a*, 229*a* positioned on the left side and vertically concentric to each other.

Figure 35C:
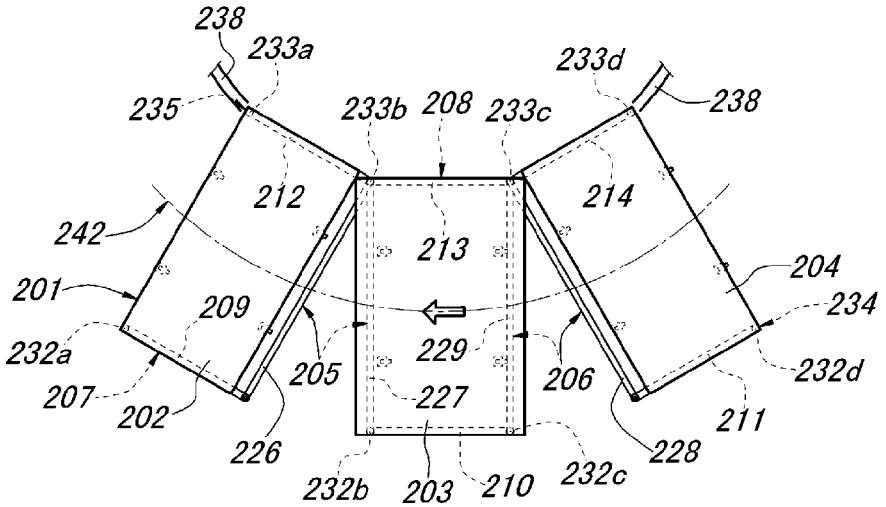
FIG. 35C is a plan view illustrating a traveling state of the conveying traveling body on the clockwise horizontal turn path section.

When the conveying traveling body 201 is desired to be turned clockwise and horizontally, the four rollers 233*a* to 233*d* of the right guide roller row 235 of the conveying traveling body 201 are guided by the clockwise circular channel guide rail 238 to which these rollers are fitted, as illustrated in FIG. 35C. The conveying traveling body 201 guided by the clockwise circular guide rail 238 is bent horizontally rightward around the vertical support shafts 226*b*, 227*b* and 228*b*, 229*b* positioned on the right side of the front and rear wagon-to-wagon coupling means 205, 206 and vertically concentric to each other (the vertical support shafts 231*b*, 231*c* of the intermediate rollers 233*b*, 233*c* of the right guide roller row 235) and travels in the posture where the respective wagons 202 to 204 are horizontally spread in a fan shape. At this time, the vertical support shafts 226*a*, 227*a* and 228*a*, 229*a* positioned on the left side of the front and rear both wagon-to-wagon coupling means 205, 206 and vertically concentric to each other are separated back and forth in the traveling direction integrally with the wagons 202 to 204 together with the rod members 209 to 211 to which respective vertical support shafts are mounted, and the upper and lower links 226, 227 and 228, 229 are opened in a V-shape around the right vertical support shafts 226*b*, 227*b* and 228*b*, 229*b* positioned vertically concentric to each other.

Figure 36:
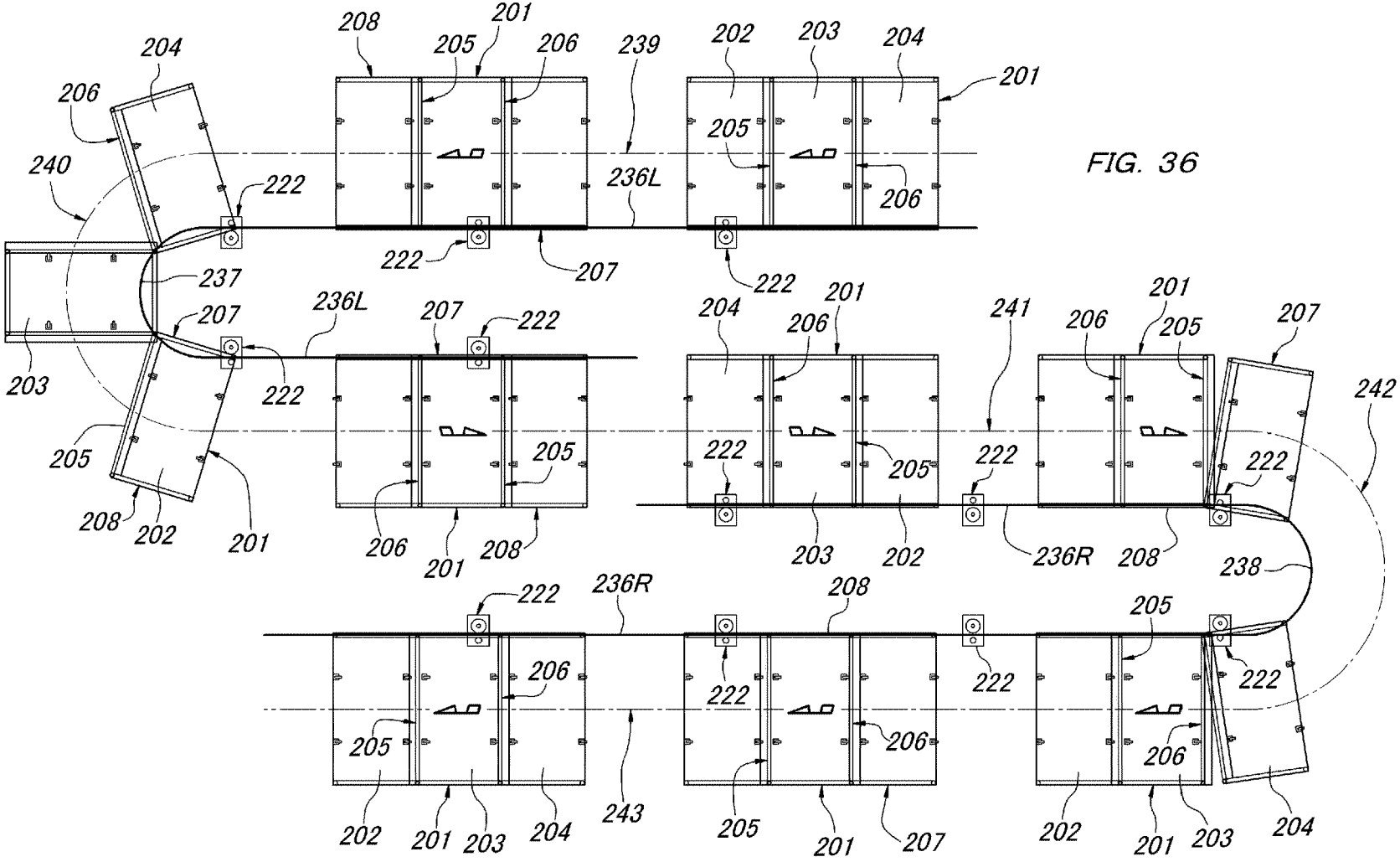

Specifically, the conveying traveling body 201 can be made to travel on a travel path in which a straight-ahead path section 239, a counterclockwise horizontal turn path section 240, a straight-ahead path section 241, a clockwise horizontal turn path section 242, and a straight-ahead path section 243 continue, as illustrated in for example FIG. 36. In this case, the counterclockwise circular guide rail 237 is laid on the counterclockwise horizontal turn path section 240, and the clockwise circular guide rail 238 is laid on the clockwise horizontal turn path section 242. On the straight-ahead path section 239 downstream of which the counterclockwise horizontal turn path section 240 is connected, a left straight-ahead guide rail 236L connected to the counterclockwise circular guide rail 237 of the counterclockwise horizontal turn path section 240 is laid. The straight-ahead path section 241 upstream of which the counterclockwise horizontal turn path section 240 is located and downstream of which the clockwise horizontal turn path section 242 is located is divided into an upstream region and a downstream region. On the upstream region, a left straight-ahead guide rail 236L connected to the counterclockwise circular guide rail 237 laid on the upstream counterclockwise horizontal turn path section 240 is laid. On the downstream region, a right straight-ahead guide rail 236R connected to the clockwise circular guide rail 238 laid on the downstream clockwise horizontal turn path section 242 is laid. In this case, in order not to generate a space between both upstream and downstream regions in which any roller of the left and right both guide roller rows 234, 235 is not guided, an exit position of the left straight-ahead guide rail 236L and an entrance position of the right straight-ahead guide rail 236R are configured to coincide in the traveling direction or the both straight-ahead guide rails 236L, 236R are configured to be overlapped in the traveling direction within an appropriate distance. As a matter of course, a right straight-ahead guide rail 236R connected to the clockwise circular guide rail 238 laid on the clockwise horizontal turn path section 242 is laid on the straight-ahead path section 243 downstream of the clockwise horizontal turn path section 242.

The left straight-ahead guide rail 236L and the right straight-ahead guide rail 236R connected upstream and downstream of the respective horizontal turn path sections 240, 242 preferably have a length long enough to guide the front and rear two rollers 232*a*, 232*b* or 233*a*, 233*b* of the front-end wagon 202 of the conveying traveling body 201 entering these straight-ahead guide rails 236L, 236R to hand over the conveying traveling body 201 to the next guide rail in the state that at least the front-end wagon 202 is guided completely in the straight ahead orientation.

On the thus configured travel path illustrated in FIG. 36, the conveying traveling body 201 is made to travel straight ahead while the respective wagons 202 to 204 adjoin each other and are integrated in the straight-ahead orientation, by guiding the respective rollers 232*a* to 232*d* of the left guide roller row 234 or the respective rollers 233*a* to 233*d* of the right guide roller row 235 with the use of the left straight-ahead guide rail 236L or the right straight-ahead guide rail 236R on each of the straight-ahead path sections 239, 241, 243. With this, the traveling of the conveying traveling body 201 entering from the straight-ahead path section 239 to the counterclockwise horizontal turn path section 240, exiting from the counterclockwise horizontal turn path section 240 to the straight-ahead path section 241, entering from the straight-ahead path section 241 to the clockwise horizontal turn path section 242, and exiting from the clockwise horizontal turn path section 242 to the straight-ahead path section 243 can be performed smoothly without any control. As a matter of course, the travel of the conveying traveling body 201 within the respective horizontal turn path sections 240, 242 can also be performed smoothly while the respective wagons 202 to 204 are spread in a fan shape as described earlier.

The travel path illustrated in FIG. 36 is schematically illustrated, and each actual entire length of the straight-ahead path sections 239, 241, 243 is several to several dozen times as long as the entire length of the conveying traveling body 201. When the conveying traveling body 201 is driven to travel by a friction drive means 222 on these straight-ahead path sections 239, 241, 243, the friction drive means 222 is disposed so as to drive one of the load bars 207, 208 having one of the guide roller rows 234, 235 guided by the left straight-ahead guide rail 236L or the right straight-ahead guide rail 236R laid on the respective straight-ahead path sections 239, 241, 243. At this time, when the respective conveying traveling bodies 201 are made to travel at constant speed while keeping a given interval, the friction drive means 222 are disposed at an interval equal to or shorter than the entire length of the conveying traveling body 201 (the entire length of the load bar 207, 208) as conventionally known. It is also known that when a zone where a plurality of conveying traveling bodies 201 are pushed and driven in the continuous state of abutting against each other in the front-rear direction is provided on the straight-ahead path section, the friction drive means 222 only need to be disposed at the entrance and the exit of this pushing drive zone. Furthermore, since the conveying traveling body 201 travels on the horizontal turn path sections 240, 242 with the respective wagons 202 to 204 spread in a fan shape, the curvature of the horizontal turn path sections 240, 242 can be made smaller as described earlier. Thus, as illustrated in FIG. 36, the friction drive means 222 can be disposed at the entrance and the exit of the horizontal turn path section 240, 242, and the load bar 207 or 208 of the conveying traveling body 201 sent into the horizontal turn path section 240, 242 by the friction drive means 222 at the entrance can be taken over to the friction drive means 222 at the exit before departing from the friction drive means 222 at the entrance, and the conveying traveling body 201 can be made to exit completely from the horizontal turn path section 240, 242 by the friction drive means 222 at the exit.

The conveyance device utilizing coupled wagons of the present invention is a conveyance device having a high degree of flexibility in layout of a conveying path, capable of combining freely a counterclockwise horizontal turn path section and a clockwise horizontal turn path section in a travel path of the conveying traveling body includes a plurality of wagons disposed in series in a traveling direction, and can be utilized for conveyance of automotive vehicle bodies in an automobile assembly line.

What is claimed is:

1. A conveyance device utilizing coupled wagons, the conveyance device comprising:

a conveying traveling body having a plurality of wagons disposed in series in a traveling direction;

a traveling drive means operable to make the conveying traveling body travel along a travel path;

a wagon-to-wagon coupling means having a pair of left and right coupling units respectively coupling left and right side portions of front and rear adjacent wagons, and the coupling units being operable to switch between a coupled state and an uncoupled state;

a first coupling control means disposed at an entrance side of a horizontal turn path section in the travel path and the first coupling control means is operable to switch at least one of the pair of left and right coupling units between the respective wagons of the conveying traveling body entering the horizontal turn path section from the coupled state to the uncoupled state; and the conveying traveling body being configured to enter into the horizontal turn path section with the coupling unit which becomes the inner side in a curving direction of the horizontal turn path section in the coupled state and the coupling unit which becomes the outer side in the curving direction of the horizontal turn path section in the uncoupled state.

2. The conveyance device according to claim 1, wherein:

the conveying traveling body is configured to travel with all of the coupling units being in the coupled state on a straight-ahead path section in the travel path, and the first coupling control means is operable to switch one coupling unit on a side opposite to a curving direction of the horizontal turn path section, from the coupled state to the uncoupled state, and the conveyance device includes a second coupling control means at an exit side of the horizontal turn path section operable to return the one coupling unit to the coupled state.

3. The conveyance device utilizing coupled wagons according to claim 2, wherein:

each of the coupling units comprises a vertical shaft positionally fixed to one of the front and rear adjacent wagons, a vertically movable bearing member is provided to the other of the front and rear adjacent wagons so as to be fittable and detachable with respect to the vertical shaft, a cam follower portion is provided to the movable bearing member, and the first and second coupling control means includes a cam rail operable to act upon the cam follower portion and to hold, for a fixed zone, the movable bearing member in a coupling released posture, detached upward from the vertical shaft.

4. The conveyance device according to claim 1, wherein:

the conveying traveling body has left and right two guide roller rows, and each of the guide roller rows comprises an intermediate-position roller provided rotatably about an axial center of the vertical shaft of a coupling unit at a position immediately below the vertical shaft, and end-position rollers provided rotatably about vertical axial centers at front and rear ends of the conveying traveling body, on the straight-ahead path section of the travel path, a straight-ahead guide rail is laid which is operable to guide the conveying traveling body via the respective rollers of at least one of the left and right guide roller rows, and on the horizontal turn path section of the travel path, a circular guide rail is laid which is operable to guide the conveying traveling body only via the respective rollers of a guide roller row located on the inner side in the curving direction of the path section.

5. The conveyance device according to claim 4, wherein the first coupling control means is operable to control one of the left and right coupling units and is juxtaposed with a guide rail controlling moving paths of the respective rollers of the guide roller row on a side where the coupling unit controlled by the coupling control means is located.

6. The conveyance device according to claim 1, wherein:

the traveling drive means comprises a friction drive load bar attached to the conveying traveling body and a friction drive unit having a friction drive wheel disposed on the travel path and rotating in pressure contact with the load bar, the load bar extends across the entire length of the conveying traveling body and has a plurality of load bar units on at least one of left and right side faces of the respective wagons, and the load bar units are disposed in series in the traveling direction, and the respective load bar units are horizontally turnably coupled together by the vertical shaft of the coupling unit.

7. The conveyance device according to claim 6, wherein:

the conveying traveling body is configured to travel with all of the coupling units in the coupled state on the straight-ahead path section in the travel path, and the first coupling control means is operable to switch one coupling unit of the pair of left and right coupling units on a side opposite to the curving direction of the horizontal turn path section, from the coupled state to the uncoupled state, a second coupling control means for returning the one coupling unit to the coupled state is provided at an exit side of the horizontal turn path section, and the second coupling control means is juxtaposed with a guide roller pair sandwiching, from left and right sides, the load bar units on a side of the one coupling unit controlled by the second coupling control means, and the guide roller pair is operable to control moving paths of the load bar units.

8. The conveyance device according to claim 6, wherein a friction drive load bar is disposed on the left and right side faces of the conveying traveling body.

9. The conveyance device according to claim 1, wherein:

the coupling units of the wagon-to-wagon coupling means include coupling units at a left row and coupling units at a right row and the coupling units are configured to be switchable between the coupled state and the uncoupled state in a way such that only the coupling units at either one of the left or right rows are operable to be in the coupled state, and the first coupling control means is operable to switch the coupling units of a row on a side of the curving direction of the horizontal turn path section, into the coupled state, when the coupling units of a row on a side opposite to the curving direction of the horizontal turn path section is in the coupled state passes.

10. The conveyance device according to claim 9, wherein:

each of the coupling units comprises a vertical shaft connected to one of the front and rear adjacent wagons and a hook-shaped coupling tool connected to the other one of the wagons so as to be laterally fittable and detachable with respect to the associated vertical shaft, the respective hook-shaped coupling tools of the pair of left and right coupling units are disposed such that lateral positions with respect to the associated vertical shafts are reverse to each other, and the vertical shafts and hook-shaped coupling tools of the coupling units of one of the left and right rows are fitted to each other and the vertical shafts and hook-shaped coupling tools of the respective coupling units of the other row are detached from each other by laterally and relatively moving the vertical shafts and hook-shaped coupling tools of the respective coupling units.

11. The conveyance device according to claim 10, wherein:

the vertical shafts and the hook-shaped coupling tools are respectively positionally fixed to the respective wagons, and when the wagon provided with the vertical shafts and the wagon provided with the hook-shaped coupling tools are laterally and relatively moved into a coupled position, the hook-shaped coupling tool is fitted to the vertical shaft in each of the coupling units at one of the left and right both rows and the hook-shaped coupling tool is detached from the vertical shaft in each of the coupling units at the other row, and the first coupling control means includes a controlling guide rail operable to guide the respective wagons so as to laterally and relatively move the wagon provided with the vertical shafts and the wagon provided with the hook-shaped coupling tools into the coupled position.

12. The conveyance device according to claim 11, wherein:

left and right guide roller rows are connected to the conveying traveling body and a guide rail is provided on the travel path, the left and right guide roller rows comprise rollers pivotally supported at left and right side portions of front and rear both ends of the respective wagons so as to be rotatable about vertical axial centers, and include rollers disposed below the vertical shaft of the each coupling unit and concentric to the associated vertical shaft, the hook-shaped coupling tool of the each coupling unit has a fitting groove having an arc shape centered around the vertical axial center of the roller disposed therebelow and has an opened end portion adjacent to the vertical shaft, a straight-ahead guide rail is operable to guide the respective wagons via the rollers in the straight-ahead path section of the travel path, a circular guide rail downstream of the straight ahead guide rail is operable to guide the respective wagons via the rollers in the horizontal turn path section, a lateral position of the circular guide rail and a lateral position of the straight-ahead guide rail are opposite, and the controlling guide rail is disposed upstream of a second straight-ahead guide rail connecting the controlling guide rail and the circular guide rail in the horizontal turn path section.

13. The conveyance device according to claim 12, wherein:

the traveling drive means comprises load bars mounted to the conveying traveling body parallel to the traveling direction and a friction drive wheel provided on the travel path so as to pressure-contact with side surfaces of the load bars, and the load bars comprise load bar units connected to the respective wagons and respectively arranged along the left and right both side faces of the respective wagons, and the rollers constituting the left and right guide roller rows are pivotally supported at front and rear end portions of the respective load bar units at the left and right rows.

14. A conveyance device utilizing coupled wagons comprising:

a conveying traveling body provided with a plurality of wagons disposed in series in a traveling direction and a wagon-to-wagon coupling means;

a guide means guiding the conveying traveling body so as to travel along a travel path;

the wagon-to-wagon coupling means having two links, and respective ends of each link being pivotally connected, by vertical support shafts, to one of the front and rear wagons, on laterally opposed sides thereof, when the front and rear two wagons coupled by the wagon-to-wagon coupling means adjoin each other in a straight ahead orientation, the two links are configured to be vertically overlapped in an orientation perpendicular to a wagon straight ahead direction and the vertical support shafts at both ends of the respective links are configured to be positioned concentrically;

the guide means includes left and right two guide roller rows and a guide rail laid on the travel path of the conveying traveling body and guiding at least one of the left and right two guide roller rows, and when the respective wagons adjoin each other in the straight ahead orientation, the left and right two guide roller rows comprise intermediate rollers pivotally supported to one of the front and rear two wagons coupled by the two links so as to be rotatable about vertical axial centers concentric to the mutually concentric vertical support shafts at both ends of the two links, and end rollers pivotally supported rotatably about vertical axial centers to end portions on a side opposite to a side where the intermediate rollers are located of the wagons at front and rear both ends, so as to be positioned on a straight line passing the intermediate rollers and being parallel to the wagon straight ahead direction.

15. The conveyance device according to claim 14, wherein the two links of the wagon-to-wagon coupling means are disposed at positions entering below either one of the front and rear adjacent wagons when the front and rear both wagons coupled by the links adjoin each other in the straight ahead orientation.

16. The conveyance device according to claim 14, wherein rod members are disposed at left and right two rows along the left and right side faces of the respective wagons, and the two links of the wagon-to-wagon coupling means have end portions pivotally supported above front and rear adjacent end portions of the rod members by the vertical support shafts, and the intermediate rollers of the left and right two guide roller rows are pivotally supported below either one of the front and rear adjacent end portions of the rod members, and the end rollers are pivotally supported below free end portions of the rod members of the wagons at the front and rear both ends.

17. The conveyance device according to claim 16, wherein:

the front and rear adjacent end portions of the rod members are vertically overlapped and formed in an arc shape concentric to the vertical support shafts, and when the respective wagons adjoin each other in the straight ahead orientation, the rod members at the left and right two rows constitute load bars at left and right two rows continuing across the entire length of the conveying traveling body and horizontally bendable at positions of the vertical support shafts positioned between the front and rear adjacent wagons, a lower link of the two links has one end pivotally supported directly by a vertical support shaft, above an upper end portion of the rod member targeted for pivotal support, and has the other end supported to an upper end portion of a long vertical support shaft erected from a lower end portion of the rod member targeted for pivotal support, an upper link of the two links has both ends pivotally supported by vertical support shafts, to bearing members mounted at positions apart from the end portions of the rod members targeted for pivotal support and extending above the lower link, the upper end portion of the rod member overlapping on the lower end portion of the rod member on which the long vertical support shaft is erected is formed with a notched groove to which the long vertical support shaft is fitted, and the traveling means includes the load bars at the left and right two rows and a friction drive wheel disposed on the travel path so as to pressure-contact with a side surface of at least one of the load bars.

18. The conveyance device according to claim 14, wherein:

the travel path includes a straight-ahead path section, a counterclockwise horizontal turn path section, and a clockwise horizontal turn path section, on each of the horizontal turn path sections, a circular guide rail is laid that guides the respective rollers of the guide roller row of the left and right two guide roller rows which is located on the inner side in a curving direction of the horizontal turn path section, at an upstream region of the straight-ahead path section, a straight-ahead guide rail is laid that is connected to the circular guide rail laid on the horizontal turn path section upstream from the straight-ahead path section, at a downstream region of the straight-ahead path section, a straight-ahead guide rail is laid that is connected to the circular guide rail laid on the horizontal turn path section downstream from the straight-ahead path section, and in an area where the straight-ahead guide rail at the upstream region of the straight-ahead path section and the straight-ahead guide rail at the downstream region are located on the same left or right side, the straight-ahead guide rails are connected with each other, and in an area where the straight-ahead guide rail at the upstream region of the straight-ahead path section and the straight-ahead guide rail at the downstream region are located at laterally opposite positions, the straight-ahead guide rails at the both regions are laid such that an exit end of the upstream straight-ahead guide rail and an entrance end of the downstream straight-ahead guide rail are not separated in the traveling direction.

* * * * *